US011371223B2

(12) United States Patent
Bierwith

(10) Patent No.: US 11,371,223 B2
(45) Date of Patent: Jun. 28, 2022

(54) FASTENER SYSTEMS HAVING ELONGATE ARCUATE BODY

(71) Applicant: Robert S. Bierwith, Berkeley, CA (US)

(72) Inventor: Robert S. Bierwith, Berkeley, CA (US)

( * ) Notice: Subject to any disclaimer, the term of this patent is extended or adjusted under 35 U.S.C. 154(b) by 0 days.

(21) Appl. No.: 17/199,356

(22) Filed: Mar. 11, 2021

(65) Prior Publication Data

US 2021/0293002 A1 Sep. 23, 2021

Related U.S. Application Data

(60) Provisional application No. 62/988,319, filed on Mar. 11, 2020.

(51) Int. Cl.
*E02F 9/28* (2006.01)
*E02F 3/815* (2006.01)

(52) U.S. Cl.
CPC ..... *E02F 9/2833* (2013.01); *E02F 3/8152* (2013.01); *E02F 9/2883* (2013.01)

(58) Field of Classification Search
CPC ..... E02F 9/2833; E02F 9/2858
See application file for complete search history.

(56) References Cited

U.S. PATENT DOCUMENTS 4,360,981 A 11/1982 Bierwith et al.
4,413,432 A 11/1983 Bierwith
4,455,771 A 6/1984 Poncin
4,456,307 A * 6/1984 Merten ..... E21C 35/19 299/103
4,570,365 A 2/1986 Bierwith
4,579,494 A 4/1986 Bierwith
4,626,034 A * 12/1986 Breuer ..... E21C 35/19 299/108
4,762,372 A * 8/1988 Rassmann ..... E21C 35/19 299/108
4,903,420 A * 2/1990 Kreitzberg ..... E02F 9/2841 37/195
5,052,134 A 10/1991 Bierwith
5,134,793 A 8/1992 Bierwith
5,417,518 A 5/1995 Bierwith
5,526,592 A 6/1996 Bierwith
5,680,717 A 10/1997 Bierwith
6,032,390 A 3/2000 Bierwith
6,151,812 A 11/2000 Bierwith
6,216,368 B1 4/2001 Bierwith
6,393,738 B1 5/2002 Bierwith
(Continued)

*Primary Examiner* — Gary S Hartmann
(74) *Attorney, Agent, or Firm* — Cislo & Thomas, LLP

(57) ABSTRACT

The present fastener securely couples a first body to a second body, where the fastener includes an elongate arcuate body curved along a longitudinal axis and having a cross-sectional area taken planar normal to the longitudinal axis, the elongate arcuate body includes a first portion separated along the longitudinal axis from a second portion with the cross-sectional area of the elongate body increasing from the first portion to the second portion. The fastener further includes a retaining portion configured to selectively secure the elongate arcuate body in the inserted configuration. In use, the present fastener is configured to be inserted into a passage delineated between a first body and a second body which are overlapping at least in part, to selectively lock the first body and the second body in the coupled configuration.

17 Claims, 51 Drawing Sheets

(56) References Cited

U.S. PATENT DOCUMENTS

| | | | | |
|---|---|---|---|---|
| 6,415,533 | B2 | 7/2002 | Bierwith | |
| 6,652,186 | B2 | 11/2003 | Bierwith | |
| 6,668,472 | B2 | 12/2003 | Bierwith | |
| 6,675,509 | B2 | 1/2004 | Bierwith | |
| 6,751,897 | B2 | 6/2004 | Bierwith | |
| 6,952,892 | B1 | 10/2005 | Bierwith | |
| 7,121,022 | B2 | 10/2006 | Bierwith | |
| 7,559,162 | B2 | 7/2009 | Bierwith | |
| 8,127,476 | B2 | 3/2012 | Bierwith | |
| 8,464,444 | B2 | 6/2013 | Bierwith | |
| 8,800,178 | B2 * | 8/2014 | Rol Corredor | E02F 9/2858 37/456 |
| 9,074,350 | B2 * | 7/2015 | LaHood | E02F 9/2891 |
| 9,187,881 | B2 | 11/2015 | Bierwith et al. | |
| 9,249,558 | B2 | 2/2016 | Bierwith | |
| 9,689,146 | B2 | 6/2017 | Bierwith et al. | |
| 9,840,828 | B2 | 12/2017 | Bierwith | |
| 9,920,504 | B2 | 3/2018 | Bierwith | |
| 10,047,503 | B2 * | 8/2018 | Lahood | E02F 9/2841 |
| 2001/0020342 | A1 | 9/2001 | Bierwith | |
| 2002/0133986 | A1 | 9/2002 | Bierwith | |
| 2003/0037467 | A1 | 2/2003 | Bierwith | |
| 2003/0063951 | A1 | 4/2003 | Bierwith | |
| 2003/0093928 | A1 | 5/2003 | Bierwith | |
| 2003/0101627 | A1 | 6/2003 | Robinson | |
| 2004/0216335 | A1 | 11/2004 | Jones | |
| 2005/0229442 | A1 | 10/2005 | Jones et al. | |
| 2005/0229443 | A1 | 10/2005 | Bierwith | |
| 2005/0241194 | A1 | 11/2005 | Bierwith | |
| 2005/0241195 | A1 | 11/2005 | Bierwith | |
| 2005/0284006 | A1 | 12/2005 | Jones | |
| 2007/0022640 | A1 | 2/2007 | Jones et al. | |
| 2010/0162594 | A1 | 7/2010 | Bierwith | |
| 2011/0061271 | A1 | 3/2011 | Bierwith | |
| 2011/0108632 | A1 | 5/2011 | Brandenburg et al. | |
| 2013/0047475 | A1 | 2/2013 | Bierwith | |
| 2013/0145659 | A1 | 6/2013 | Lahood et al. | |
| 2013/0318839 | A1 | 12/2013 | Bierwith | |
| 2014/0360060 | A1 | 12/2014 | Kunz | |
| 2015/0082671 | A1 | 3/2015 | Bierwith et al. | |
| 2015/0376872 | A1 | 12/2015 | Bierwith | |
| 2016/0053466 | A1 | 2/2016 | Bierwith et al. | |
| 2018/0171602 | A1 | 6/2018 | Quarfordt et al. | |

* cited by examiner

FASTENER SYSTEMS HAVING ELONGATE ARCUATE BODY

CROSS-REFERENCE TO RELATED APPLICATION

This application claims the benefit of U.S. Provisional Patent Application Ser. No. 62/988,319, filed on Mar. 11, 2020, which is entitled "Fasteners and Fastener Systems," and is incorporated in its entirety herein by this reference.

TECHNICAL FIELD

The invention described herein generally relates to fasteners for connecting overlapping portions of two objects and selectively removable when separation of the two objects is desired.

BACKGROUND

Fasteners used to temporarily connect objects often have issues with retraction of the fastener for separating the objects, due to rust, debris, wear, and the like. For example, replaceable wear components are used in mining and construction machinery (such as shrouds, teeth, guards, adapters, lip assemblies, and so on) protect the leading edges, corners, and various surfaces from undue abrasion due to excavation. The wear components may attach to and protect portions of buckets, blades, rippers, etc. which would wear prematurely without the wear components. The wear components are bolted, pinned, etc. to machinery attachments and implements. Due to the extreme usage conditions and excessive wear and tear, it is often difficult to remove the fasteners, wasting time and resources. A more reliable fastener system is needed for quickly and easily changing wear components.

SUMMARY

The present specification discloses a fastener includes an elongate arcuate body curved along a longitudinal axis and having a cross-sectional area taken planar normal to the longitudinal axis, the elongate arcuate body comprising a first portion separated along the longitudinal axis from a second portion with the cross-sectional area of the elongate body increasing from the first portion to the second portion, and a retaining portion configured to selectively secure the elongate arcuate body in an inserted configuration.

Other features and advantages of aspects of the present invention will become apparent from the following more detailed description, taken in conjunction with the accompanying drawings, which illustrate, by way of example, the principles of aspects of the invention.

BRIEF DESCRIPTION OF DRAWINGS

FIG. 46 is exploded perspective view of the fastener of FIG. 43, aligned and ready to connect a tooth to the lip of an implement to create a lip assembly;

DETAILED DESCRIPTION

Figure 1:
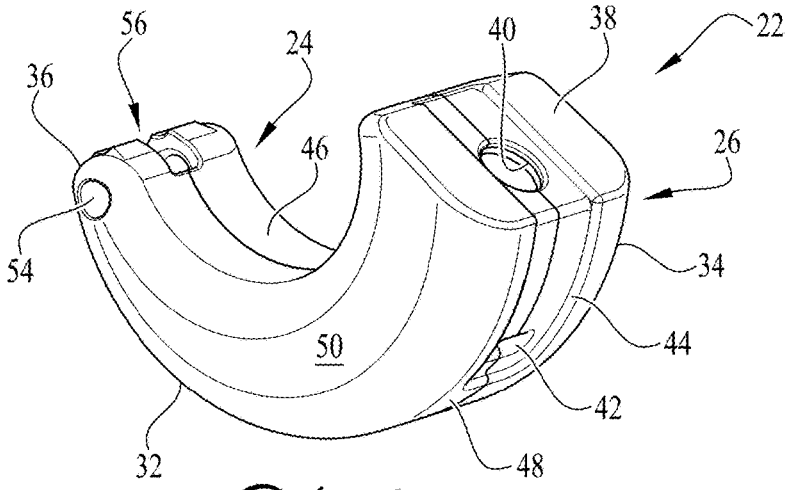
FIG. 1 is a perspective view of an embodiment of a fastener.
Figure 2:
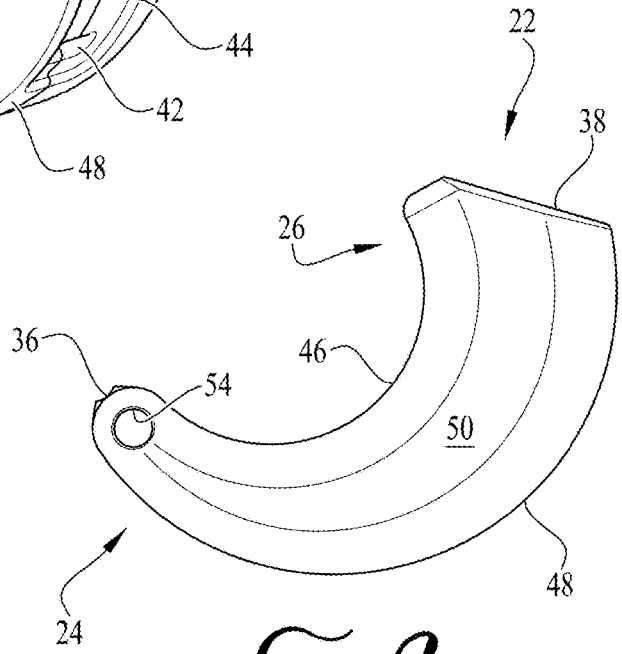
FIG. 2 is a bottom view of the fastener of FIG. 1.
Figure 3:
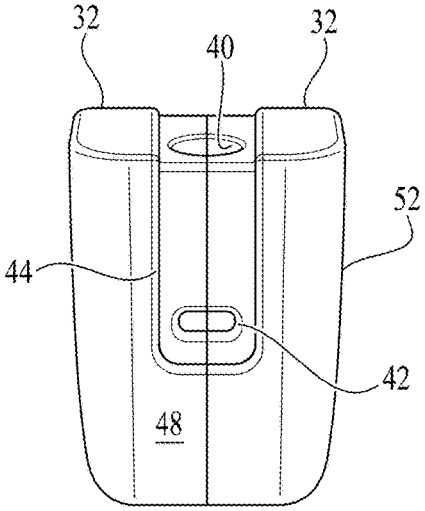
FIG. 3 is an end view of the fastener of FIG. 1.
Figure 4:
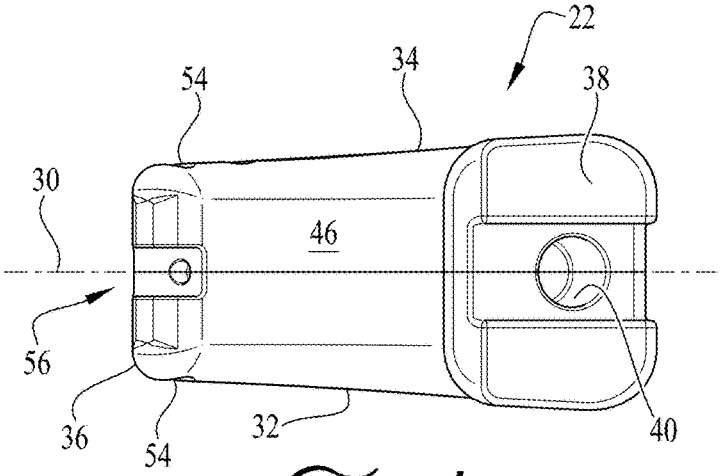
FIG. 4 is a top view of the fastener of FIG. 1.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Looking first at the example embodiment illustrated in FIGS. 1-8, a fastener 20 is shown In FIGS. 1-4, the elongate arcuate body 22 is shown isolated from the remaining components of the fastener 20. The elongate arcuate body 22 generally includes a first end 36 opposite a second end 38. A first portion 24 is a part of the elongate arcuate body 22 that is closer in proximity to the first end 36 than the second end 38, and can, in one or more embodiments, include or exclude the first end 36. A second portion 26 is a part of the elongate arcuate body 22 that is closer in proximity to the second end 38 than the first end 36, and can, in one or more embodiments, include or exclude the second end 38. Although the first end 36 is shown as a planar face in this embodiment, the first end 36 can be of any geometry, as the application or aesthetics dictate.

Looking at the outer surface of the elongate arcuate body 22, there is an inner surface 46 opposite to and generally having a smaller radius than the outer surface 48. Although the curvature of the inner surface 46 and the outer surface 48 are described as having a radius, the curvature of each of the surfaces can have a constant radius (e.g., an arc of a circle) or a radius that is variable or not constant (e.g., an arc of an ellipse, a curvilinear shape). Furthermore, portions of the inner surface 46 and the outer surface 48 may include non-curved surfaces (e.g., depressions, protrusions, planar portions, and so on). Thus, the radius or curvature of the elongate arcuate body 22 in general, the inner surface 46, and the outer surface 48, can mean, in one or more embodiments, that the general curvature is considered while ignoring relatively small discontinuities between the first portion 24 and the second portion 26 (e.g., sufficiently small as to not interfere with insertion or retraction, as will be discussed further below). A first side surface 50 is opposite a second side surface 52, and each are adjacent to the inner surface 46 and the outer surface 48. The inner surface 46, the outer surface 48, the first side surface 50, and the second side surface 52 are illustrated in the example embodiments herein with a particular shape. However, the shape of each surface can vary, and can be rounded, planar, lofted surface, or a combination of varying surfaces.

Looking at the second end 38 of the elongate arcuate body 22, a blind bore creates an extraction bore 40, into which the working portion of an extraction tool can be inserted (not shown, but can be a rod, screw driver, or similar tool which provides purchase and mechanical advantage to pry and loosen the fastener 20). The second end 38, in this example embodiment, includes opening forming a jaw 56 with a through hole 54 for rotatably capturing a pin, much like a clevis. The jaw 56 can be formed by the mating of notched ends of the first half 32 and the second half 34 (each machined or cast separately in this example). The hole 54 of for the pin (such as the head of a T-bolt) can be formed as blind holes on the inner opposing sides of each side of the jaw 56 or as a through hole formed normal to the mesial plane 30 (e.g., the plane through the middle of the elongate arcuate body 22, symmetric or not, and, in this example, the physical division of the of the first half 32 and the second half 34).

A recess 44 is formed in the second end 38 and extending onto the outer surface 48 at the region adjacent to the first end 38, for receiving therein a protective cover 58 (see FIG. 5) in a recessed or flush configuration with the surrounding surfaces. The protective cover 58 is held in place on the elongate arcuate body 22 by engaging the extraction hole 40 and the undercut hole that forms a locking slot 42 (a blind slot with an undercut in this example embodiment) formed within the recess 44 on the outer surface 48. A radiused or chamfered rim formed on the locking slot 42 provides a lead-in to ease the insertion of the bulbous boss 62 of the protective cover 58.

Figure 5:
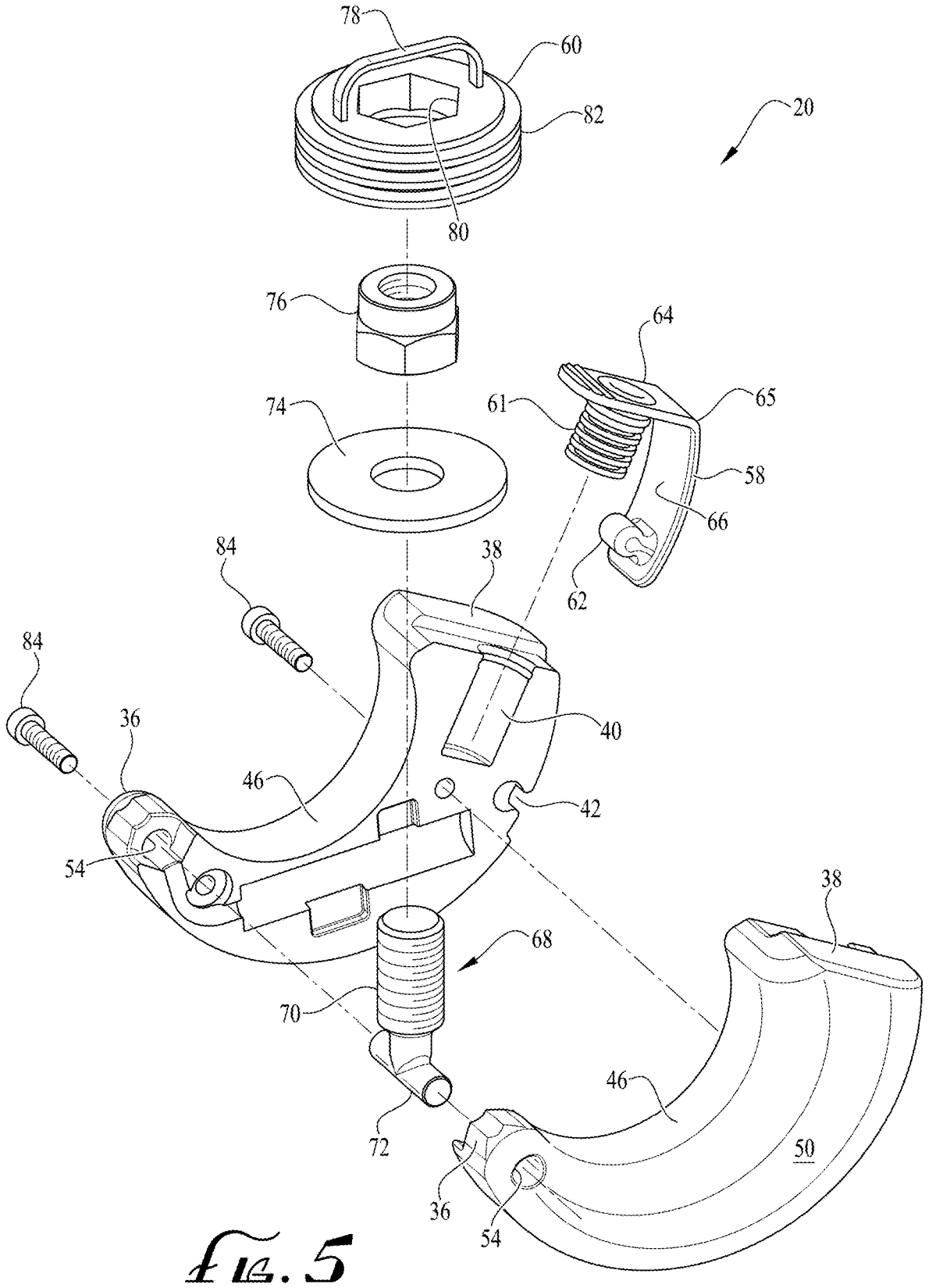
FIG. 5 is exploded perspective view of the fastener assembly of FIG. 1.

Turning now to FIG. 5, a complete exploded assembly of at least one embodiment of the present fastener 20 is shown with optional protective covers 58, 60. The elongate arcuate body 22 is made fastening the first half 32 to the second half 34, using screws 84. However, the elongate arcuate body 22 can be of a unitary or welded design, made from a cast metal alloy or other material appropriate for a given application. As the first half 32 and the second half 34 are fastened, the pin 72 of the T-bolt 68 is captured within the jaw 56 halves within the holes 54, such that the threads 70 on the shaft (or rod member) of the T-bolt extend from the first end 36 when assembled and rotates about the pivot created by the pin 72 captured within the holes 54. The washer 74 and threaded nut 76 engage the threads 70 of the T-bolt 68, to mechanically block retraction of the elongate arcuate body 22 from the inserted configuration. The protective cover 60 is placed over the nut 76, with the nut 76 inserted into the hexagonal hole 80. Annular ribs 82 extend from the outer diameter of the protective cover 60, which engage the walls of a recess to protect the retaining portion beneath, including the nut 76, the optional washer 74, and the T-bolt hinged or otherwise pivoted on the first end 36. A handle 78 is provided on the protective cover 60 to provide purchase and permit removal or other manipulation.

Protective cover 58 is configured to engage the extraction bore 40 by insertion of the ribbed boss 61 extending from the cap portion 64 into the extraction bore 40. A second boss 62 extends from the side portion 66 of the protective cover. The second boss 62 has a bulbous cross-sectional shape (e.g., a necked base with an enlarged tip), that is configured to snap into the undercut hole (or receiver) and lock in place due to the enlarged tip being removably trapped beneath the undercut opening. A living hinge 65 permits the cap portion 64 to rotate about the side portion 66.

Figure 6:
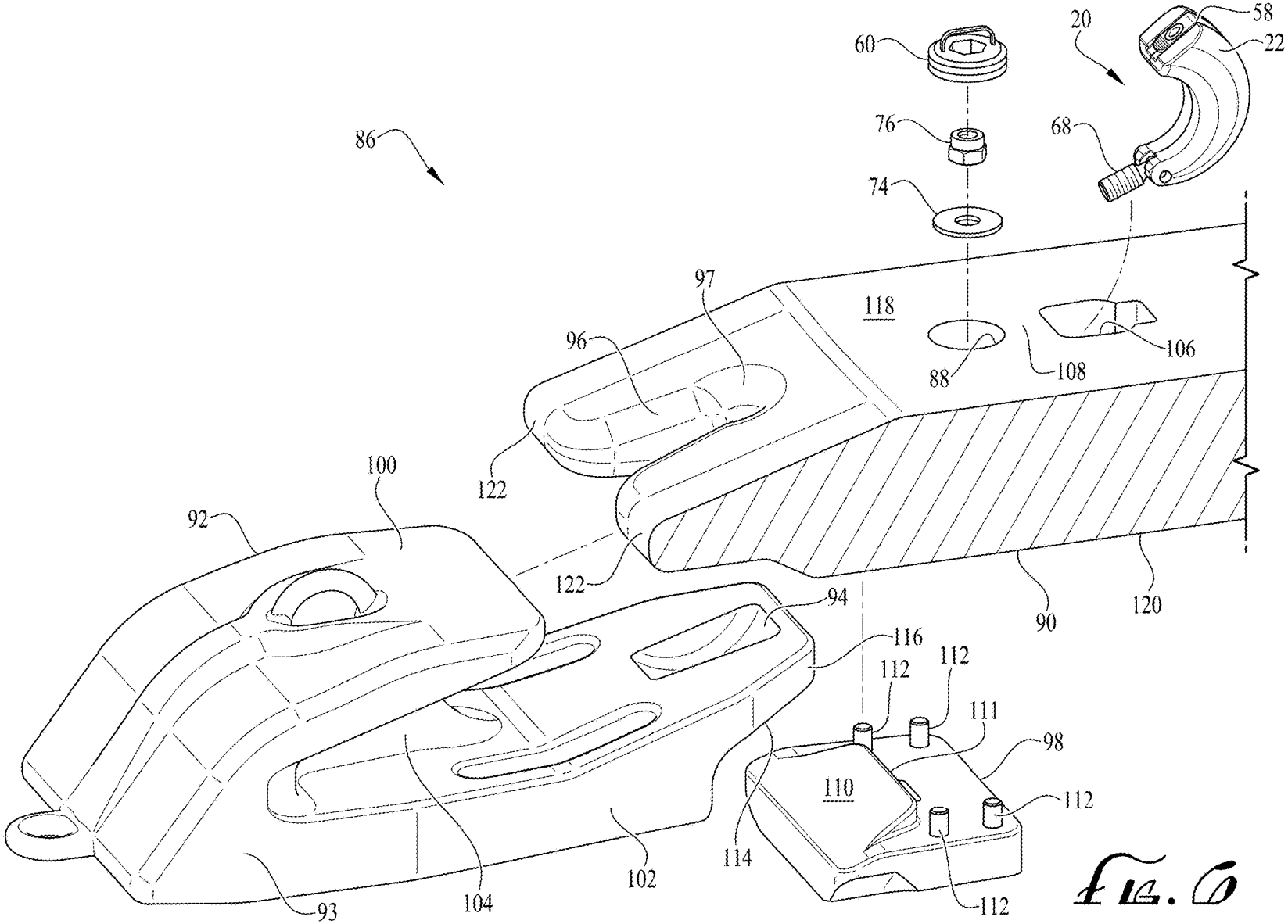
FIG. 6 is exploded perspective view of the fastener assembly of FIG. 1, aligned and ready to connect a tooth to the lip of an implement to create a lip assembly.
Figure 8:
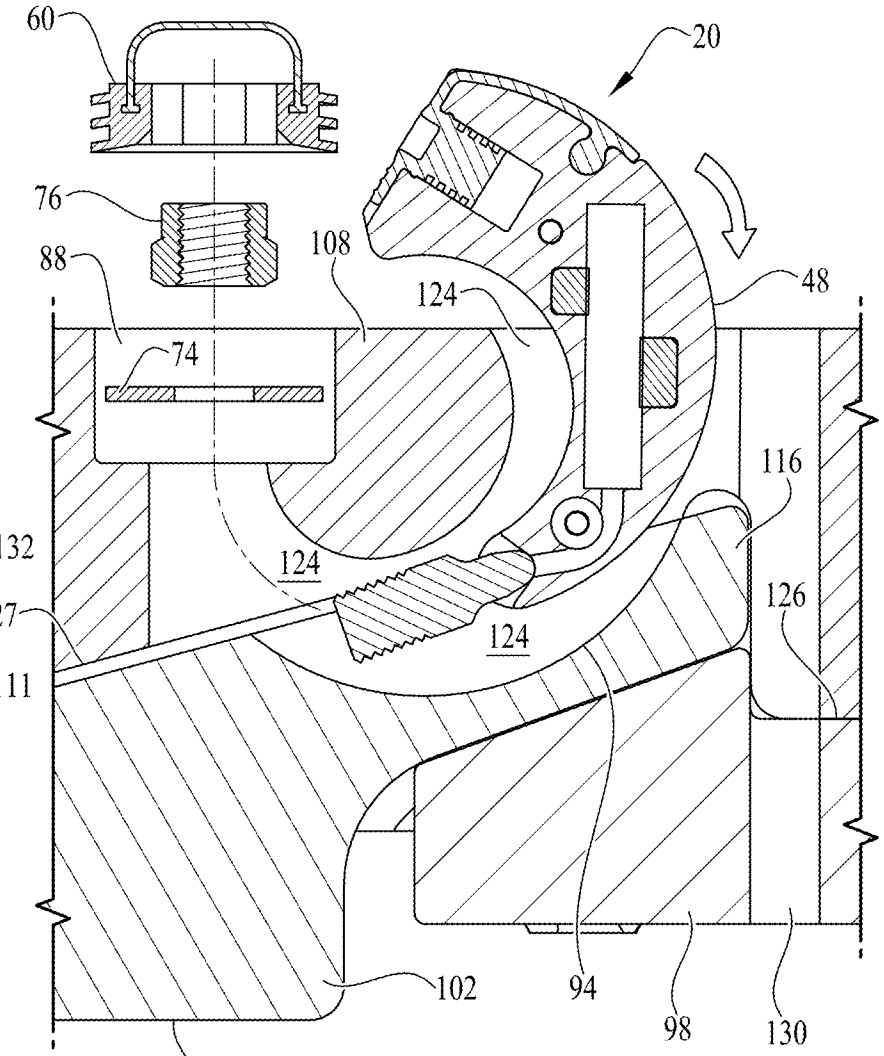
FIG. 8 is a sectional view of the assembled lip assembly of FIG. 6 taken on-center and along the longitudinal axis of the fastener, showing the fastener rotating into the inserted configuration.
Figure 7:
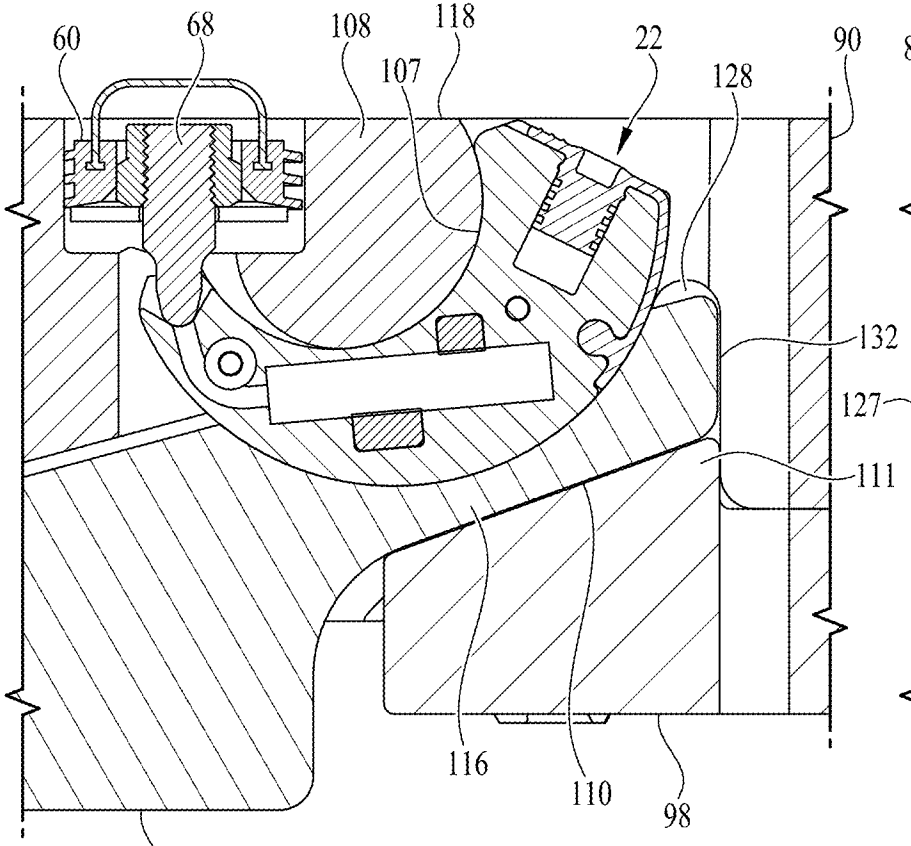
FIG. 7 is a sectional view of the assembled lip assembly of FIG. 6 taken on-center and along the longitudinal axis of the fastener, showing the fastener in the inserted configuration.
Figure 9:
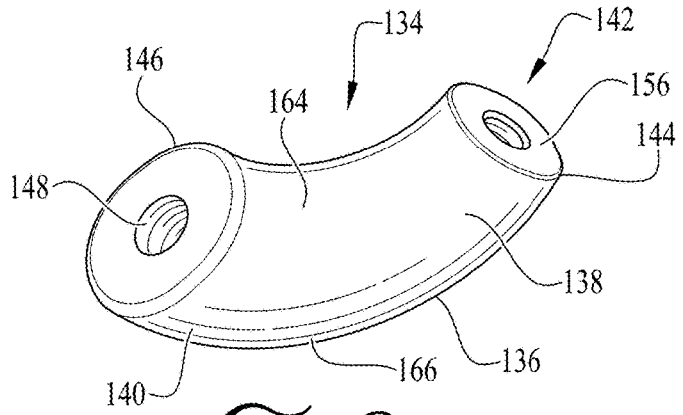
FIG. 9 is a perspective view of an another embodiment of the present fastener.
Figure 10:
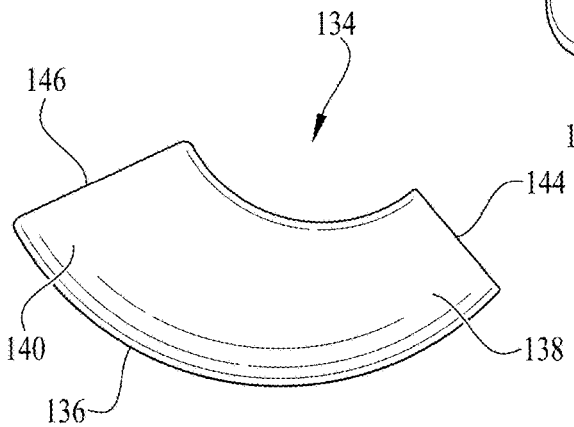
FIG. 10 is a side view of the fastener of FIG. 9.
Figure 11:
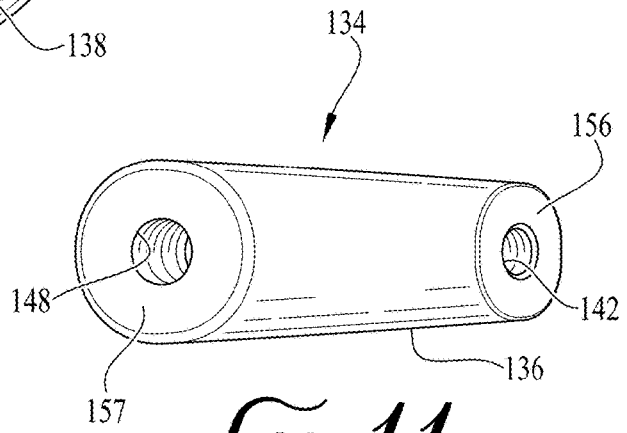
FIG. 11 is an top view of the fastener of FIG. 9.
Figure 12:
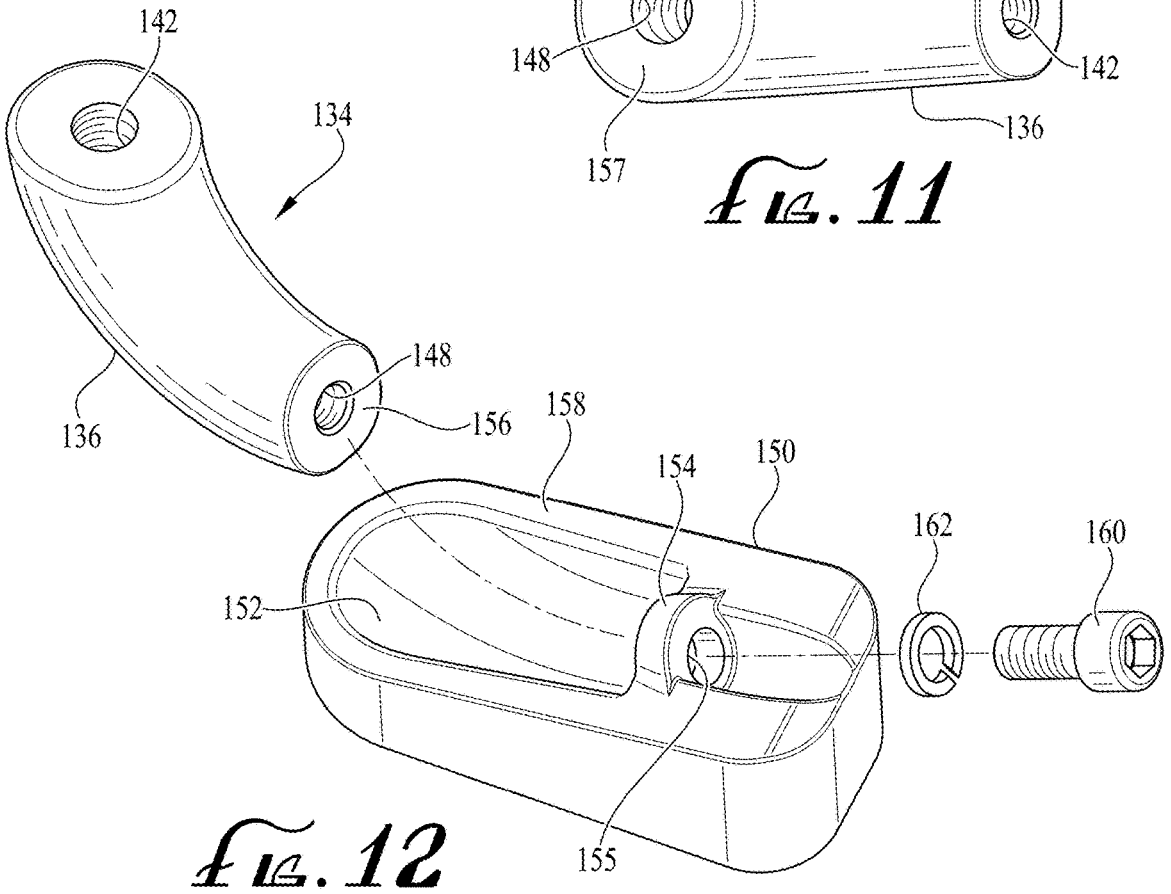
FIG. 12 is an exploded perspective view of the fastener of FIG. 9, shown aligned and ready to be seated within the seat insert.
Figure 13:
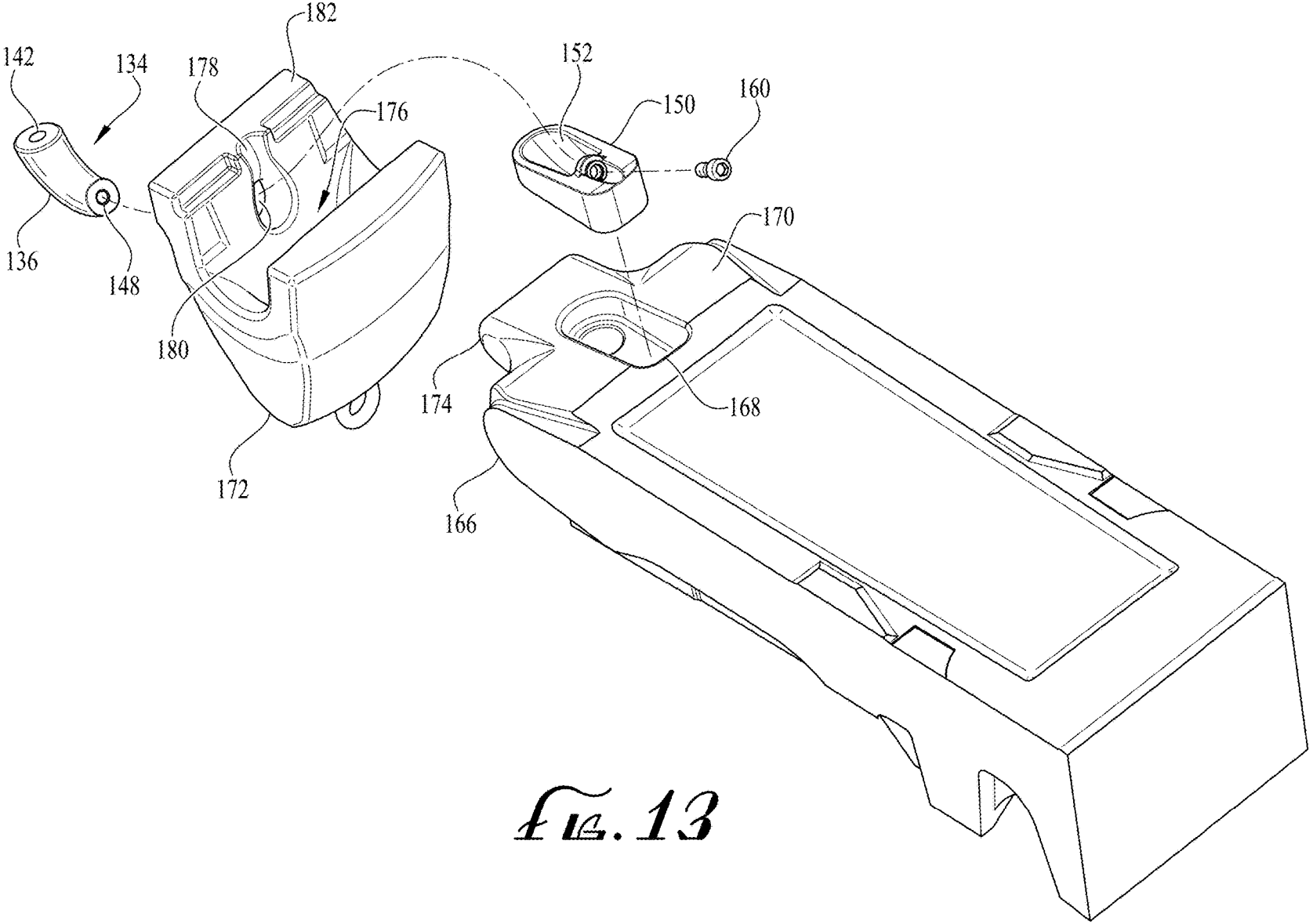
FIG. 13 is exploded perspective view of the fastener of FIG. 9, aligned and ready to connect a tooth to the lip of an implement to create a lip assembly.

FIGS. 6-8 illustrate a lip assembly 86 (e.g., attachable to or integrated with the edge of an implement, such as an excavator bucket, loader bucket, or the like), with a shroud 92 aligned with and ready to be mounted to a lip 90 (which is attachable to or integrated with the edge of an implement). Just a section of the lip 90 is shown, where the lip 90 can be a number of feet long. The structure of the lip 90 is generally repeating for at least a distance along the edge 122. In this case, a wedge-shaped notch 96 is formed on the edge 122, with a radiused root 97 to reduce stress. The top surface 118 (or the bottom surface 120 in one or more embodiments) includes an entry hole 106, for receiving the fastener 20 by the first end 36, aligned with a counterbore hole 88. The fastener 20 is inserted through the entry hole 106 and threaded through a converging arcuate passage 124 (shown in FIGS. 7 and 8), with the T-bolt 68 freely hinging on the first end 36 to aid in navigation of the converging arcuate passage 124 to exit through the counterbore hole 88.

The shroud 92 (or other similar attachable wear part or protective part) includes a top leg 100 spaced apart from a bottom leg 102 and connected at the tip 93, creating a U-shaped opening for receiving the edge 122 of the lip 90 inserted between the top leg 100 and the bottom leg 102. A web 104 extends between the top leg 100 and the bottom leg 102 and spans the U-shaped opening to divide the opening into two substantially symmetric openings, into which the edges 122 on each side of the wedge-shaped notch 96 are received, while the web 104 is received by the wedge-shaped notch 96 (e.g., the notch 96 is formed through the edge 122 of the lip 90 during casting forming a V-like converging shape for guiding in and firmly seating web 104 of the shroud 92). The top leg 100 and the bottom leg 102 prevent shifting of the shroud 92 relative to the lip 90 in the vertical direction (i.e., in this example, the vertical axis is planar normal to the top surface 118 of the lip 90). The joint created by the web 104 inserted within the wedge-shaped notch 96 prevents shifting of the shroud 92 relative to the lip 90 in the lateral direction along the edge 122 (i.e., in this example, the lateral direction is parallel to the plane of the top surface 118 of the lip 90 and restricted approximately to travel along the edge 122). As will be discussed further below, the fastener 20, when in the inserted configuration, prevents the web 104 from being withdrawn from the notch 96. The shroud 92 further includes a seat 94 for receiving a portion of the elongate arcuate body 22 of the fastener 20. In this example, the seat 94 is shaped complementarily to the elongate arcuate body 22 and forms part of the converging arcuate passage 124. The shape of the seat 94, in this example, is a depression formed on a tongue portion of the bottom leg 102. The depression is shown as a slot with a generally rectangular opening and an arcuate bottom (much like that created by a circular saw plunge cut). Although, the seat 94 is shown as having an arcuate bottom floor, a flat-bottomed slot or other shaped slots can work to prevent the shroud 92 from sliding past the fastener 20, as will be described in further detail below.

Looking at FIGS. 6-8, a tail plate 98 is fastened (or integrally formed) within an upper step 126 of a stepped recess formed into the bottom surface 120 of the lip 90 beneath or nearby the entry hole 106 using screws 112. An inclined portion 110 (e.g., a ramp) on the tail plate 98, starting at the front edge 109 forms a step 111, where both the inclined portion 110 and the step 111 protrude into the lower step 127 (e.g., the stepped recess forms a cavity with a shallow step and a deeper portion, with parts of the recess extending through the thickness of the lip 90 to form the entry hole 106 and counterbore hole 88). The tongue 116 of the shroud 92 is inserted within the lower step 127, where the tongue 116 limited in its insertion by contacting the back wall 132 of the lower recess 128. The tongue 116 is formed with an inclined portion 114 that closely matches the inclined portion 110 of the tail plate 98, so that once the tail plate 98 is fastened in place, the tongue 116 is closely fitted within the pocket defined between the lower step 127 and the inclined portion 110 of the tail plate 98.

FIG. 8 illustrates the tongue 116 of the shroud 92 within the lower step 127 and inserted within the pocket defined by the inclined portion 110 of the tail plate 98. The entry hole 106 and counterbore hole 88 open into the lower step 127, with the entry hole 106 and counterbore hole 88 separated (at least in part and at least at or near the top surface 118) by the cross member 108. The cross member 108 has a curved profile 107 which forms a portion of the passage 124, with the seat 94 forming yet another portion of the passage 124. In at least one embodiment, passage 124 is converging (or otherwise reducing in cross-section area or size) at least in part so that the elongate arcuate body 22 of the fastener 20 can be inserted therein, yet not fully pulled through the counterbore hole 88 (or, in differing or similar embodiments, other holes through which the retaining portion of the fastener may be accessed besides the entry hole 106). FIG. 8 further shows the fastener 20 partially inserted with the T-bolt 68 being pushed through the passage 124, pivoting to move through the curve of the passage 124.

FIG. 7 illustrates the fastener 20 in the inserted configuration, with the elongate arcuate body 22 fully seated within the passage 12. Although it is not required for the operation of all embodiments, the washer 74 is within the counterbore 88, with the nut 76 threaded to the threads of the T-bolt 68 and the protective cover 60 attached within the counterbore 88. The nut 76 may be tightened down so that the washer 74 bears down on the bottom of the counterbore 88 shoulder or left loosely, yet securely connected to the T-bolt 68, so that the washer 74 and nut 76 prevent the fastener 20 from retracting. When the nut 76 is tightly threaded to the T-bolt 68, the elongate arcuate body 22 is pulled completely into the passage 124, and wedged into place, due to the relatively larger second portion 26 of the elongate arcuate body 22 preventing further insertion into the converging passage 124 (e.g., in at least one embodiment, the elongate arcuate body 22 is formed like a wedge that has been bent to from an arcuate shape, where the wedge is formed by sloping at least one surface to converge toward its opposing surface).

Still looking at FIG. 7, with the fastener 20 in the inserted configuration, the inner surface 46 of the elongate arcuate body 22 contacts the cross member 108 on the curved profile 107; while, simultaneously, the outer surface 48 (and surrounding portions of the elongate arcuate body 22 are seated within the seat 94 formed as a depression on the tongue 116 of the shroud 92, thus, trapping the tongue 116 between the inclined portion 110 of the tail plate 98 and the fastener 20. If a force were to be applied to the shroud 92 in an attempt to withdraw the tongue 116, inner surface 46 the elongate arcuate body 22 would firmly contact the curved profile 107 (or any surface created by a similar member); and the outer surface 48 would be firmly contacted by the seat 94, pinching and wedging the elongate arcuate body 22 of the fastener 20 between the seat 94 and the curved profile 107 of the cross member 108. The tail plate 98 prevents the tongue 116 from separating from the fastener 20. Because the fastener 20 is prevented from further insertion due to being wedged, in this example, between the seat 124 and the cross member 108 within the passage 124 defined between the two, and because the seat 124 is not permitted to substantially separate (e.g., increase the gap between) from the cross member 108, the tongue 116 cannot be pulled out of the pocket 128, unless the fastener 20 is sufficiently retracted from the passage 124. Even with the nut 76 and washer 74 removed, this wedging action would still persist and prevent withdrawal. Although, some sort of retainer (e.g., a nut, a retaining ring, a pin, a collar, or other retainer or fastener) is desirable so that the fastener 20 is prevented from back out of the passage 124 due to vibration, etc. and to prevent a loose fit between parts (e.g., to prevent the shroud 92 from substantially moving relative to the lip 90). A through slot 130 can be provided for alignment purposes or insertion of tools.

Looking now at FIGS. 9-15, another embodiment of the fastener 134 is disclosed. The elongate arcuate body 136 of the fastener 134 generally includes a first end 144 opposite a second end 146. A first portion 138 is a region of the elongate arcuate body 136 that is closer in proximity to the first end 144 than the second end 146, and can, in one or more embodiments, include or exclude within that region the first end 144. A second portion 140 is a region of the elongate arcuate body 136 that is closer in proximity to the second end 146 than the first end 144, and can, in one or more embodiments, include or exclude within that region the second end 146. Although the first end 144 is shown as a planar face 156 in this embodiment, the first end 144 can be of any geometry, as the application or aesthetics dictate.

Looking at the outer surface of the elongate arcuate body 136, there is an inner surface 164 opposing and generally having a smaller radius than the outer surface 166 (e.g., the radius measured from a center of that radius at a particular point on the inner surface 164 is smaller than the radius from that same center point to the outer surface 166, comparable to measuring the bend radius of a pipe). Although the curvature of the inner surface 164 and the outer surface 166 are described as having a radius, the curvature of each of the surfaces can have a constant radius (e.g., an arc of a circle) or a radius that is variable or not constant (e.g., an arc of an ellipse, a curvilinear shape). Furthermore, portions of the inner surface 164 and the outer surface 166 may include non-curved surfaces (e.g., depressions, protrusions, planar portions, and so on). Thus, the radius or curvature of the elongate arcuate body 136 in general, the inner surface 164, and the outer surface 166, can mean, in one or more embodiments, that the general curvature is considered while ignoring relatively small discontinuities between the first portion 138 and the second portion 140 (e.g., sufficiently small as to not interfere with insertion or retraction, as will be discussed further below). The cross-sectional shape of the elongate arcuate body 136 is elliptical, and more particularly, almost circular in this embodiment (e.g., there is a slight flat region on each side to make a slightly oblong circle), where the area of the circle decreases as measured from the first portion 138 to the second portion 140. This is somewhat comparable, in one or more embodiments, to an elongate conical frustum that is bent about a center point, much like pipe bending.

Looking at the second end 146 of the elongate arcuate body 136, a blind bore creates an extraction bore 142, into which the working portion of an extraction tool can be inserted (not shown, but can be a rod, screw driver, or similar tool which provides purchase and mechanical advantage to pry and loosen the fastener 134). The retaining portion 148, in this example, is a threaded hole for threadably receiving therein a screw 160, removably locked in place by the lock washer 162. In use, a portion of the elongate arcuate body 136 of the fastener 134 is received within the concavity of the seat 152 formed in an insert 150, where the seat 152 is shaped to closely match the negative shape of the elongate arcuate body 136. Although the insert 150 is illustrated as a separate part from the lip 166 and insertable into the mortise 168 formed into the lip 166, the seat 152 can be formed directly into the top surface 170 of the lip 166. The seat 152 terminates at a wall with a through hole 155 that forms a shoulder 154, where the screw 160 inserts into the through hole 155 of the shoulder 154 and threads into the retaining portion 148 (i.e., the threaded hole in this example) of the fastener 134. Tightening of the screw 160 draws the face 156 against the shoulder 154 sandwiching the wall of the shoulder tightly between the screw 160 (and optional lock washer 162) and the face 156 of the elongate arcuate body 136, thus joining the fastener 134 to the insert 150.

Figure 14:
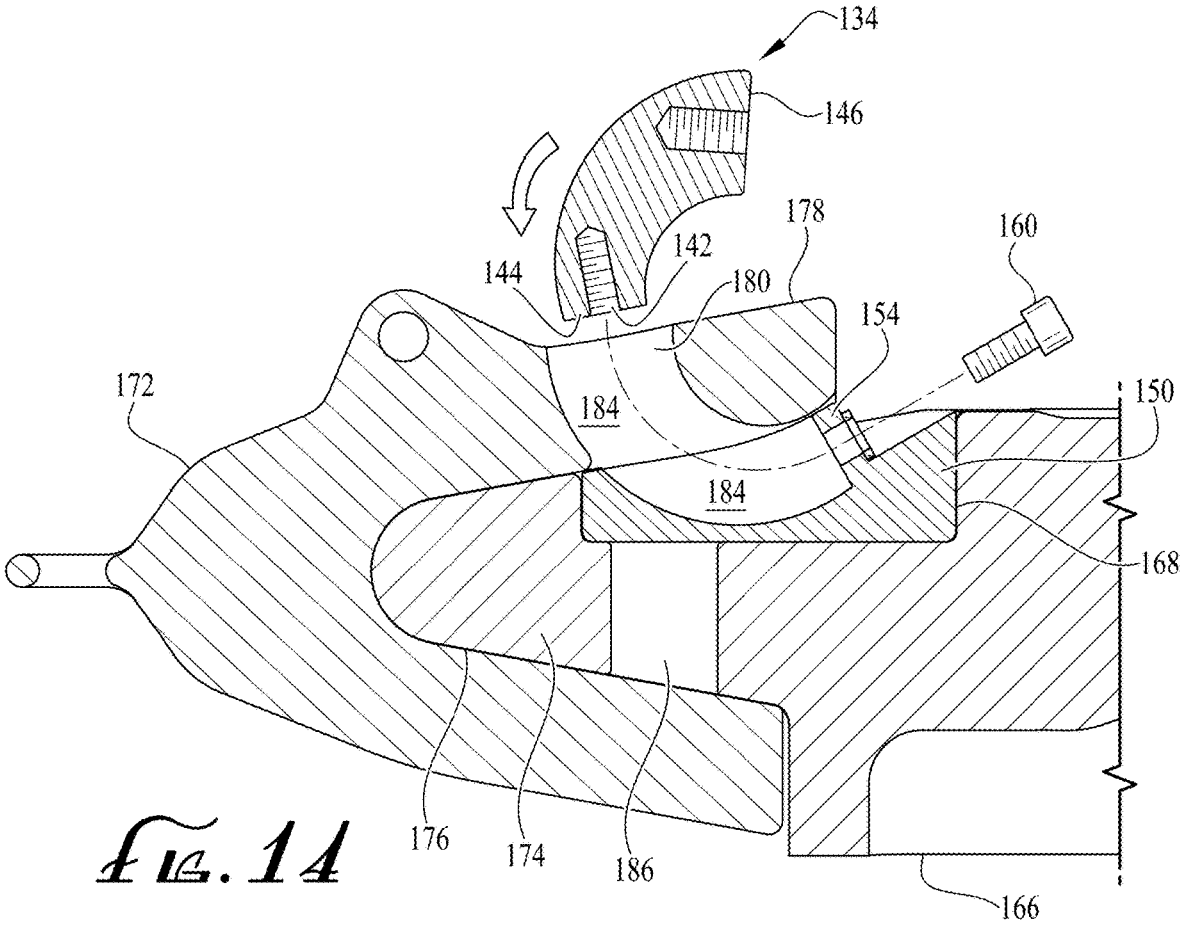
FIG. 14 is a sectional view of the assembled lip assembly of FIG. 13 taken on-center and along the longitudinal axis of the fastener, showing the fastener rotating into the inserted configuration.
Figure 15:
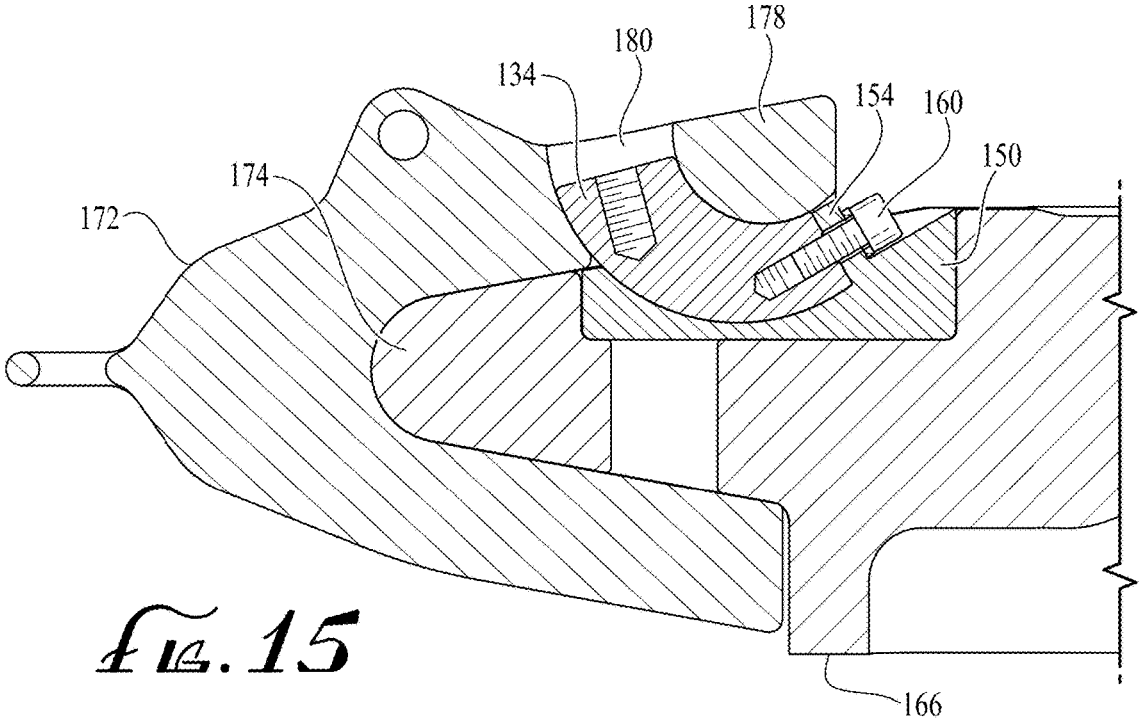
FIG. 15 is a sectional view of the assembled lip assembly of FIG. 13 taken on-center and along the longitudinal axis of the fastener, showing the fastener in the inserted configuration.
Figure 16:
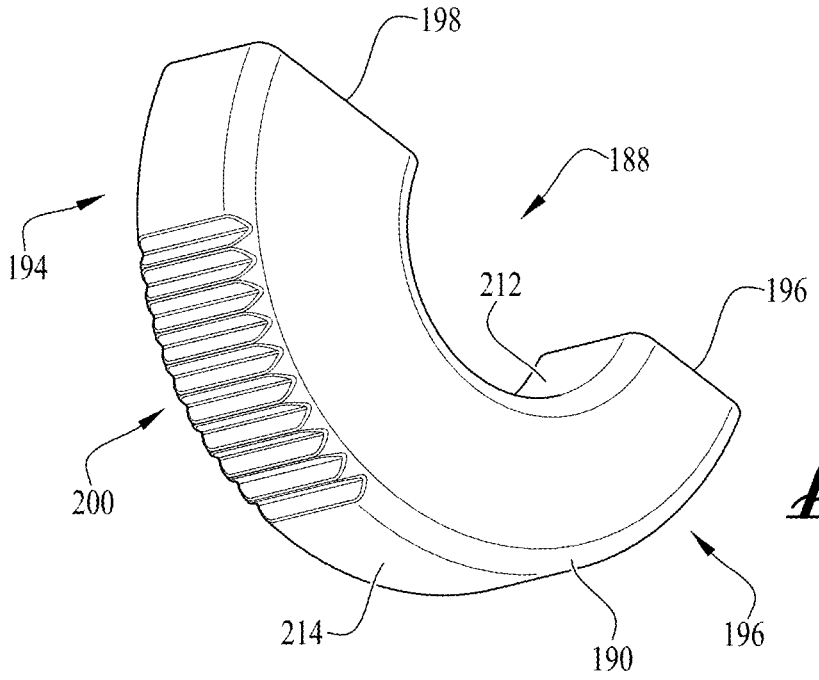
FIG. 16 is a perspective view of a yet another embodiment of the present fastener.
Figure 17:
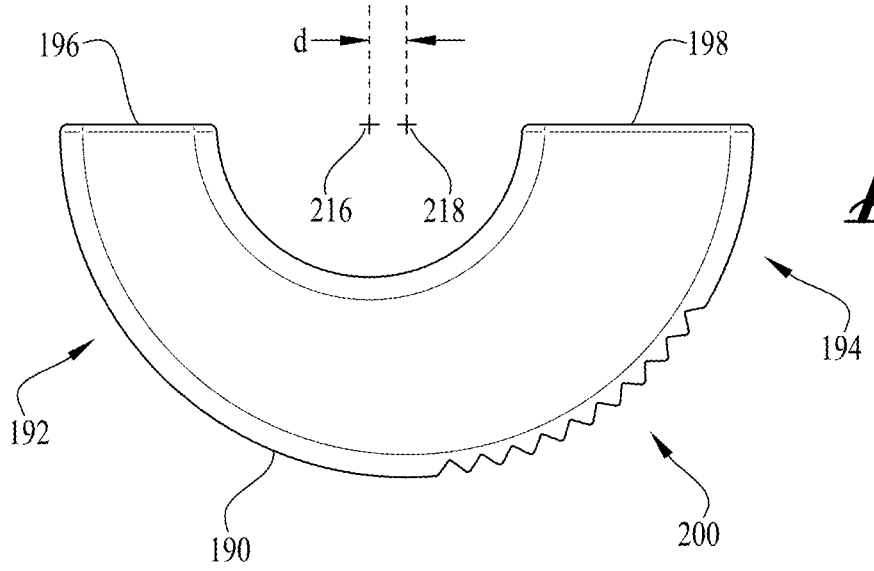
FIG. 17 is a side view of the fastener of FIG. 16.
Figure 18:
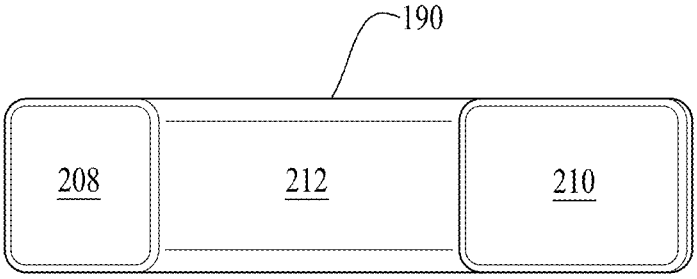
FIG. 18 is an end view of the fastener of FIG. 16.
Figure 19:
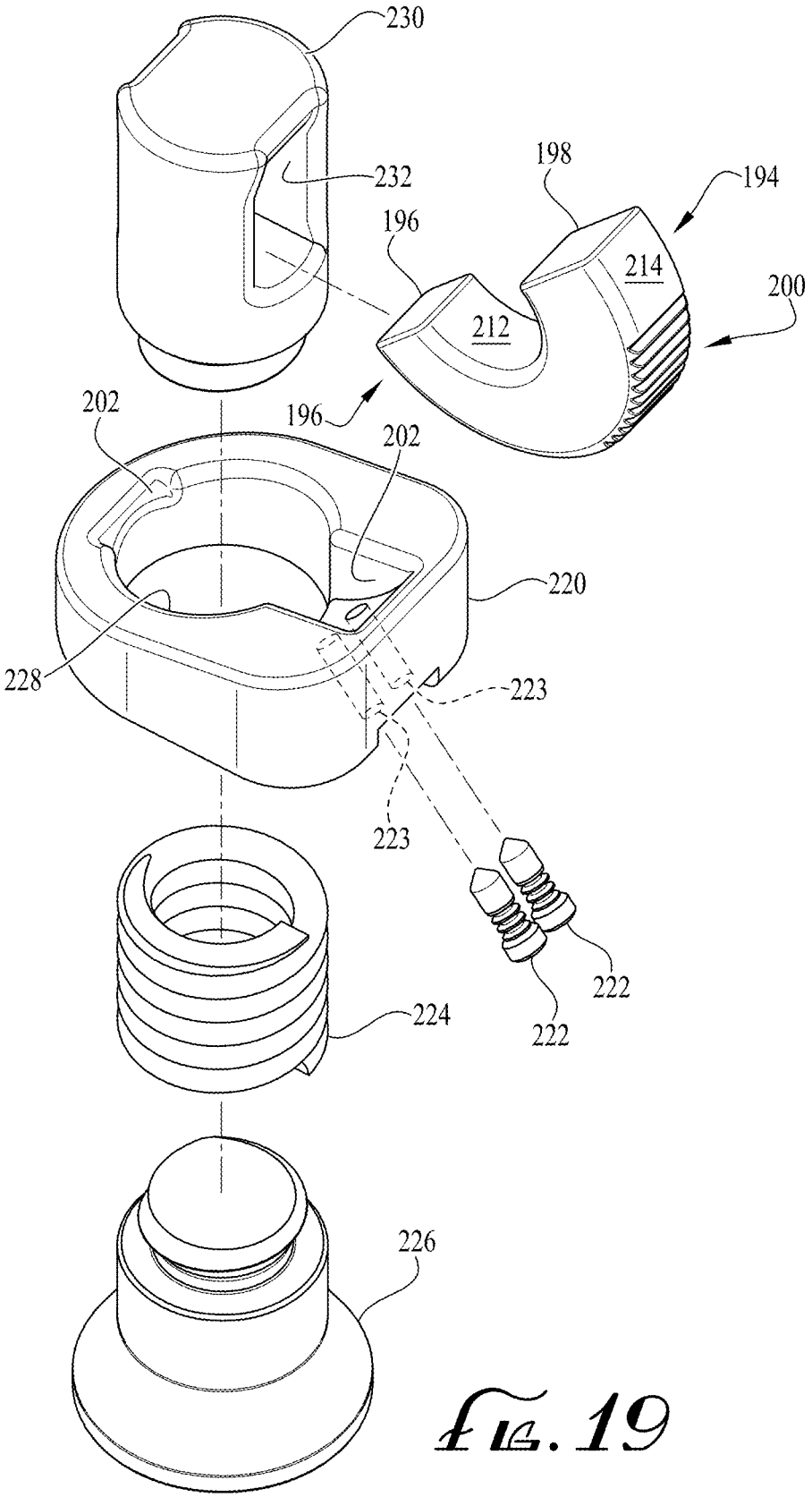
FIG. 19 is an exploded perspective view of the fastener of FIG. 16, shown aligned and ready to be inserted through a tensioner and seated within the seat insert.
Figure 20:
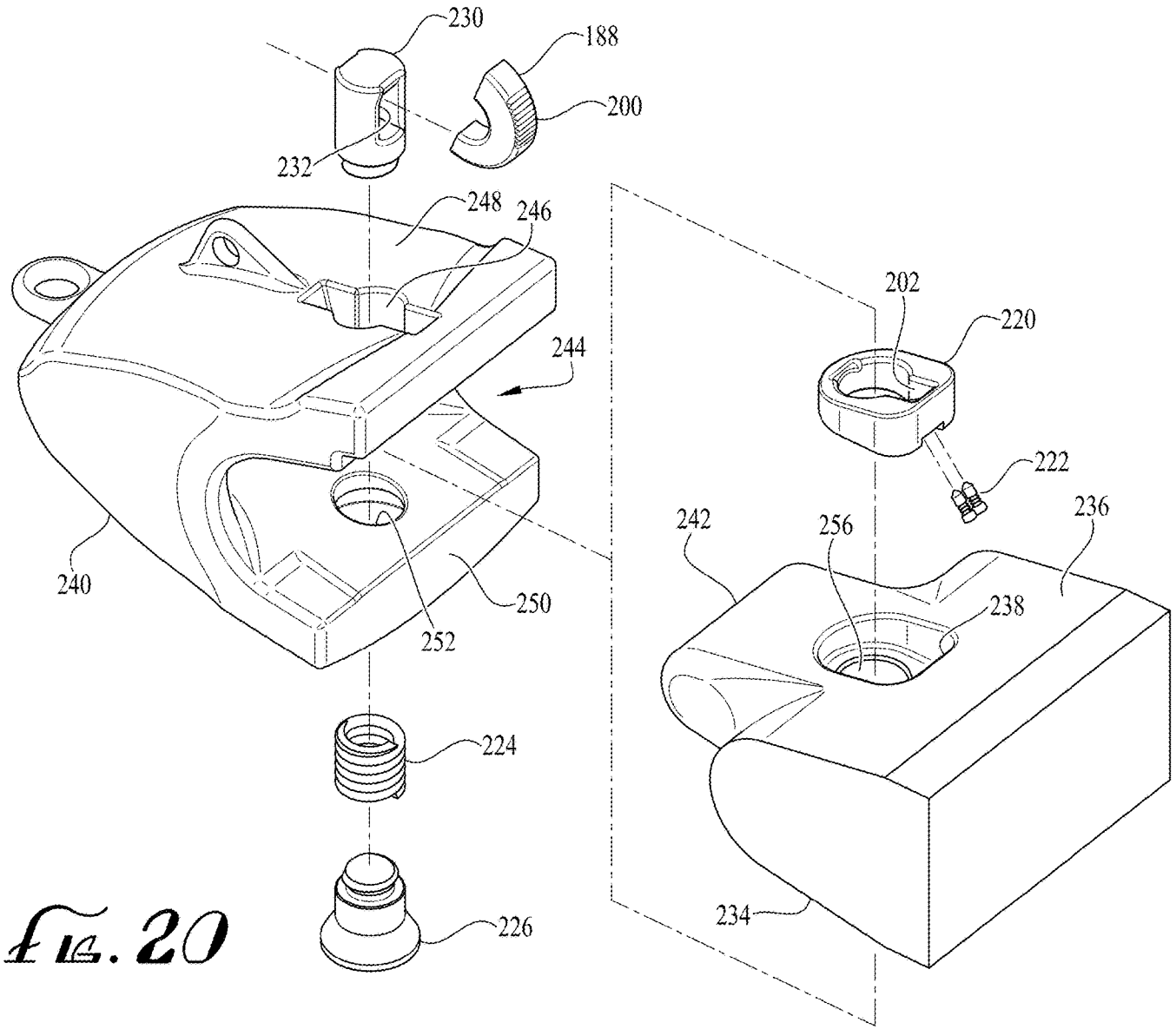
FIG. 20 is exploded perspective view of the fastener of FIG. 16, aligned and ready to connect a tooth to the lip of an implement to create a lip assembly.
Figure 21:
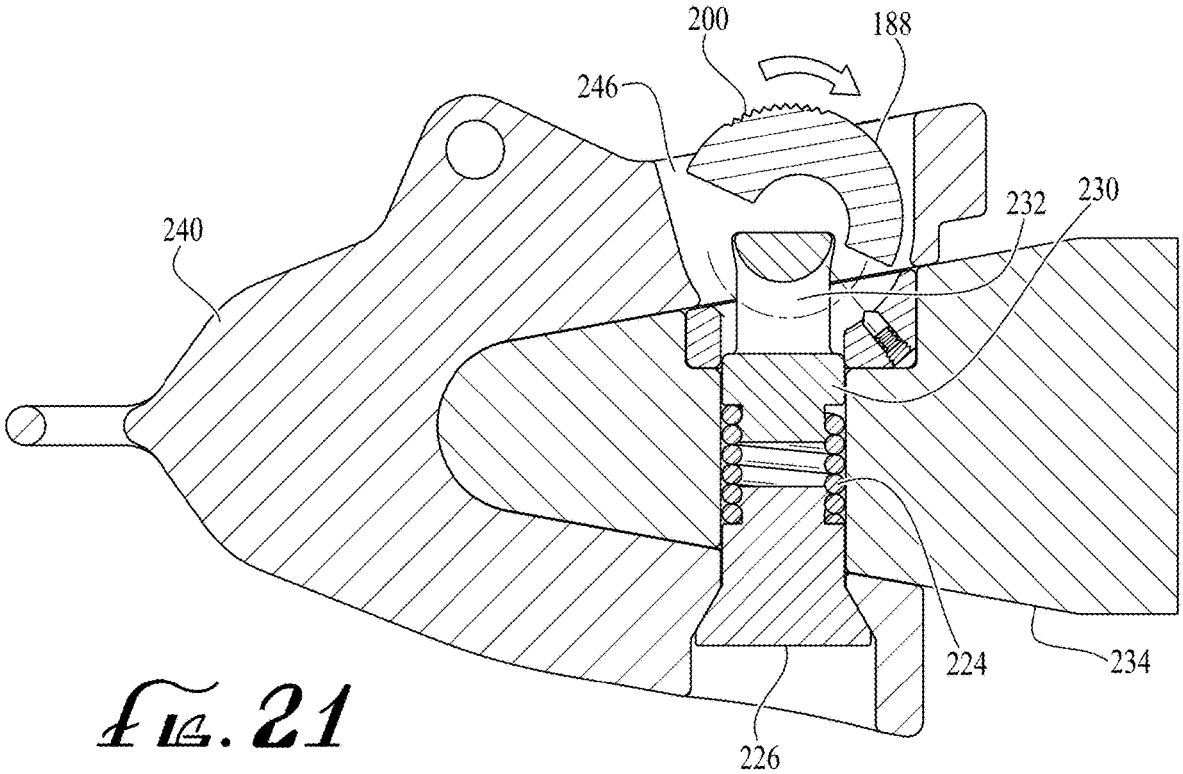
FIG. 21 is a sectional view of the assembled lip assembly of FIG. 20 taken on-center and along the longitudinal axis of the fastener, showing the fastener rotating into the inserted configuration.
Figure 22:
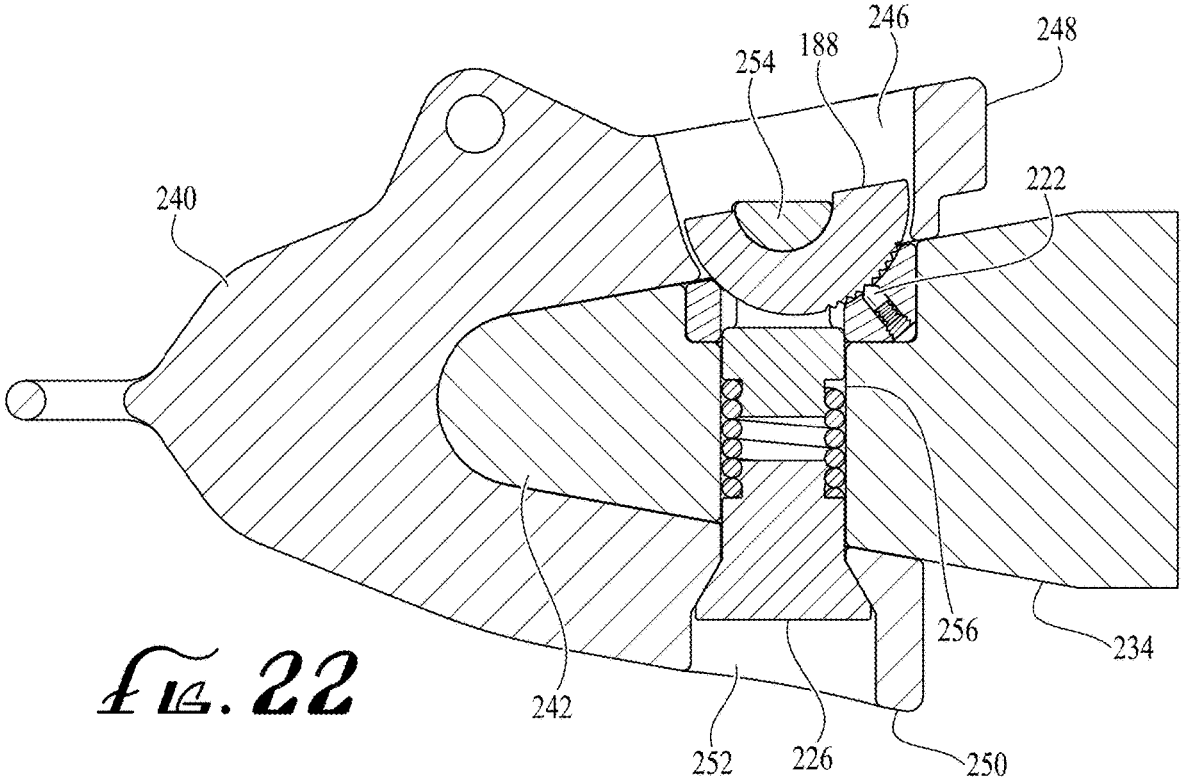
FIG. 22 is a sectional view of the assembled lip assembly of FIG. 20 taken on-center and along the longitudinal axis of the fastener, showing the fastener in the inserted configuration.
Figure 23:
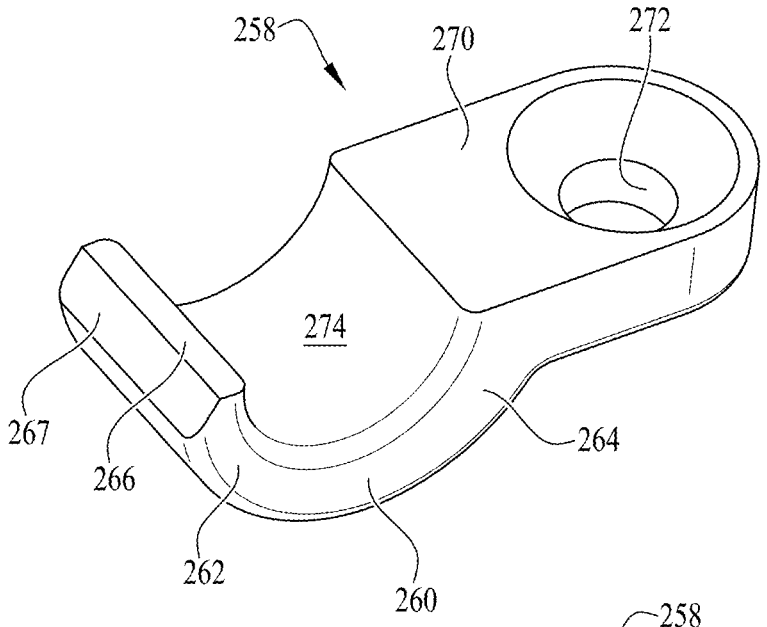
FIG. 23 is a perspective view of a further embodiment of the present fastener.
Figure 24:
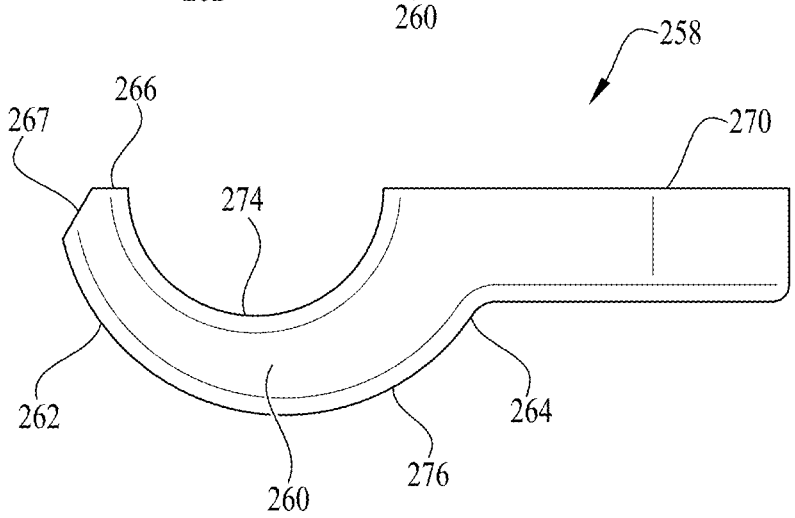
FIG. 24 is a side view of the fastener of FIG. 23.
Figure 25:
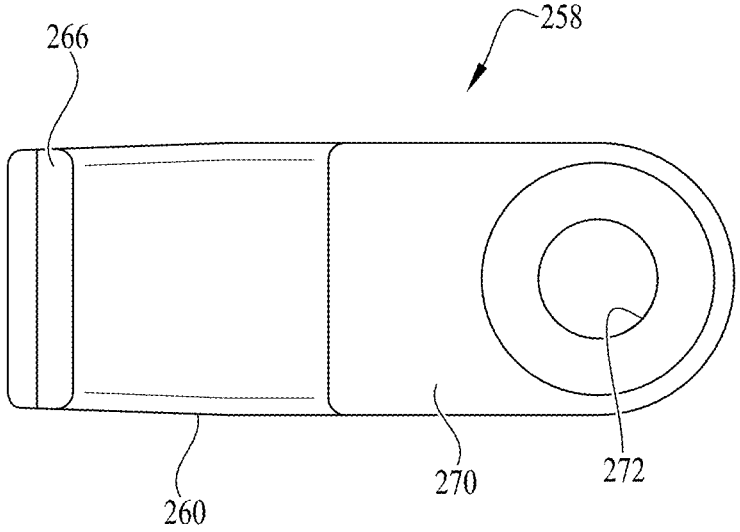
FIG. 25 is a top view of the fastener of FIG. 23.
Figure 26:
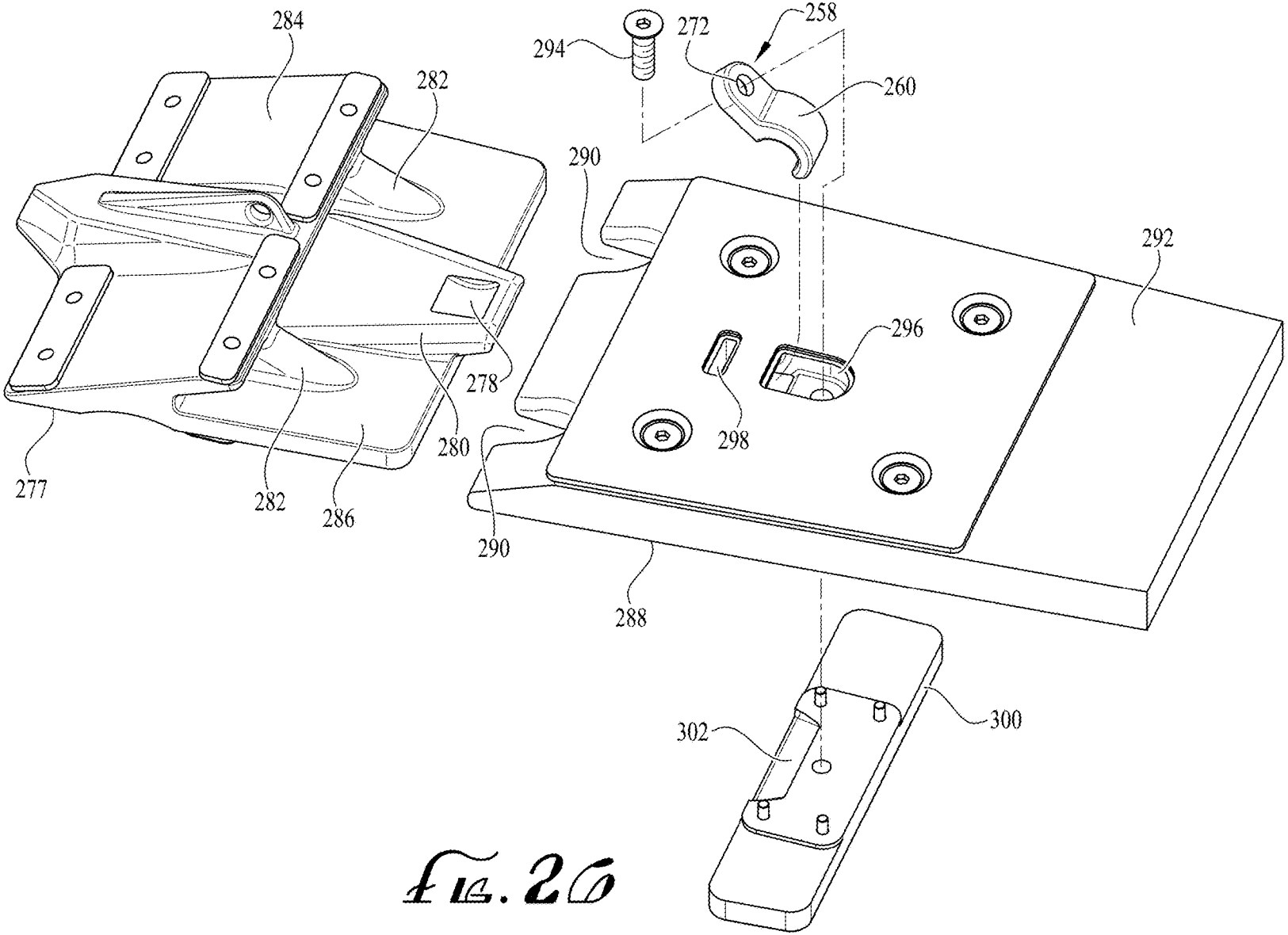
FIG. 26 is exploded perspective view of the fastener of FIG. 23, aligned and ready to connect a tooth to the lip of an implement to create a lip assembly.
Figure 27:
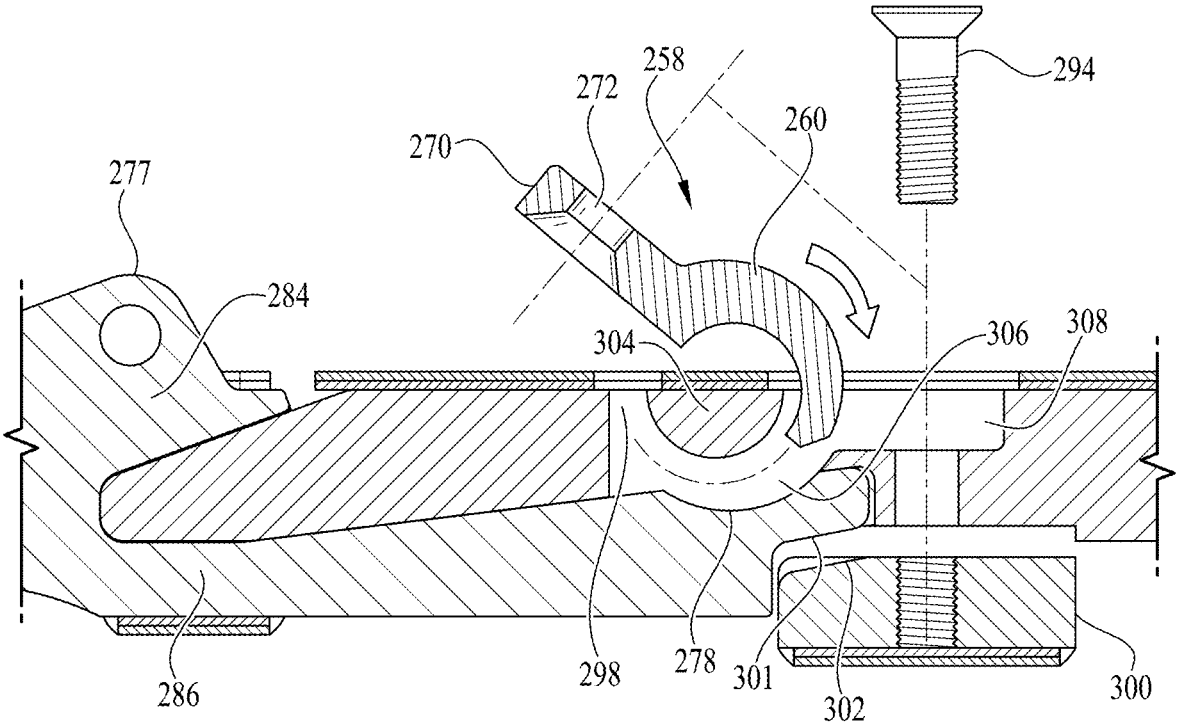
FIG. 27 is a sectional view of the assembled lip assembly of FIG. 26 taken on-center and along the longitudinal axis of the fastener, showing the fastener rotating into the inserted configuration.
Figure 28:
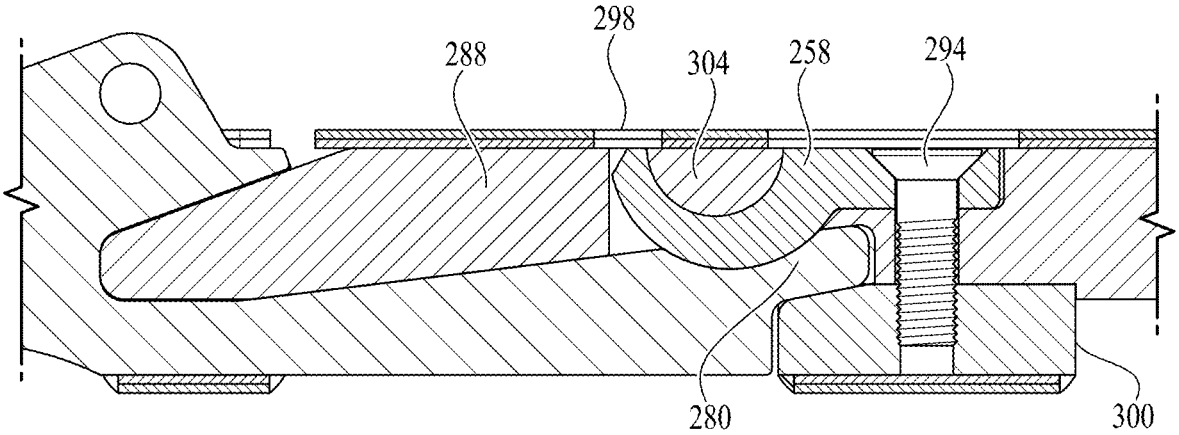
FIG. 28 is a sectional view of the assembled lip assembly of FIG. 26 taken on-center and along the longitudinal axis of the fastener, showing the fastener in the inserted configuration.
Figure 29:
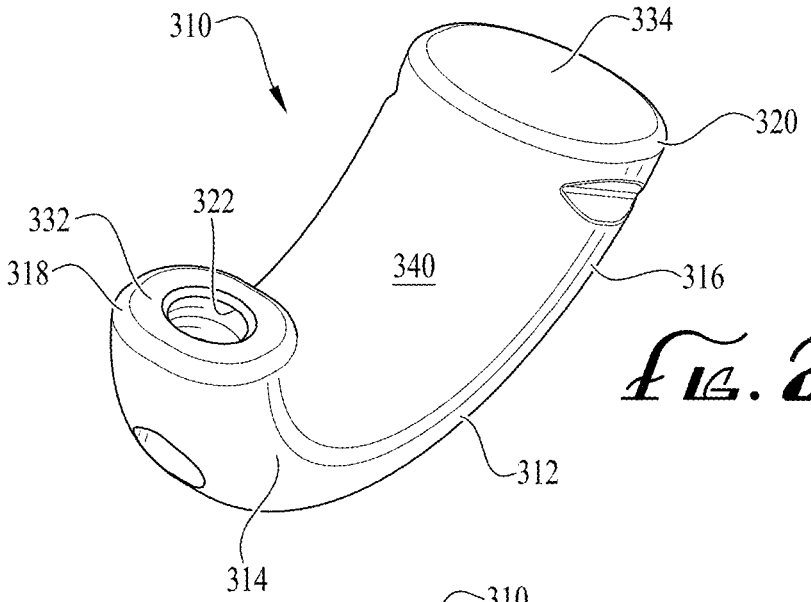
FIG. 29 is a perspective view of yet a further embodiment of the present fastener.
Figure 30:
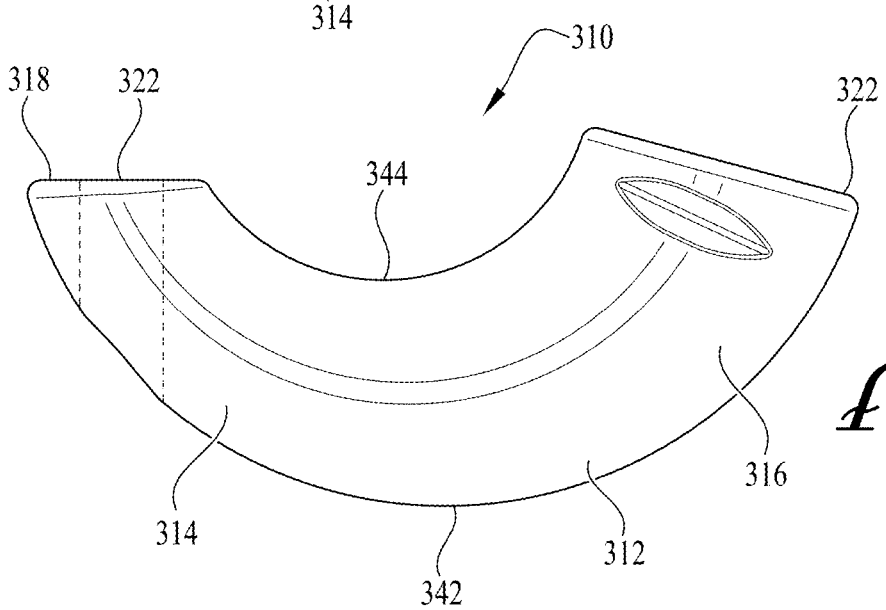
FIG. 30 is a side view of the fastener of FIG. 29.

The shroud 172 (or other attachment, such as a wear part or adapter) includes a cavity for receiving the nose 174 of the lip 166, and an entry hole 180 formed through a first leg 182 of the shroud 172 which defines a cross member 178. The insert 150 is placed in the mortise 168 of the lip 166, and the shroud 172 placed over the nose 174. The entry hole 180 aligns with part of the seat 152. The a clearance between the shroud 172 and the top surface 170 of the lip 166 and provides access to insert the screw 160 into the through hole 155 of the shoulder 154. An access hole 186 through the lip 166 permits the insertion of a tool to dislodge the insert 150 from the mortise 168. FIGS. 14 and 15 illustrate the insertion of the fastener 134 into the converging passage 184 at least in part defined between the cross member 178 and the seat 152. In a similar manner to the embodiment of FIGS. 1-8, the fastener 134 is wedged or closely fitted within the passage 184, such that a force acting to pull the shroud 172 off the nose 174 would cause the cross member 178 to contact the second portion 140 of the elongate arcuate body 136 of the fastener 134, thus blocking substantial movement (e.g., beyond the slop normally permitted within tolerance) of the shroud 172 and preventing it from separating from the lip 166. Each of the shroud 172 and the lip 166 (where the lip 166 assembly includes the insert 150, which can be attachable to the lip 166 or integrally formed on the lip 166) form part of the passage 184; and a force applied in a direction to pull the shroud 172 off the nose 174 would apply at least a shear force (and a bending moment) on the fastener 134, which prevents movement of the shroud 172 relative to the lip 166.

Looking now at FIGS. 16-22, yet another embodiment of the fastener 188 is disclosed. The elongate arcuate body 190 of the fastener 188 generally includes a first end 196 opposite a second end 198. A first portion 192 is a region of the elongate arcuate body 190 that is closer in proximity to the first end 196 than the second end 198, and can, in one or more embodiments, include or exclude within that region the first end 196. A second portion 198 is a region of the elongate arcuate body 190 that is closer in proximity to the second end 198 than the first end 1196, and can, in one or more embodiments, include or exclude within that region the second end 198. Although the first end 196 and 198 are shown as a planar faces 156 in this embodiment, the first end 196 and second end 198 can be of any geometry, as the application or aesthetics dictate.

Looking at the outer surface of the elongate arcuate body 190, there is an inner surface 212 opposing and generally having a smaller radius than the outer surface 214. Although the curvature of the inner surface 212 and the outer surface 214 are described as having a radius, the curvature of each of the surfaces can have a constant radius (e.g., an arc of a circle) or a radius that is variable or not constant (e.g., an arc of an ellipse, a curvilinear shape). Furthermore, portions of the inner surface 212 and the outer surface 214 may include non-curved surfaces (e.g., depressions, protrusions, planar portions, and so on). Further, the increasing cross-sectional area of the elongate arcuate body 190 from the first end 196 to the second end 198 can be achieved by offsetting the centers or the radii, where the smaller radius is of the inner surface 212 is centered about center 216 and the larger radius of the outer surface is centered about center 218, offset by a distance d. In this example embodiment, the retaining portion 200 is a series of teeth which form steps or grooves into which detents (or other engaging tip) engage for holding the position of the fastener 188.

In use, the fastener 188 is inserted into an engagement clamp, having a seat 220, a tension spring 224, a clamp 230, and a retaining head 226. The tension spring 224 is connected between the clamp 230 and the retaining head 226 to resist separation of the two under spring bias. The insert 220 includes a seat 202 configured to cradle the elongate arcuate body 190 of the fastener 188, and a spring clamp bore 228 intersecting the seat 202. Detents 222 protrude into the seat 202 for engaging the ridges of the retaining portion 200. The detents 222 can alternatively be screws with tips to engage the ridges, with no detent spring element.

When used to fasten a shroud 240 to the nose 242 of a lip 234, the insert 220 is set within the mortise 238, the cavity 244 of the shroud 240 placed onto the nose 242 aligning the seat 202 with the fastener access hole 246 formed through the first leg 248 of the shroud 240. The assembly of the tension spring 224 connecting the clamp 230 to the retaining head 226 is inserted into the through hole 252 formed through the second leg 250, through the hole 256 formed through the lip 234, where the clamp 230 is positioned in the faster hole 246 (which can be shaped in part to conform to the shape of the fastener 188). The countersunk hole 252 prevents pull-through of the retaining head 226, such that pulling on the clamp 230 expands the spring 224. The first end 196 of the fastener 188 is inserted through the eye 232 formed through the clamp 230, where continued insertion tensions the spring 224 due to the increasing thickness of the elongate arcuate body 190. As the ridges of the retaining portion 200 push in the detents 222, a ratchet or clicking sound will be audible to alert the user of positive engagement. The fastener 188 is inserted until the desired tension is obtained, such that the fastener 188 will not withdraw under normal usage. In this embodiment a passage is defined in part by both the walls of the fastener access hole 246 and the eye 232 of the clamp 230, with the end portion 254 of the clamp 230 acting as a cross member. Application of a force acting to pull the shroud 240 off the nose 242 would cause the wall of the fastener access hole 246 to contact the cross member 254 to further engage the second portion 194 of the elongate arcuate body 190 of the fastener 188, thus blocking substantial movement of the shroud 240 and preventing it from separating from the lip 234.

Turning now at FIGS. 23-28, another embodiment of the fastener 258 is disclosed. The elongate arcuate body 260 of the fastener 258 generally includes a first end 266 with a chamfer 267 (or other feature to ease the first end 266 to aid in insertion) opposite a flange 270 with a through hole 272 for receiving a screw 294 (a countersunk hole in this example for receiving a flat head screw). A first portion 262 is a region of the elongate arcuate body 260 that is closer in proximity to the first end 266 than the flange 270 (which can act as a second end equivalent), and can, in one or more embodiments, include or exclude within that region the first end 266. A second portion 264 is a region of the elongate arcuate body 260 that is closer in proximity to the flange 270 than the first end 266.

The structure of the lip 288 and edge attachment 277 assembly is structurally and functionally similar to the assembly described in relation to FIGS. 6-8. Thus, equivalent structures will only be briefly discussed for the present embodiment. The edge attachment 277 includes a first leg 284 separated by a gap from a second leg 286, with two webs 282 spanning between the legs. A tongue 280 protrudes from the second leg 286, with a seat 278 formed on the top of the tongue 280 and an inclined surface 301 formed on the opposite side of the tongue 280. A tail plate 300 bolts to the underside of the lip 288, with the inclined or ramped surface 302 configured to receive the tip of the tongue 280. The webs 282 each insert into their respective notches 290, with the seat 278 positioned beneath the cross member 304 to define the passage 306 therebetween.

During assembly, the first end 266 of the fastener 258 is inserted into the entry hole 296 and rotated into position, such that the elongate arcuate body 260 is positioned within the passage 306 and the flange 270 is positioned within the flange recess 308, where the screw 294 is inserted into the through hole 272 on the flange 270, inserted through the lip 288 and threaded into the tail plate 300, sandwiching the tongue 280 between the ramped surface 302 and the fastener 258. In this way, similar to the embodiment of FIGS. 6-8 the edge attachment 277 is prevented from withdrawing.

Looking now at FIGS. 29-35, yet another embodiment of the fastener 310 is disclosed. The elongate arcuate body 312 of the fastener 310 generally includes a first end 318 opposite a second end 320. A first portion 314 is a region of the elongate arcuate body 312 that is closer in proximity to the first end 318 than the second end 320, and can, in one or more embodiments, include or exclude within that region the first end 318. A second portion 316 is a region of the elongate arcuate body 312 that is closer in proximity to the second end 320 than the first end 318, and can, in one or more embodiments, include or exclude within that region the second end 320.

Figure 31:
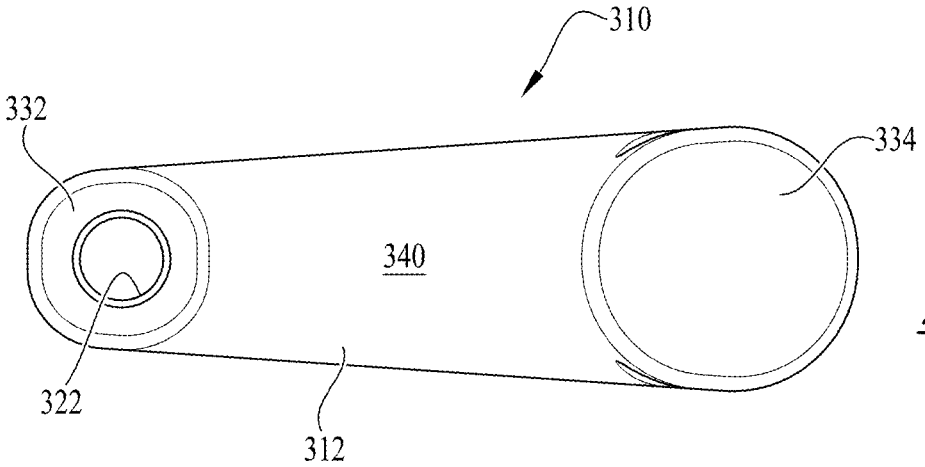
FIG. 31 is a top view of the fastener of FIG. 29.
Figure 32:
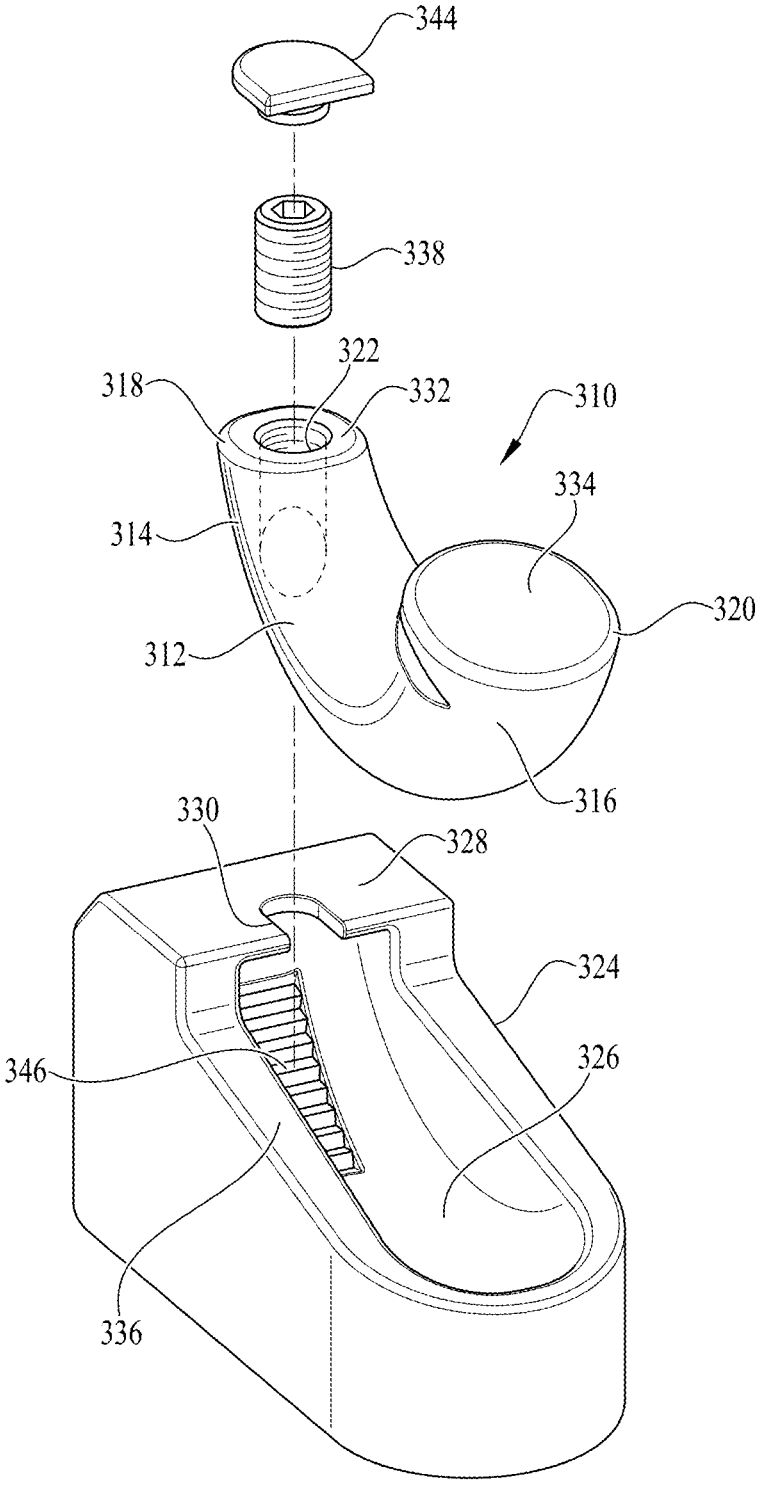
FIG. 32 is an exploded perspective view of the fastener of FIG. 29, shown aligned and ready to be seated within the seat insert.
Figure 33:
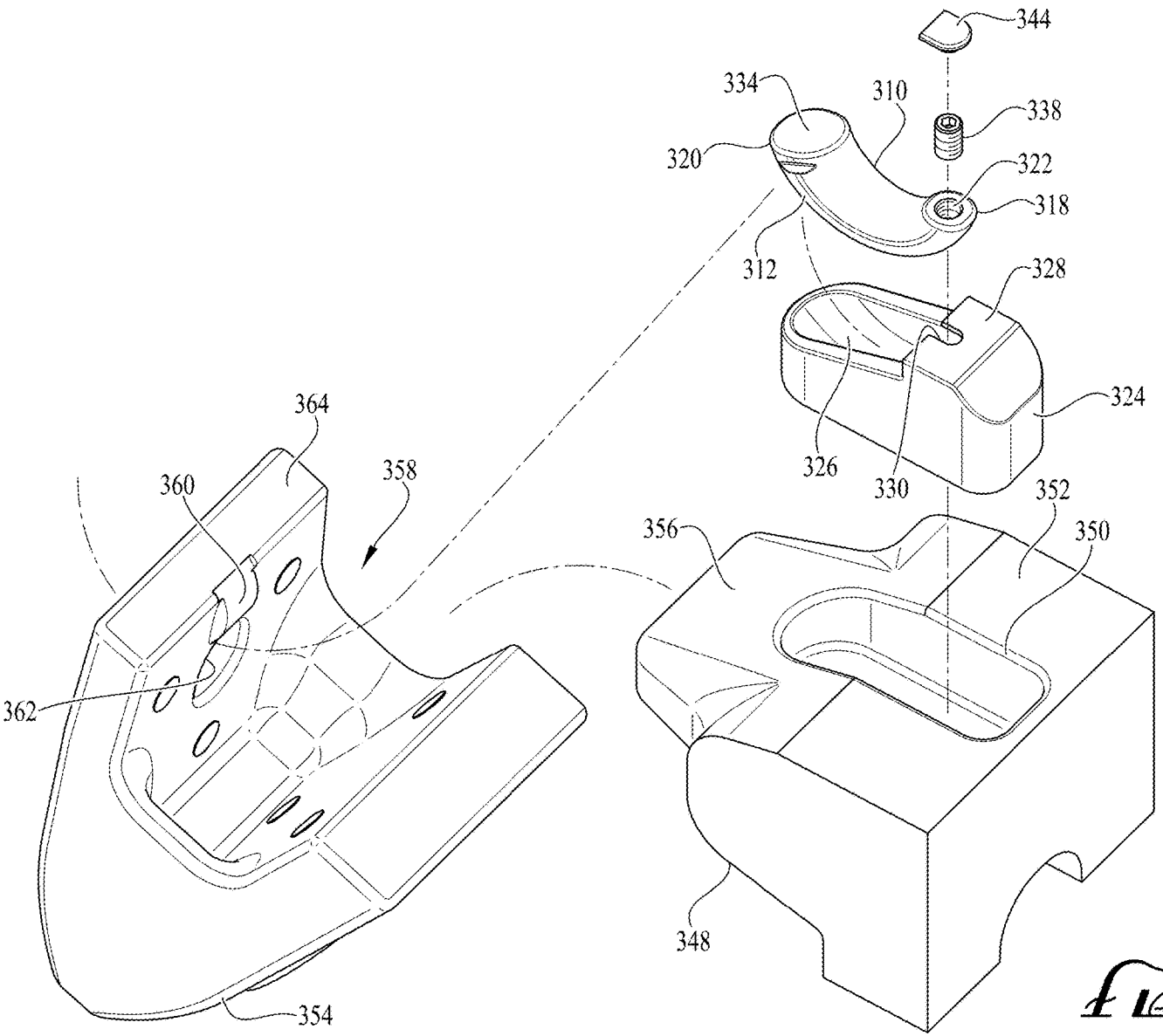
FIG. 33 is exploded perspective view of the fastener of FIG. 29, aligned and ready to connect a tooth to the lip of an implement to create a lip assembly.
Figure 34:
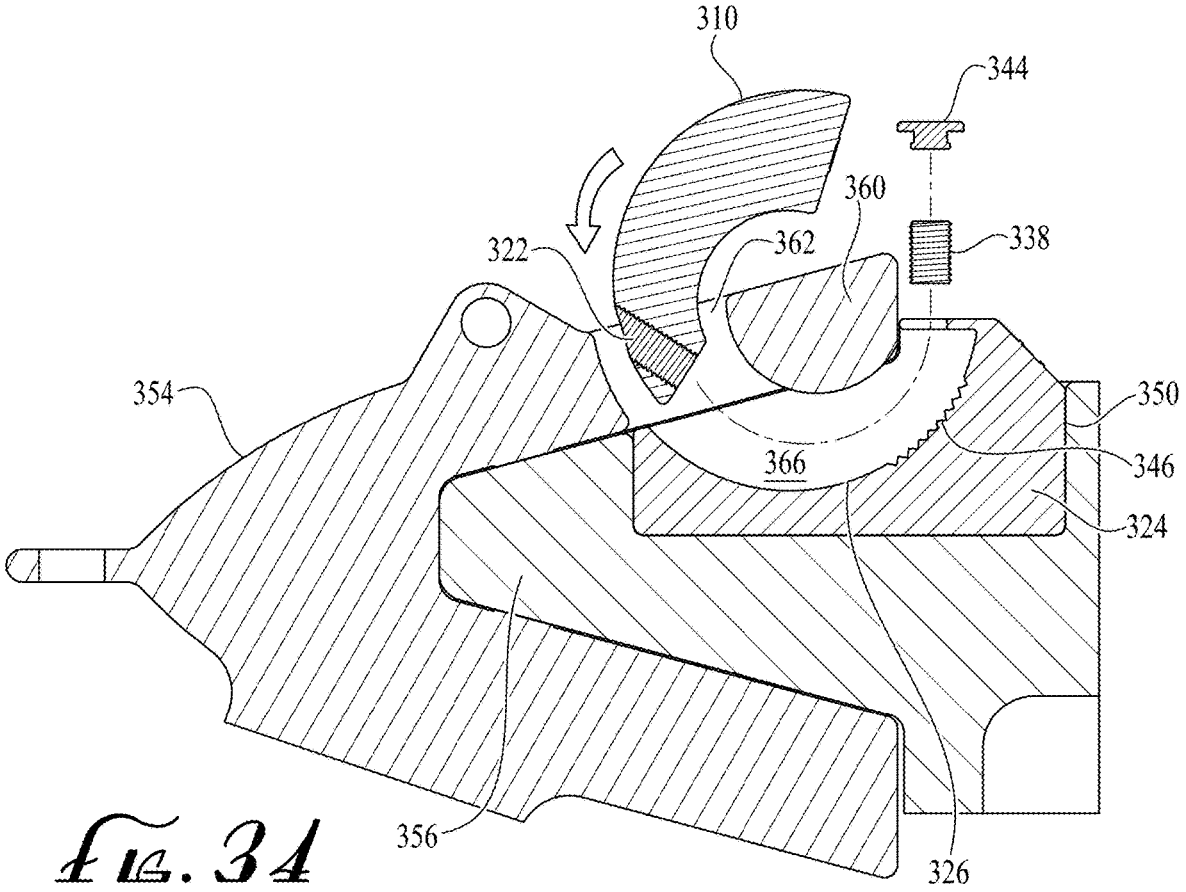
FIG. 34 is a sectional view of the assembled lip assembly of FIG. 33 taken on-center and along the longitudinal axis of the fastener, showing the fastener rotating into the inserted configuration.
Figure 35:
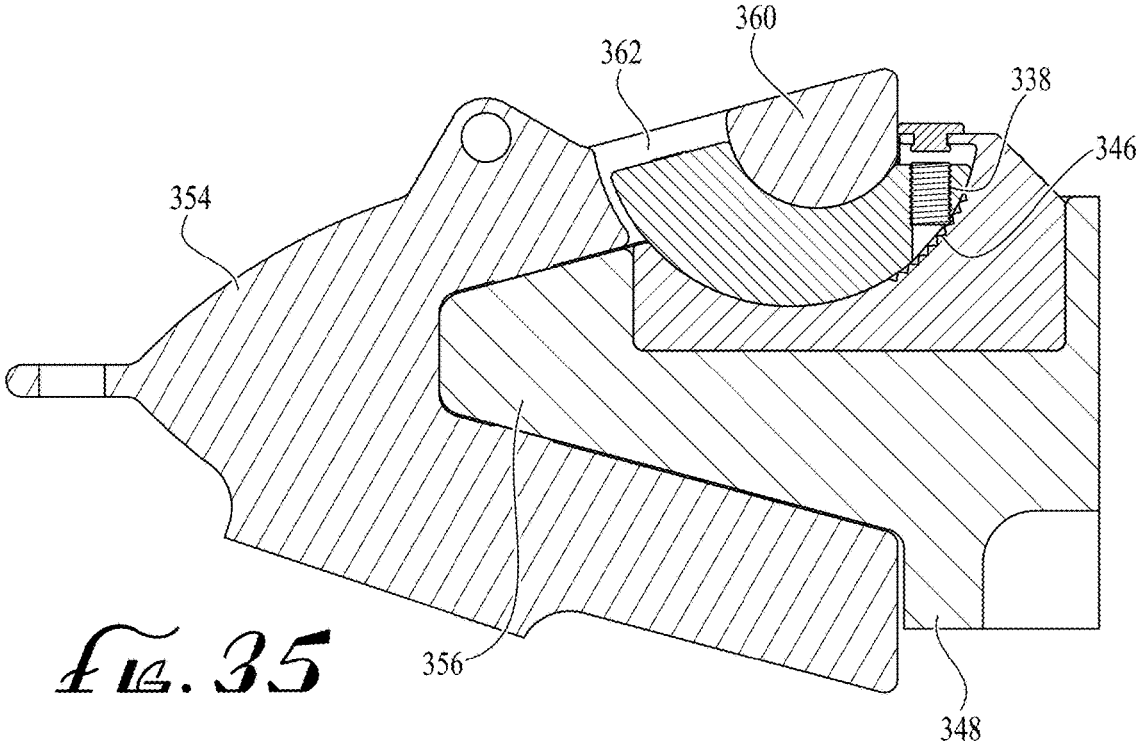
FIG. 35 is a sectional view of the assembled lip assembly of FIG. 33 taken on-center and along the longitudinal axis of the fastener, showing the fastener in the inserted configuration.
Figure 36:
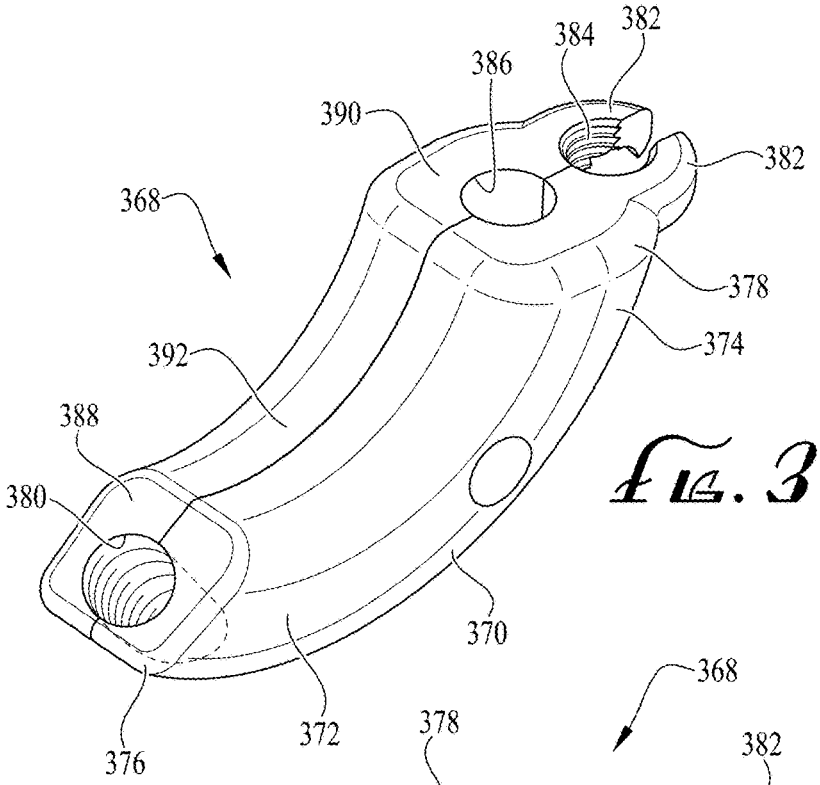
FIG. 36 is a perspective view of an additional embodiment of the present fastener.
Figure 37:
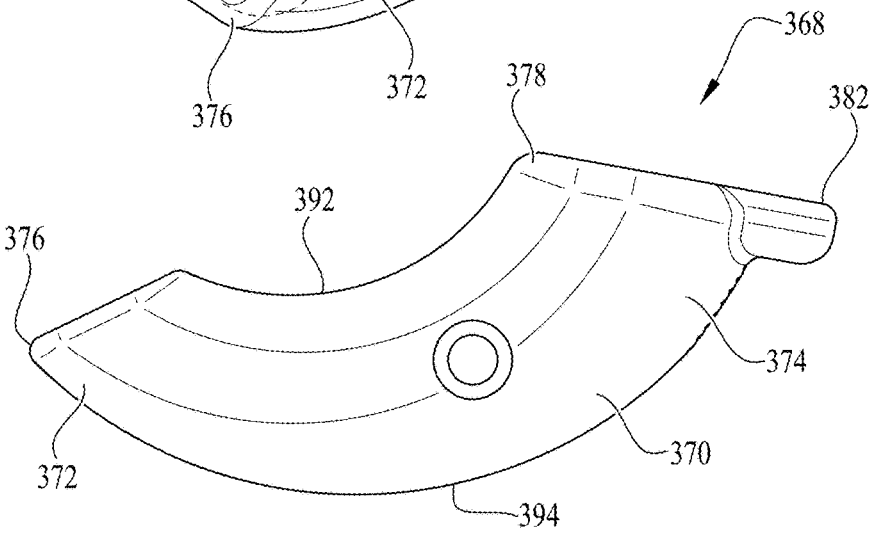
FIG. 37 is a side view of the fastener of FIG. 36.

Very similar in many respects to the embodiment of FIGS. 9-15 (with the differences explained), looking at the outer surface of the elongate arcuate body 312, there is an inner surface 340 opposing and generally having a smaller radius than the outer surface 342. Although the curvature of the inner surface 340 and the outer surface 342 are described as having a radius, the curvature of each of the surfaces can have a constant radius (e.g., an arc of a circle) or a radius that is variable or not constant (e.g., an arc of an ellipse, a curvilinear shape). Furthermore, portions of the inner surface 340 and the outer surface 342 may include non-curved surfaces (e.g., depressions, protrusions, planar portions, and so on). Thus, the radius or curvature of the elongate arcuate body 312 in general, the inner surface 340, and the outer surface 342, can mean, in one or more embodiments, that the general curvature is considered while ignoring relatively small discontinuities between the first portion 314 and the second portion 316. The cross-sectional shape of the elongate arcuate body 312 is somewhat elliptical, and more particularly, almost circular in this embodiment (e.g., there is a slight flat region on each of four sides to make a circle/square-like shape with large corner radii, as seen in FIG. 31), where the area of the cross section decreases as measured from the first portion 314 to the second portion 316.

The retaining portion 322, in this example, is a threaded through hole for threadably receiving therein a set screw 338 being threaded within the hole 322. In use, a portion of the elongate arcuate body 312 of the fastener 310 is received within the concavity of the seat 326 formed in an insert 324, where the seat 326 is shaped to closely match the negative shape of the elongate arcuate body 312. The seat 326 terminates at a wall 328 with a notch 330, with the notch 330 providing access for a tool (e.g., a hex wrench or similar) to act on the screw 338. A protective cover 344 presses into the notch 330. A series of parallel steps 346 are formed in the seat 326 for receiving the tip of the set screw 338, where tightening the set screw pushes against one of the steps 346 which forces the first face 332 of the fastener 310 upwards and toward the wall 328 (but not necessarily touching the wall 328).

The shroud 354 (or other attachment, such as a wear part or adapter) includes a cavity 358 for receiving the nose 356 of the lip 348, and an entry hole 368 formed through a first leg 364 of the shroud 354 which defines a cross member 360 which comprises an arced hump. The insert 324 is placed in the mortise 350 of the lip 348, and the shroud 354 placed over the nose 356. The entry hole 362 aligns with part of the seat 326. In a similar manner to the embodiment of FIGS. 1-8, the fastener 310 is wedged or closely fitted within the passage 366 by tightening the set screw 338 against a step 346, such that a force acting to pull the shroud 354 off the nose 356 would cause the cross member 360 to contact the second portion 316 of the elongate arcuate body 312 of the fastener 310, thus blocking substantial movement (e.g., beyond the slop normally permitted within tolerance) of the shroud 354 and preventing it from separating from the lip 348.

FIGS. 36-42 illustrate an additional embodiment of the fastener 310 is disclosed. The elongate arcuate body 312 of the fastener 310 generally includes a first end 318 opposite a second end 320. A first portion 314 is a region of the elongate arcuate body 312 that is closer in proximity to the first end 318 than the second end 320, and can, in one or more embodiments, include or exclude within that region the first end 318. A second portion 316 is a region of the elongate arcuate body 312 that is closer in proximity to the second end 320 than the first end 318, and can, in one or more embodiments, include or exclude within that region the second end 320.

Figure 38:
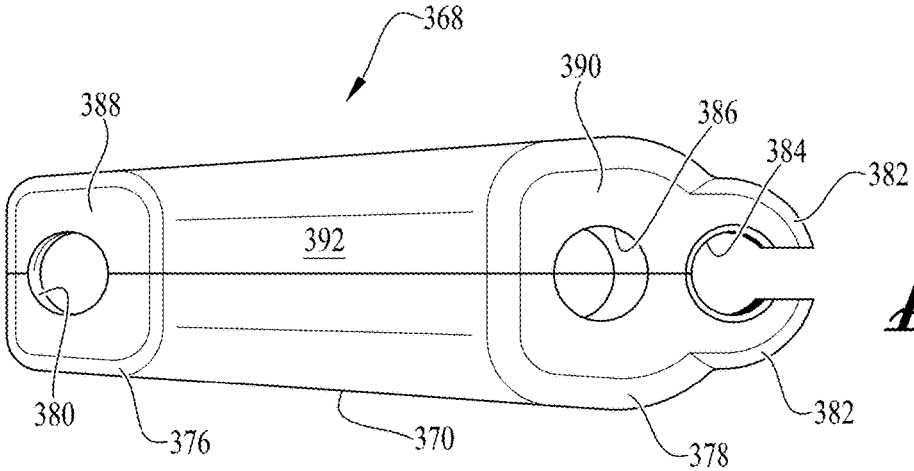
FIG. 38 is a top view of the fastener of FIG. 36.
Figure 39:
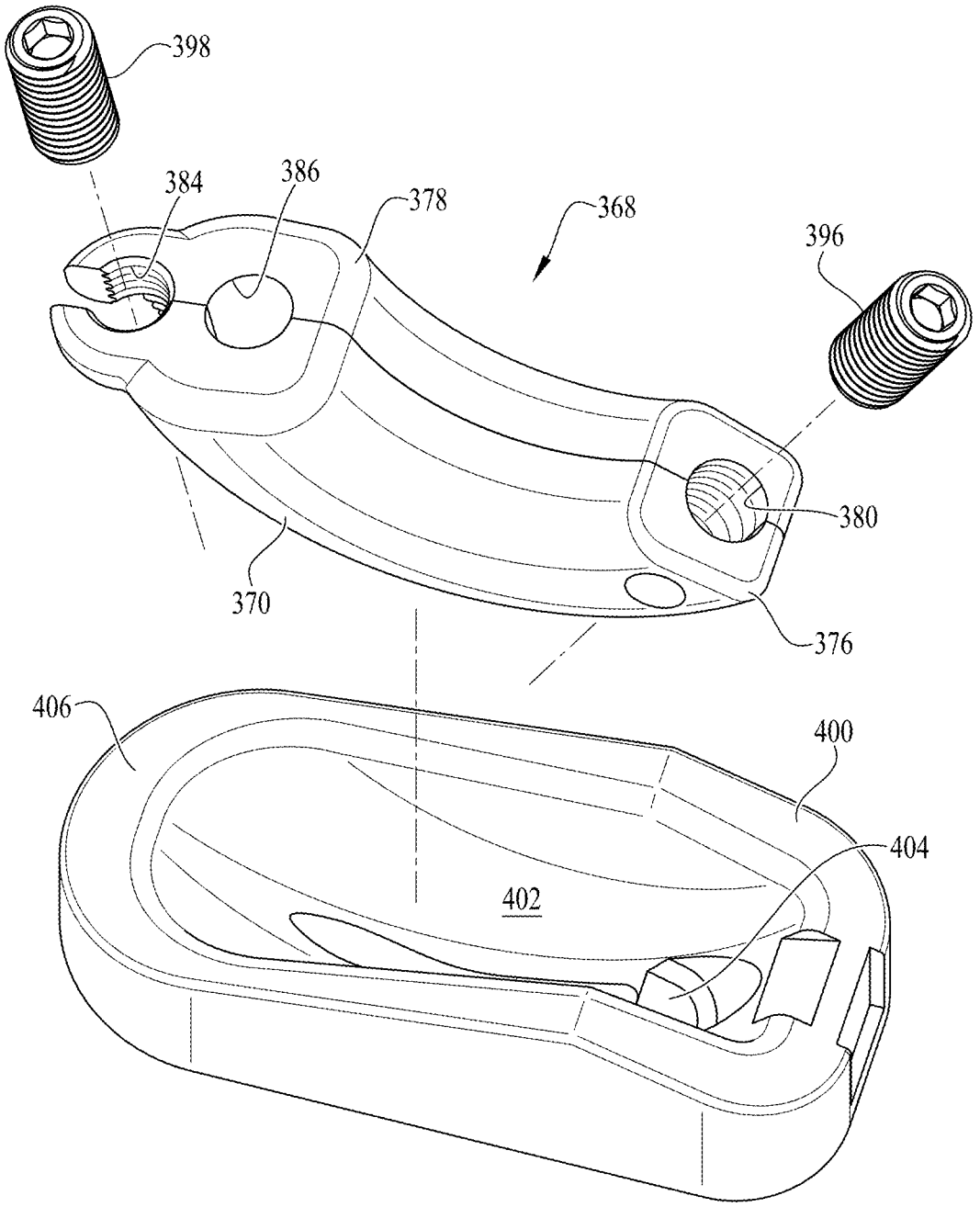
FIG. 39 is an exploded perspective view of the fastener of FIG. 36, shown aligned and ready to be seated within the seat insert.
Figure 40:
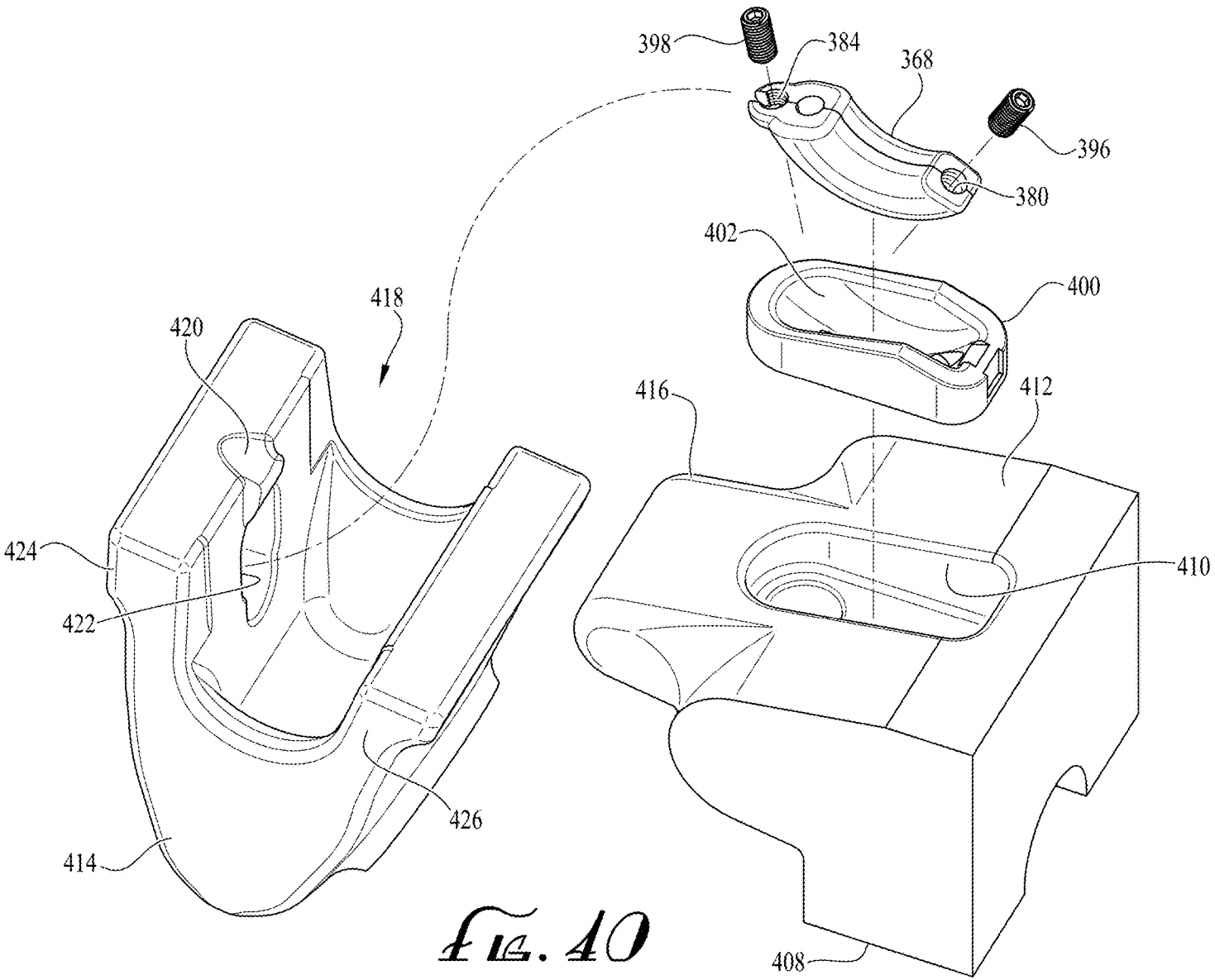
FIG. 40 is exploded perspective view of the fastener of FIG. 36, aligned and ready to connect a tooth to the lip of an implement to create a lip assembly.
Figure 41:
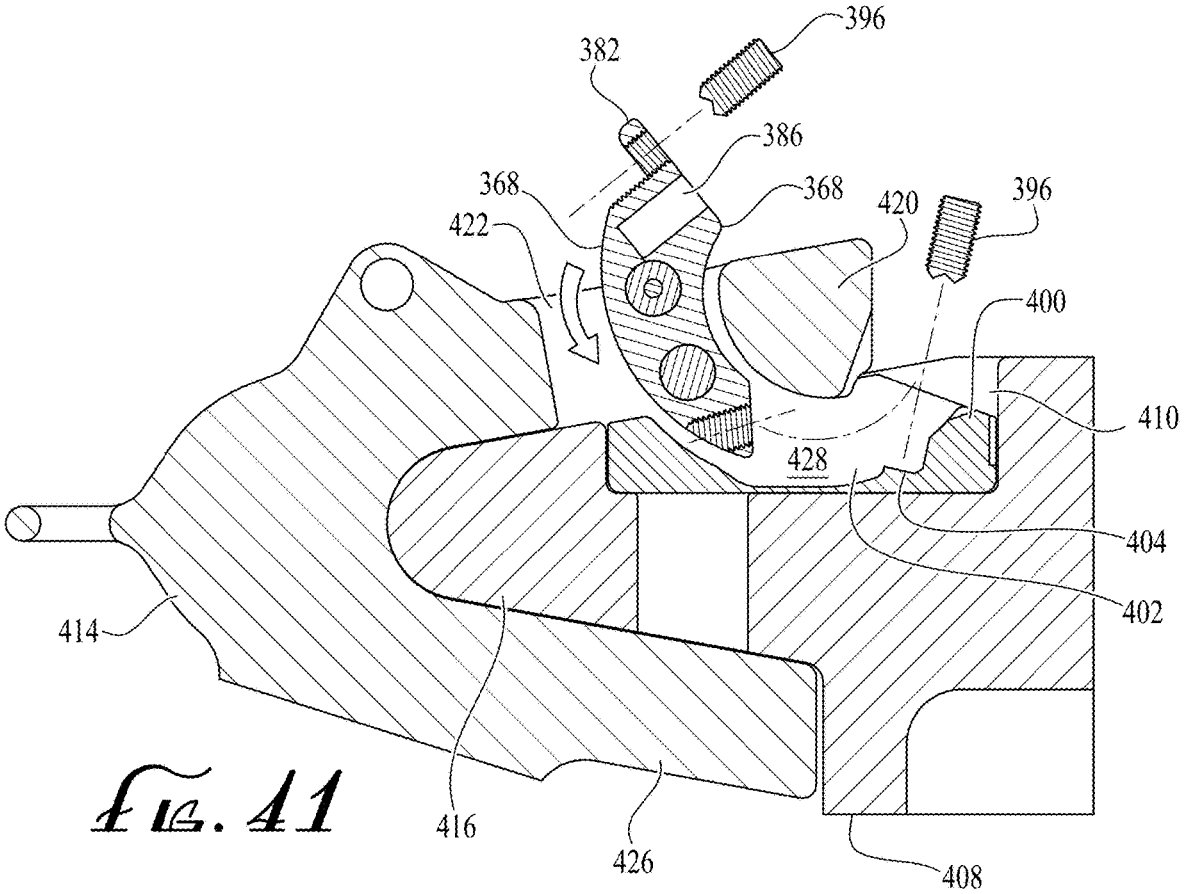
FIG. 41 is a sectional view of the lip assembled assembly of FIG. 40 taken on-center and along the longitudinal axis of the fastener, showing the fastener rotating into the inserted configuration.
Figure 42:
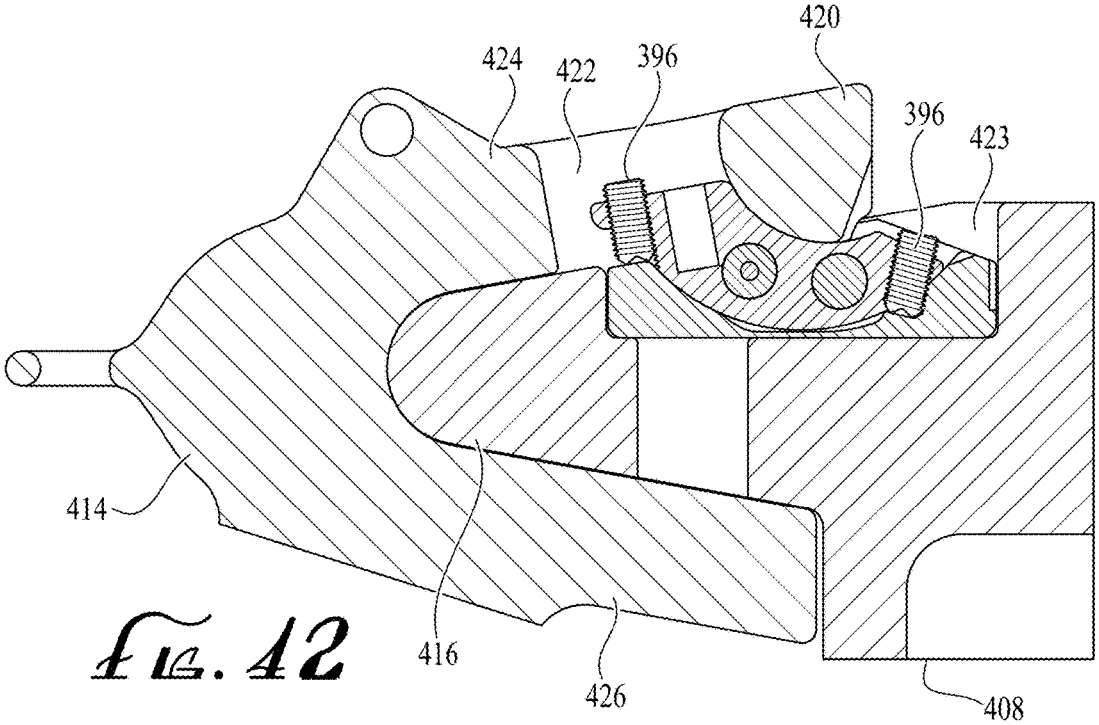
FIG. 42 is a sectional view of the assembled lip assembly of FIG. 40 taken on-center and along the longitudinal axis of the fastener, showing the fastener in the inserted configuration.
Figure 43:
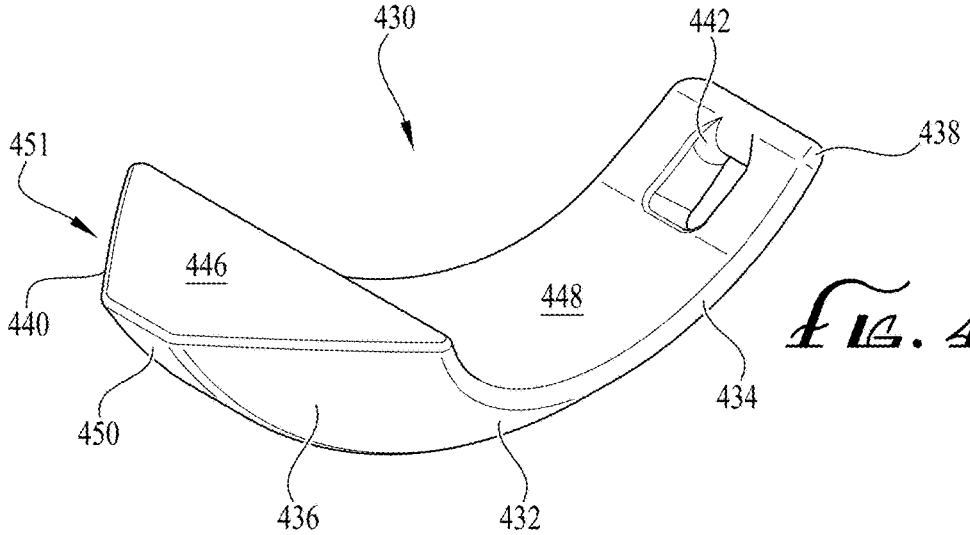
FIG. 43 is a perspective view of an additional embodiment of the present fastener.
Figure 44:
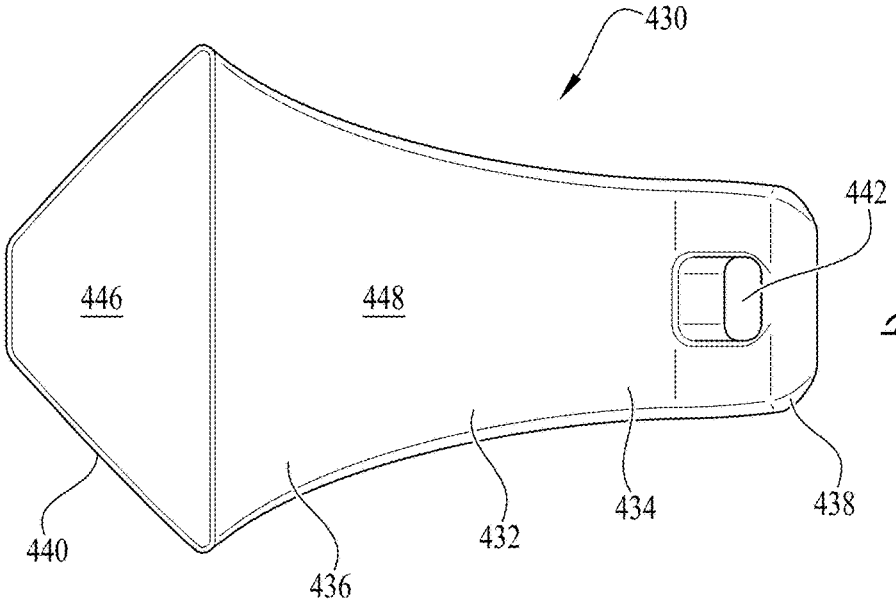
FIG. 44 is a top view of the fastener of FIG. 43.
Figure 45:
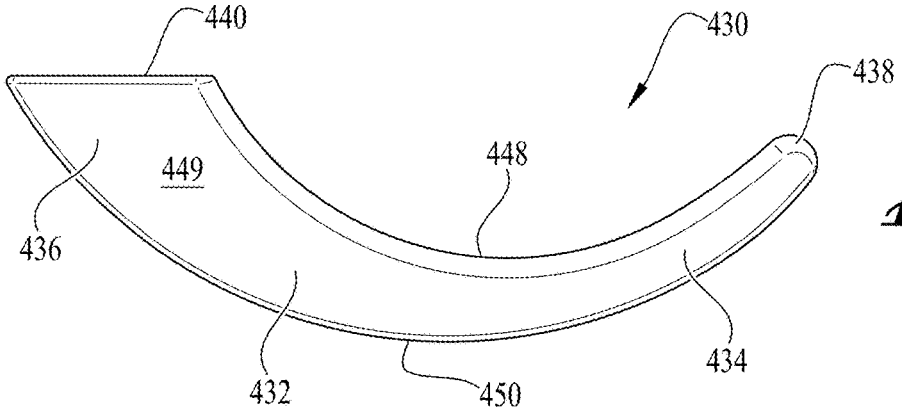
FIG. 45 is a side view of the fastener of FIG. 43.
Figure 40:
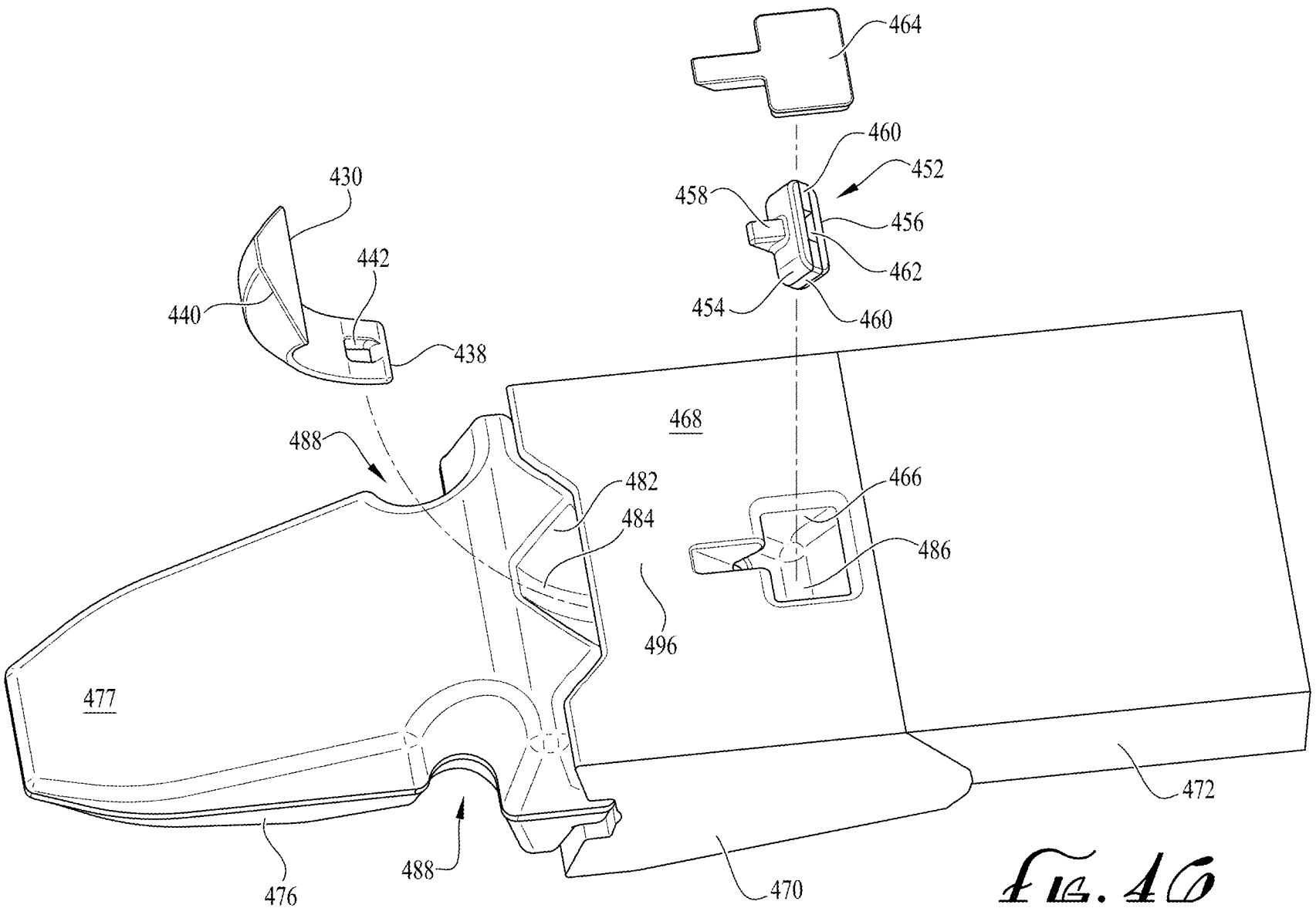
Figure 47:
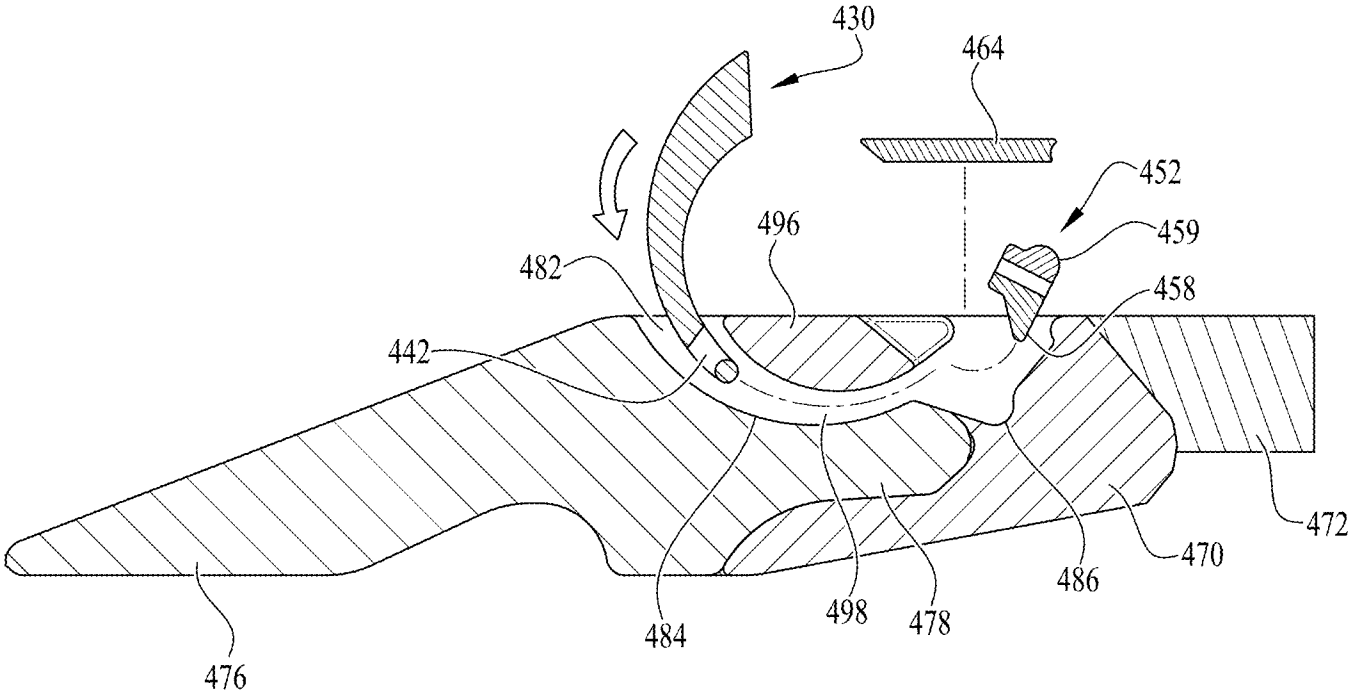
FIG. 47 is a sectional view of the assembled lip assembly of FIG. 46 taken on-center and along the longitudinal axis of the fastener, showing the fastener rotating into the inserted configuration.
Figure 48:
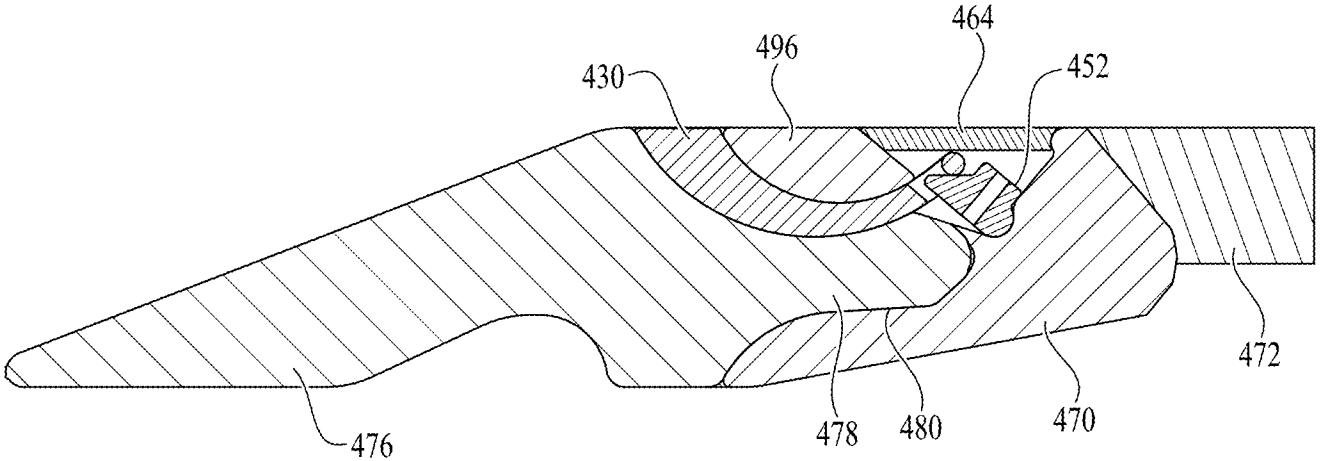
FIG. 48 is a sectional view of the assembled lip assembly of FIG. 46 taken on-center and along the longitudinal axis of the fastener, showing the fastener in the inserted configuration.
Figure 49:
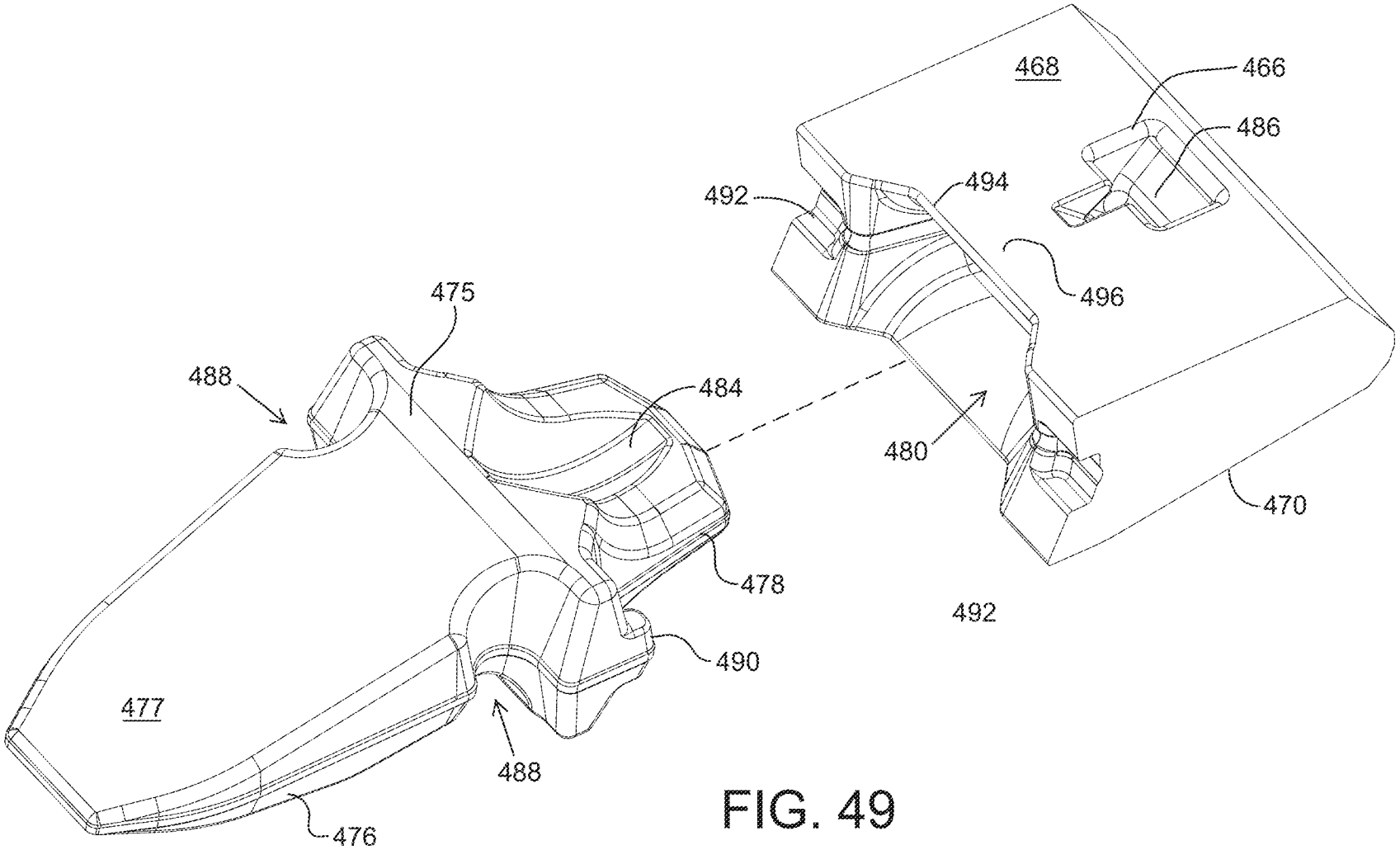
FIG. 49 is a top front exploded perspective view of the lip adapter and the tooth of the lip assembly of FIG. 46.
Figure 50:
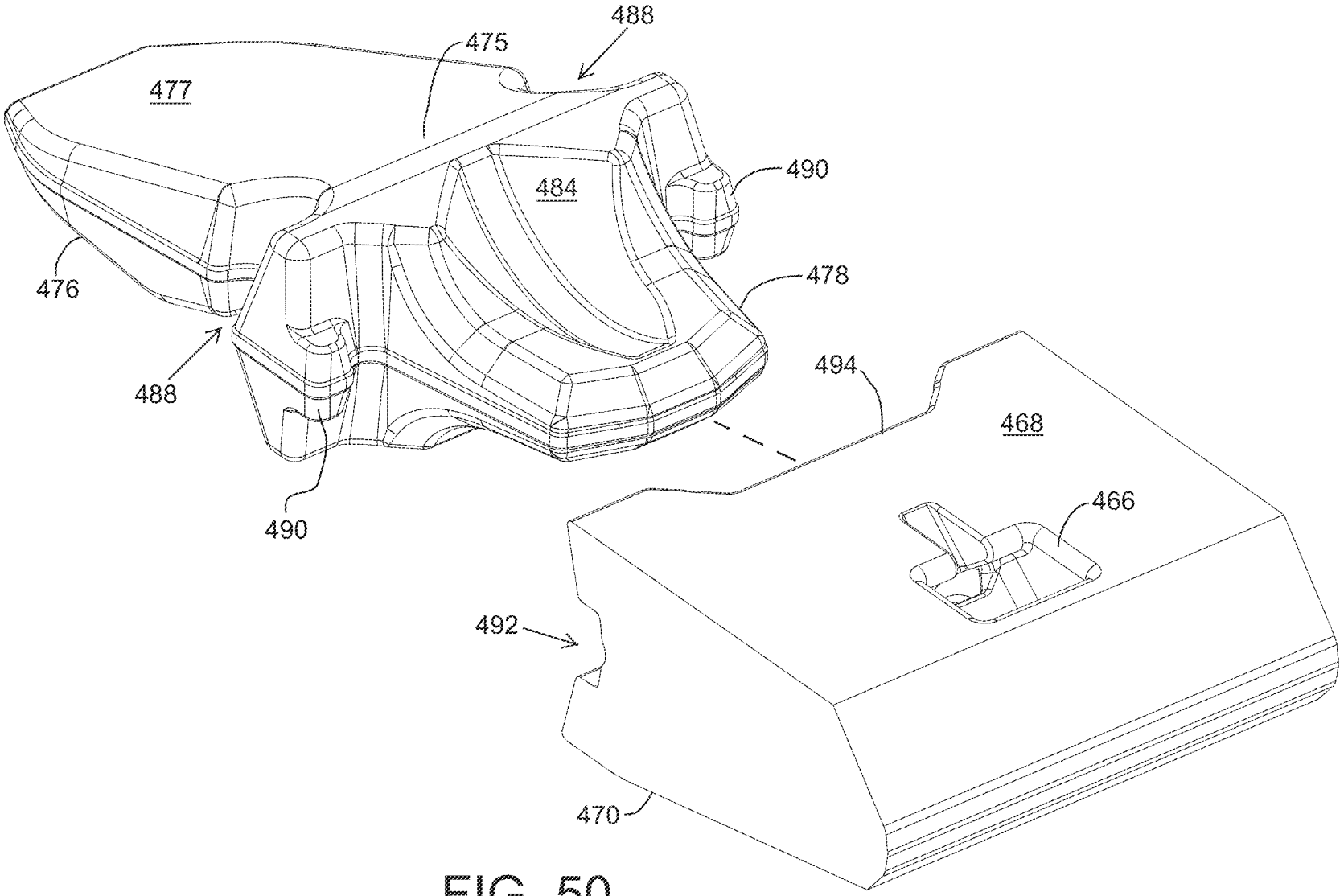
FIG. 50 is a top back exploded perspective view of the lip adapter and the tooth of the lip assembly of FIG. 46.
Figure 51:
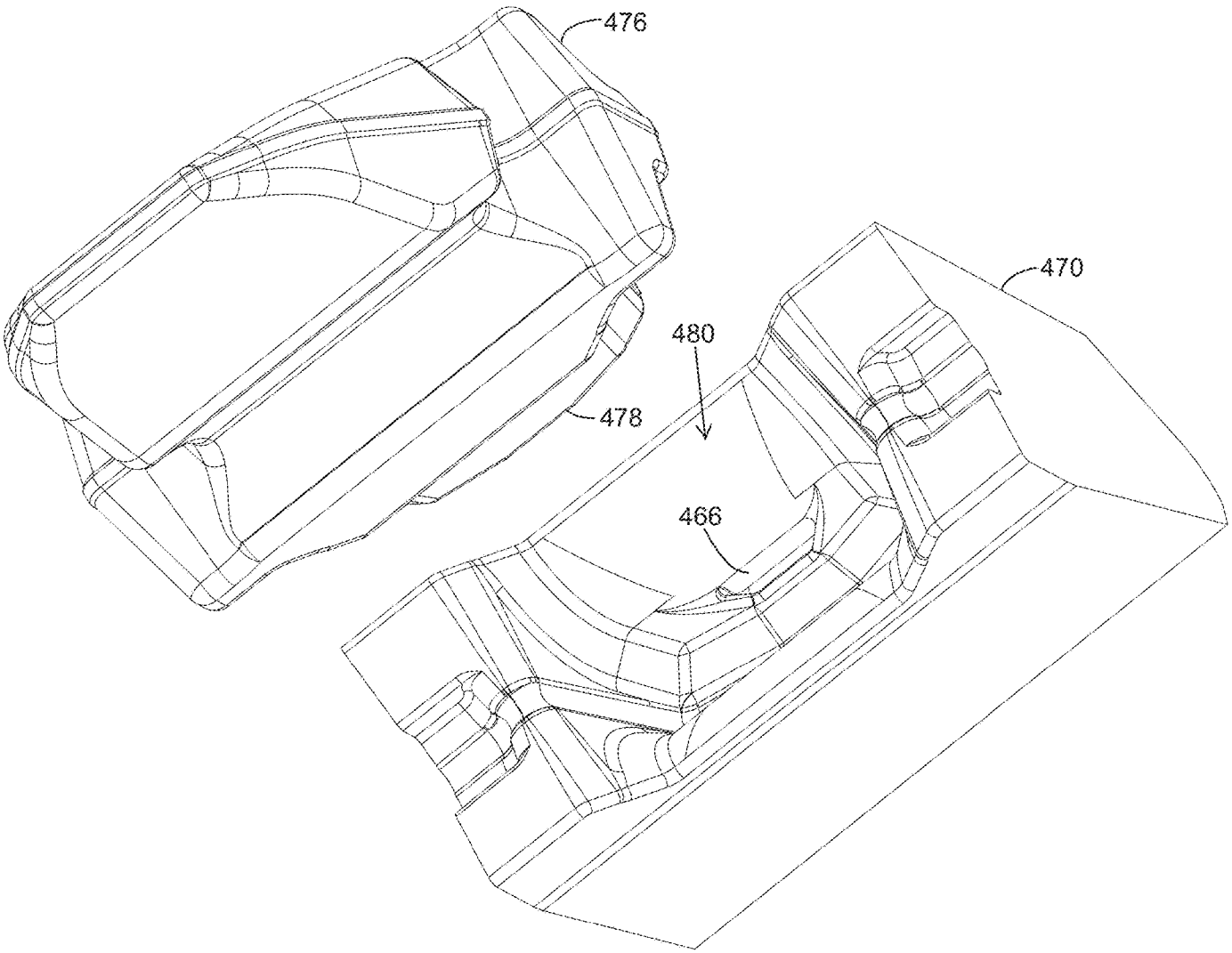
FIG. 51 is a bottom front exploded perspective view of the lip adapter and the tooth of the lip assembly of FIG. 46.
Figure 52:
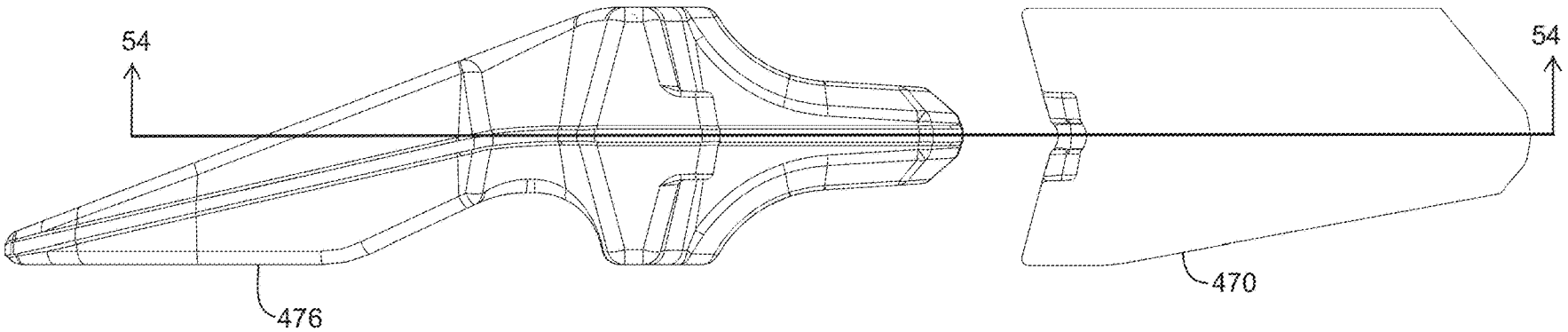
FIG. 52 is a side exploded view of the lip adapter and the tooth of the lip assembly of FIG. 46.
Figure 53:
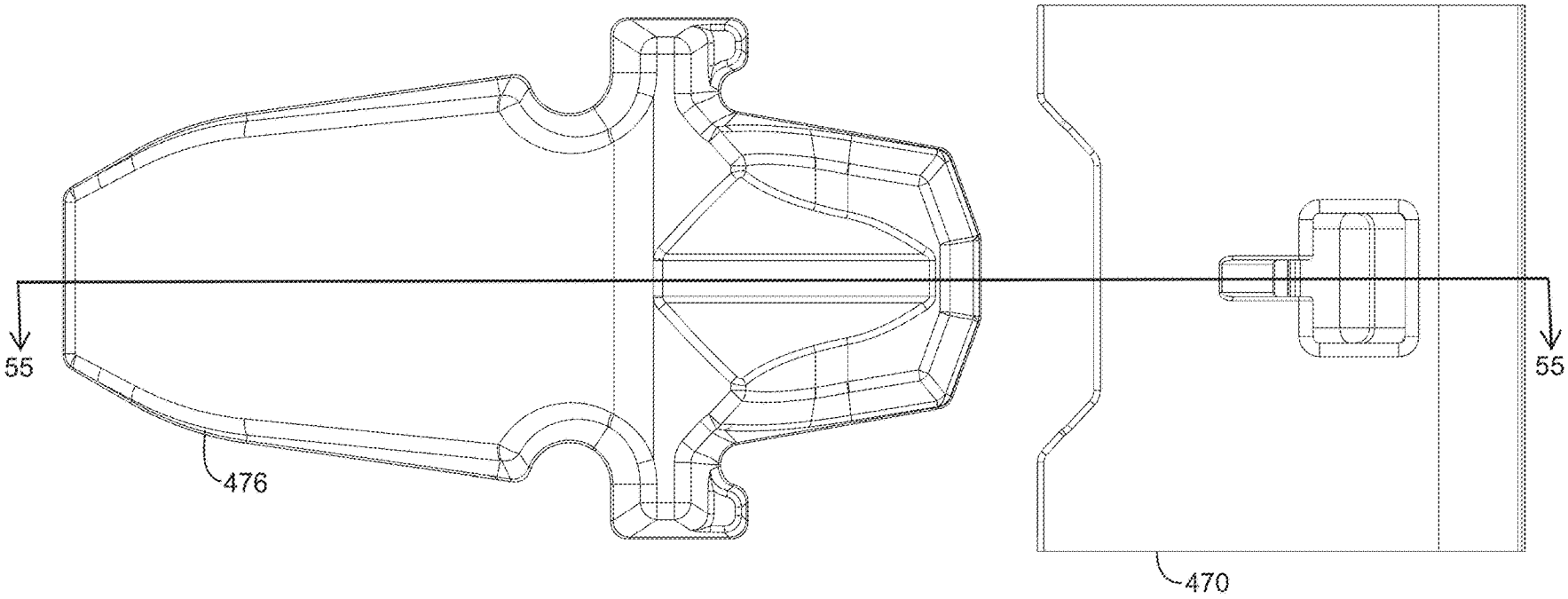
FIG. 53 is a top exploded view of the lip adapter and the tooth of the lip assembly of FIG. 46.
Figure 54:
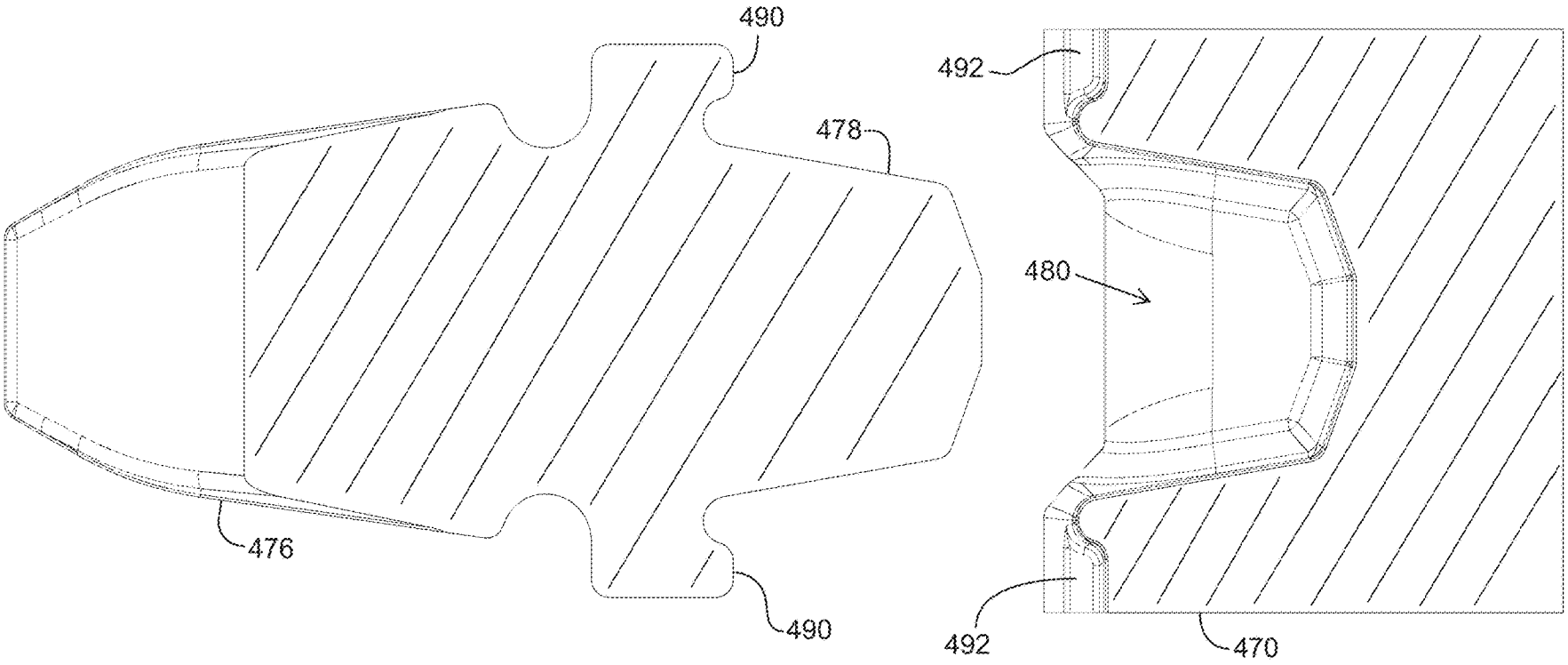
FIG. 54 is a top cross-sectional exploded view of the lip adapter and the tooth of the lip assembly of FIG. 46, taken along section 54-54 in FIG. 52.
Figure 55:
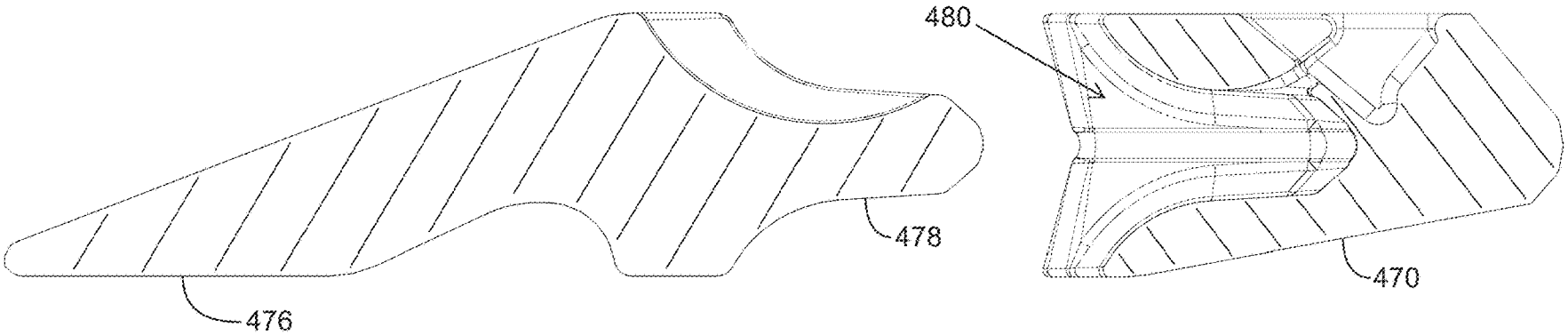
FIG. 55 is a side cross-sectional exploded view of the lip adapter and the tooth of the lip assembly of FIG. 46, taken along section 55-55 in FIG. 53.

Very similar in many respects to the embodiment of FIG. 29-35 (with the differences explained), looking at the outer surface of the elongate arcuate body 370, there is an inner surface 392 opposing and generally having a smaller radius than the outer surface 394. Although the curvature of the inner surface 392 and the outer surface 394 are described as having a radius, the curvature of each of the surfaces can have a constant radius (e.g., an arc of a circle) or a radius that is variable or not constant (e.g., an arc of an ellipse, a curvilinear shape). Furthermore, portions of the inner surface 392 and the outer surface 394 may include non-curved surfaces (e.g., depressions, protrusions, planar portions, and so on). Thus, the radius or curvature of the elongate arcuate body 370 in general, the inner surface 392, and the outer surface 394, can mean, in one or more embodiments, that the general curvature is considered while ignoring relatively small discontinuities between the first portion 372 and the second portion 374. The cross-sectional shape of the elongate arcuate body 370 is somewhat rectangular, and more particularly, a square-like shape with large corner radii, as seen in FIG. 38), where the area of the cross section decreases as measured from the first portion 372 to the second portion 374.

The retaining portion 380, in this example, is a threaded through hole for threadably receiving therein a first set screw 396 being threaded within the hole 380. On the second end 378, a extraction bore 386 is formed, as well as a flange 382 with a threaded hole 384 for receiving a second set screw 398. In use, a portion of the elongate arcuate body 370 of the fastener 368 is received within the concavity of the seat 402 formed in an insert 400, where the seat 402 is shaped to closely match the negative shape of the elongate arcuate body 370. The seat 402 includes a step 404 formed therein, and ledge 406 formed adjacently.

The shroud 414 (or other attachment, such as a wear part or adapter) includes a cavity 418 for receiving the nose 416 of the lip 408, and an entry hole 422 formed through a first leg 424 of the shroud 414 which defines a cross member 420 which comprises an arced hump. The insert 40 is placed in the mortise 410 formed on the top surface 412 of the lip 408, and the shroud 414 is placed over the nose 416. The entry hole 422 aligns with part of the seat 402. In a similar manner to the embodiment of FIGS. 1-8, the first set screw 396 is threaded into hole 380 and until touching the step 404, where the user can further tighten the first set screw 396 pull the fastener 368 further into the passage 428. The second set screw 396 is optionally threaded into hole 384 to reduce play or slop in the assembly for a tight fit without relying solely on the wedge-like fit of the fastener 368 within the passage 428.

Turning to FIGS. 43-55, an additional embodiment of the fastener 430 is disclosed. The elongate arcuate body 432 of the fastener 430 generally includes a first end 438 opposite a second end 440. A first portion 434 is a region of the elongate arcuate body 432 that is closer in proximity to the first end 438 than the second end 440, and can, in one or more embodiments, include or exclude within that region the first end 438. A second portion 436 is a region of the elongate arcuate body 432 that is closer in proximity to the second end 440 than the first end 438, and can, in one or more embodiments, include or exclude within that region the second end 440.

Looking at the outer surface of the elongate arcuate body 432, there is an inner surface 448 opposing and generally having a smaller radius than the outer surface 450 (although, in this example embodiment, the inner surface 448 and the outer surface 450 are planes curved or curled about their respective center axes, where the curved planes are curled about axes perpendicular and offset to the longitudinal axis). Although the curvature of the inner surface 448 and the outer surface 450 are described as having a radius, the curvature of each of the surfaces can have a constant radius (e.g., an arc of a circle) or a radius that is variable or not constant (e.g., an arc of an ellipse, a curvilinear shape). Furthermore, portions of the inner surface 448 and the outer surface 450 may include non-curved surfaces (e.g., depressions, protrusions, planar portions, and so on). Thus, the radius or curvature of the elongate arcuate body 432 in general, the inner surface 448, and the outer surface 450, can mean, in one or more embodiments, that the general curvature is considered while ignoring relatively small discontinuities between the first portion 434 and the second portion 436. The cross-sectional shape of the elongate arcuate body 432 is somewhat trapezoidal (an isosceles trapezoid in this example), where the area of the cross section decreases as measured from the first portion 434 to the second portion 436. The second face 446 at the second end 440 illustrates the trapezoidal shape. The retaining portion 442, in this example, is a slot or other hole formed through the elongate arcuate body 432 at the first portion 434, with the portion of the hole closest to the first end 438 radiused to permit engagement and disengagement with the protrusion 458 of the catch 452.

The tooth 476 includes a cutting portion 477 opposite a nose portion 478, each protruding from the tooth body 475 is opposite directions. The nose portion 478 protrudes rearwardly from the tooth body 475 and is configured to fit within a cavity 480 within an adapter 470 which connects to the lip 471 (e.g., by welding or using one or more of the present fasteners. The design of the tooth 476 is unique and provides a long-lasting cutting tool that is stronger than tooth designs with a cavity formed into the tooth, basically providing a solid metal cross-section. The nose portion 478 includes a seat 484 with integrally formed within the nose 478, where the concavity of the seat 326 is shaped to closely match the negative shape of the elongate arcuate body 432, matching the shape of the outer surface, the first side surface 449, and the second side surface (out of view in the figures). The tooth 476 further includes an installation indent 488 on each side of the tooth body 475 shaped to receive a vertical pole on a rack which hold a plurality of tooth assemblies (as shown in later figures). Further, a locator boss 490 protrudes from the tooth body 475 on each side of the nose 478, and each engage within a locator pocket 492 formed in the adapter 470 to help in locating the tooth 476 on the adapter 470 and to limit shifting and twisting of the tooth 476 within the pocket 480.

The adapter 470 (or lip assembly in one or more embodiments) includes a pocket within which the nose 478 is inserted. A notch 494 on the front edge of the pocket 480 partially defines the entry hole 482. An access hole 466 is formed through the top surface 468 of the adapter 470 and is shaped internally to include a catch seat 486 within which a catch 452 is captured and selectively permitted to rotate over a limited angle. The access hole 466 communicates with both the catch seat 486 and the cavity 480. A cross member 496 is defined between the notch 494 and the access hole 466.

The catch 452 is made of a front plate 454 with a catch protrusion 458 extending therefrom, a back plate 456, with two elastomeric spacers 460 sandwiched therebetween. A gap between the elastomeric spacers 460 provides access for insertion of the head of a screwdriver for tilting the catch 452 to permit the extraction of the fastener 430. When inserting the fastener 430 into the passage 498 through the entry hole 482, the first end 438 of the fastener contacts the protrusion 458 of the catch 452, and forces the catch 452 to rotate about its heel 459 within the catch seat 486 (a clockwise rotation in the view of FIGS. 47 and 48). The user continues to push the fastener 430 past the protrusion 458, thereby compressing the elastomeric spacers 460 (made of rubber bonded between the first plate 454 and the second plate 456 through a vulcanization process) and permitting the first end 438 to pass the protrusion 458, such that the protrusion 458 is inserted through the hole 442 near the first end 438 of the fastener 430. Inserting a screwdriver or other pry tool within the slot 462 and rotating counterclockwise forces the protrusion 458 to push the fastener 430 partially out of the passage 498, disengaging the protrusion from the catch hole 442 (e.g., the fastener 430 acts much like a moving strike plate when engaging and disengaging the catch protrusion 458). In this way, the user can grasp the second end 440 of the fastener 430 and withdraw it from the passage 498.

Figure 56:
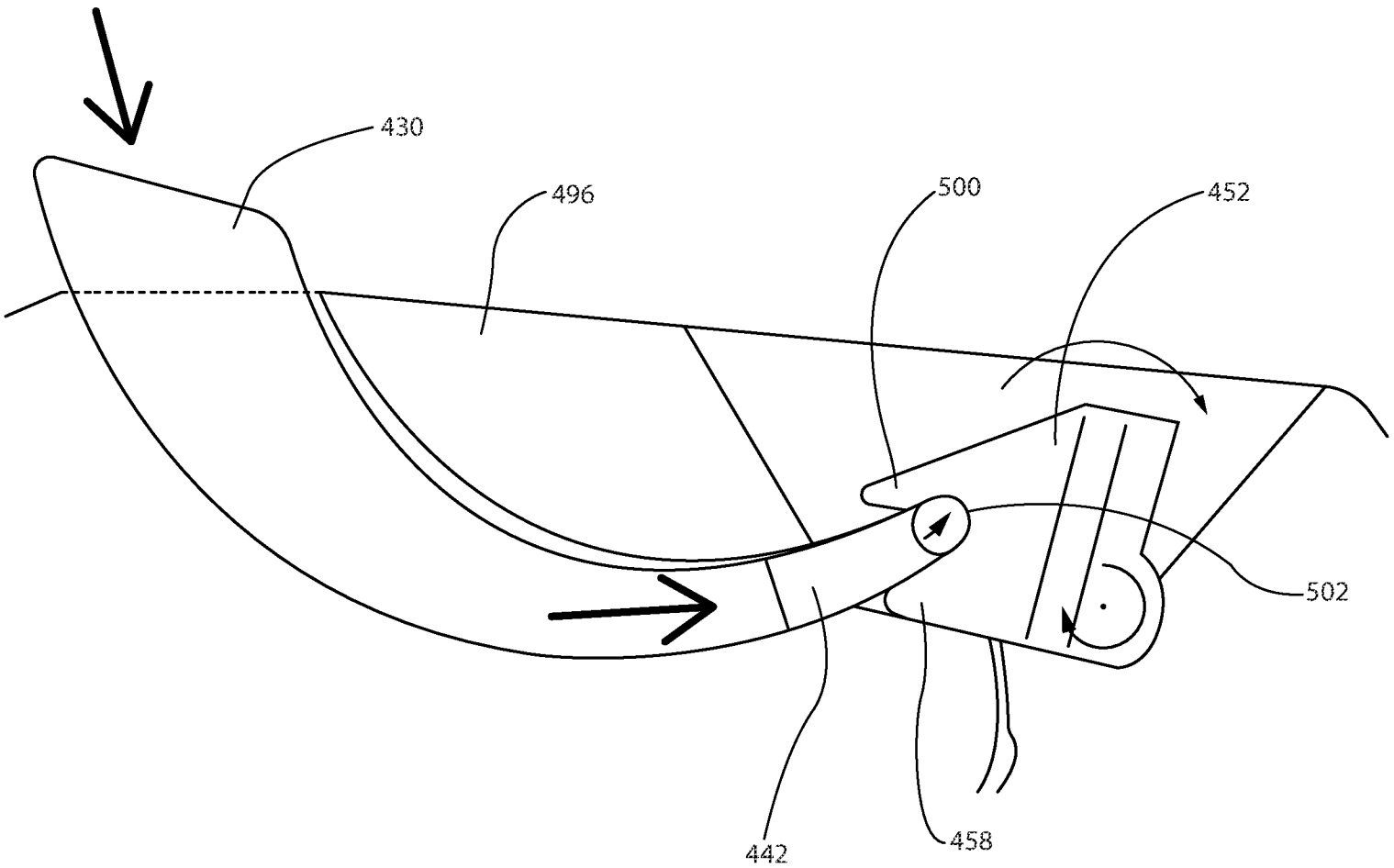
FIG. 56 is a side view of a modified embodiment of the fastener of FIG. 43, showing the fastener rotating into the inserted configuration.
Figure 57:
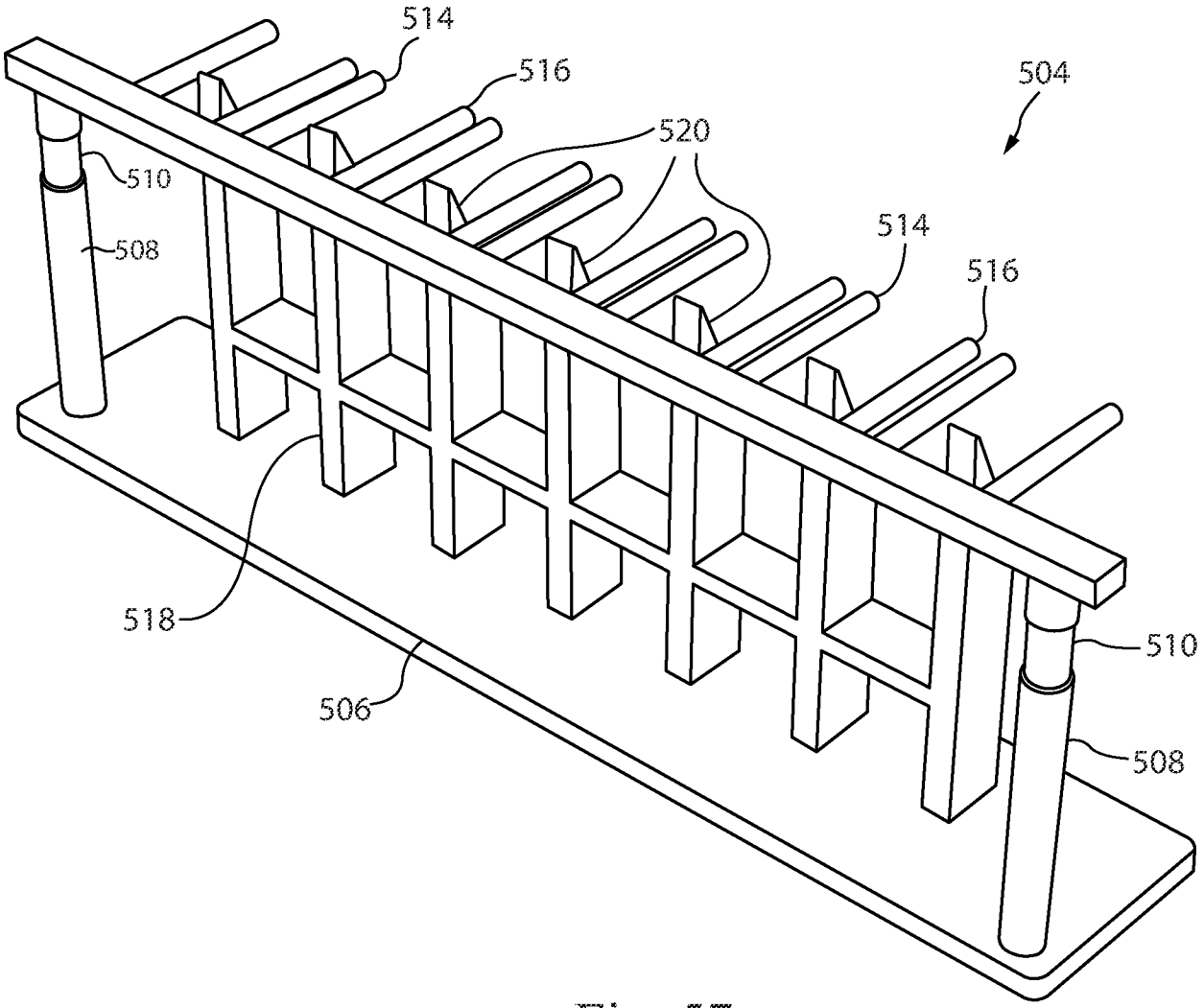
FIG. 57 is a back perspective image of a loading rack compatible with the one or more embodiments of the present lip assemblies.
Figure 58:
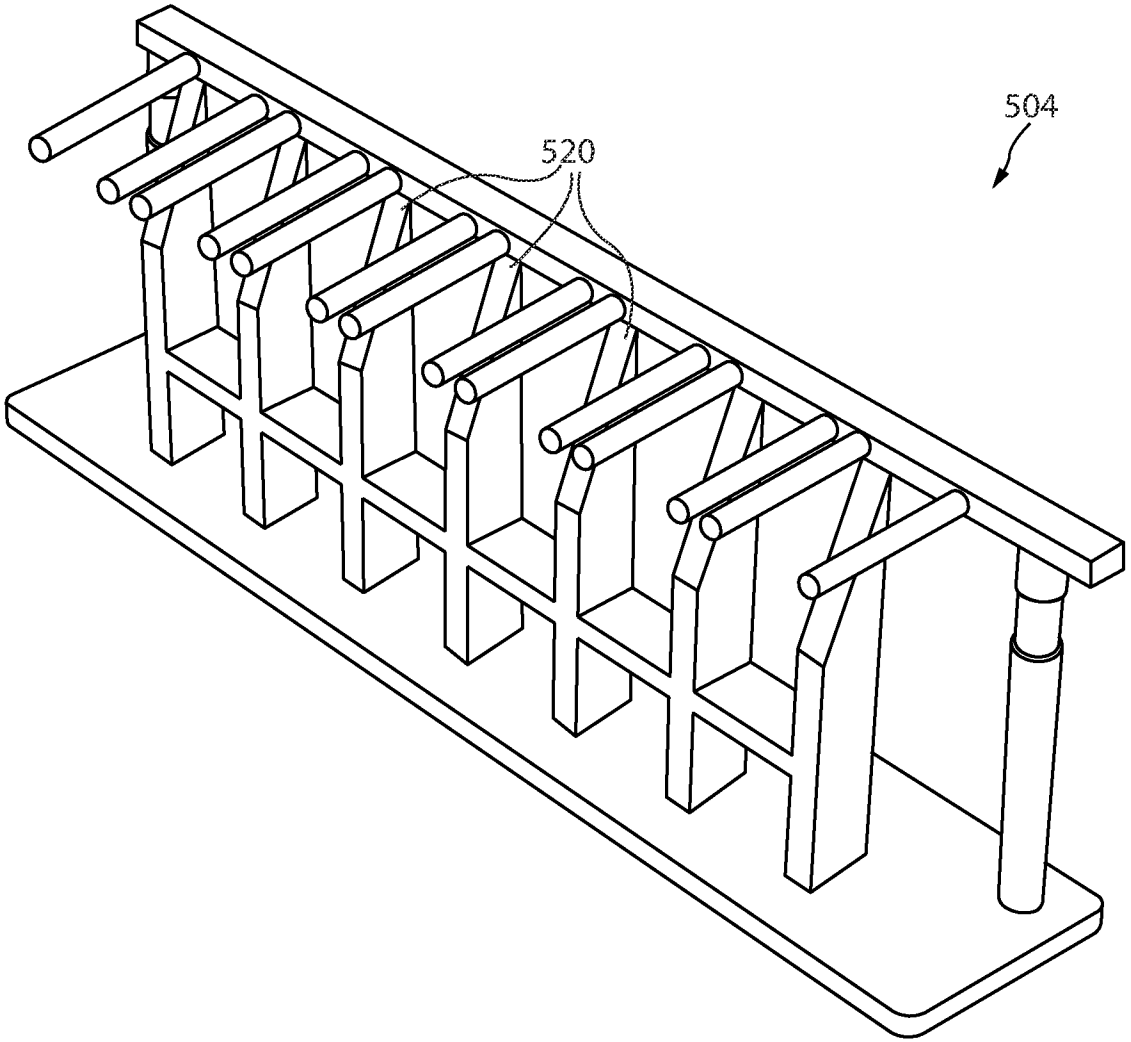
FIG. 58 is a front perspective image of the loading rack of FIG. 57.
Figure 59:
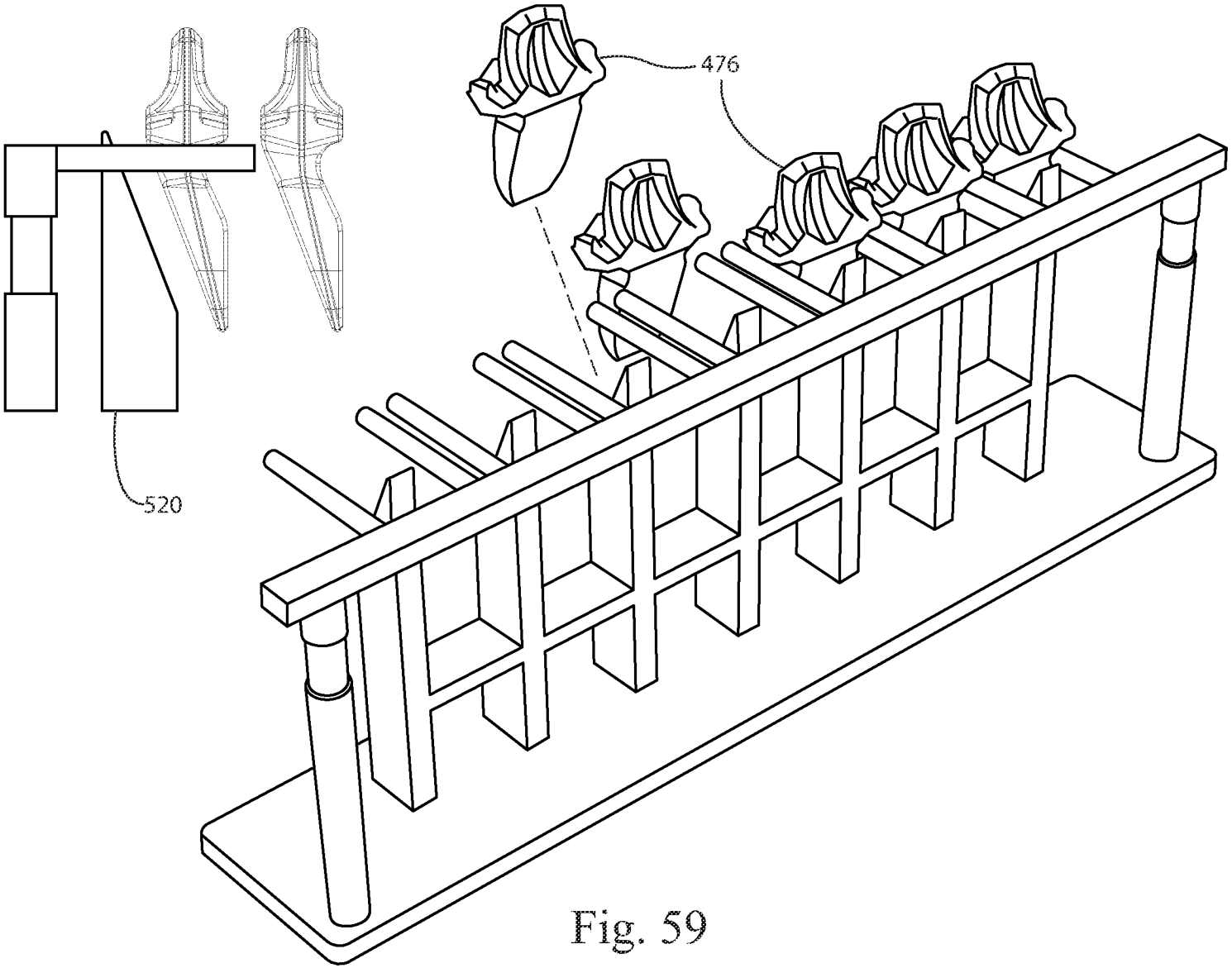
FIG. 59 is a back perspective image of teeth being loaded onto the loading rack.
Figure 60:
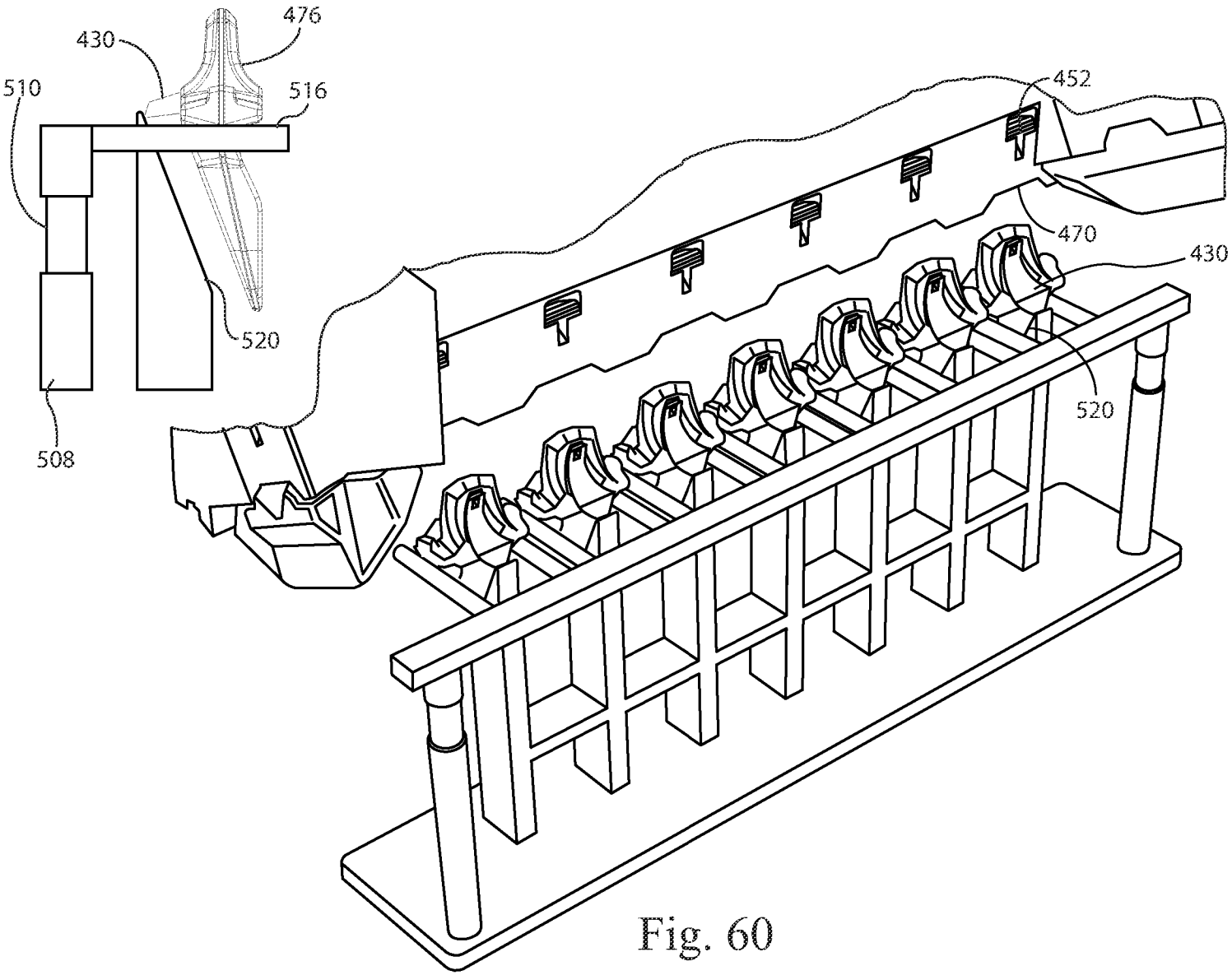
FIG. 60 is a back perspective image of a lip of a bucket aligned and ready to receive the teeth in locking engagement supported by the loading rack.

A variation of the above embodiment of the fastener 430 is illustrated in FIG. 56, where catch 452 is modified to include a second protrusion 500 to define a pocket 502 between the protrusion 458 and the second protrusion 500, for capturing the end 438 within the pocket 502.

Figure 61:
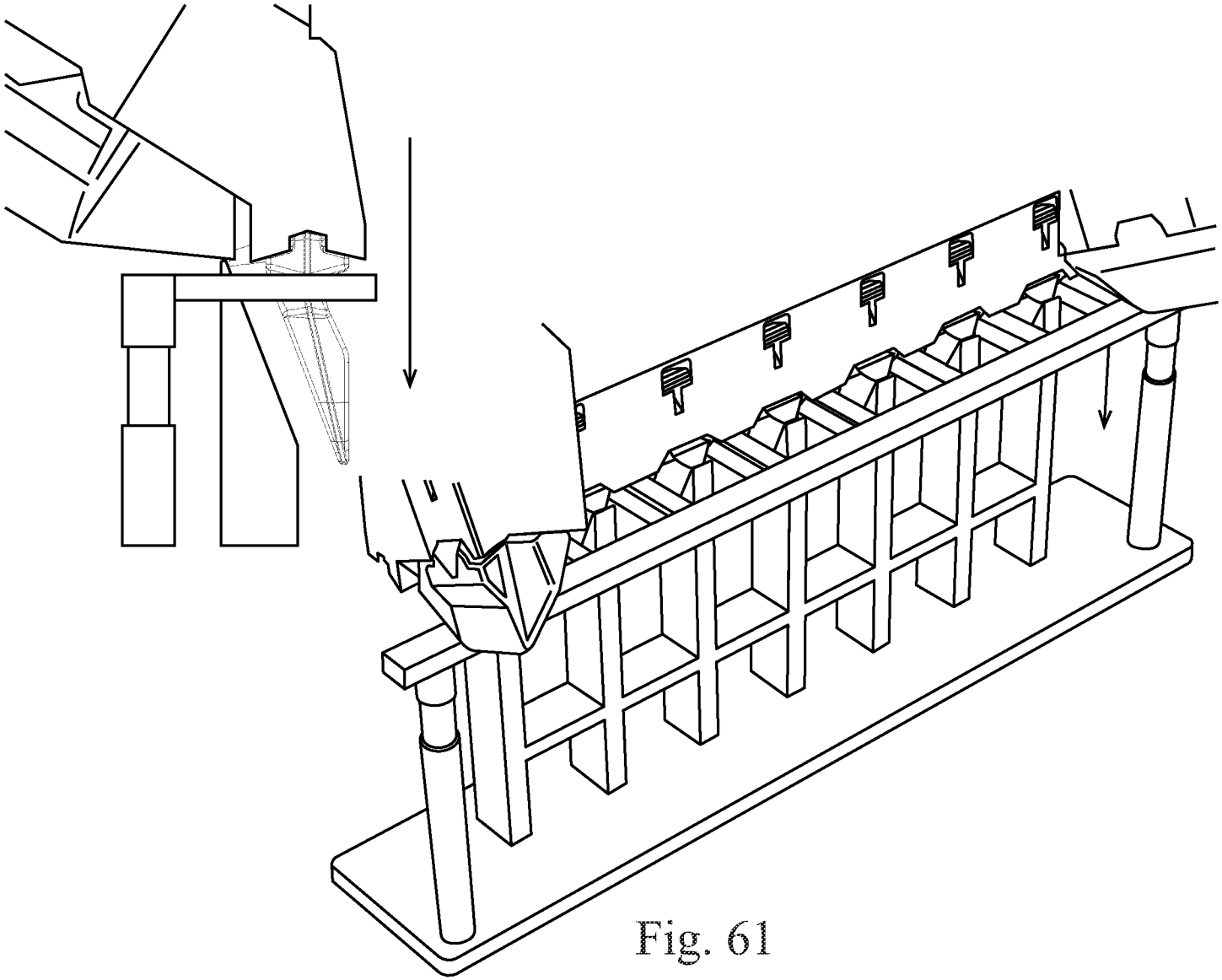
FIG. 61 is a back perspective image of the lip of the bucket compressing the upper rack down to lock the teeth into place on the lip assembly.
Figure 62:
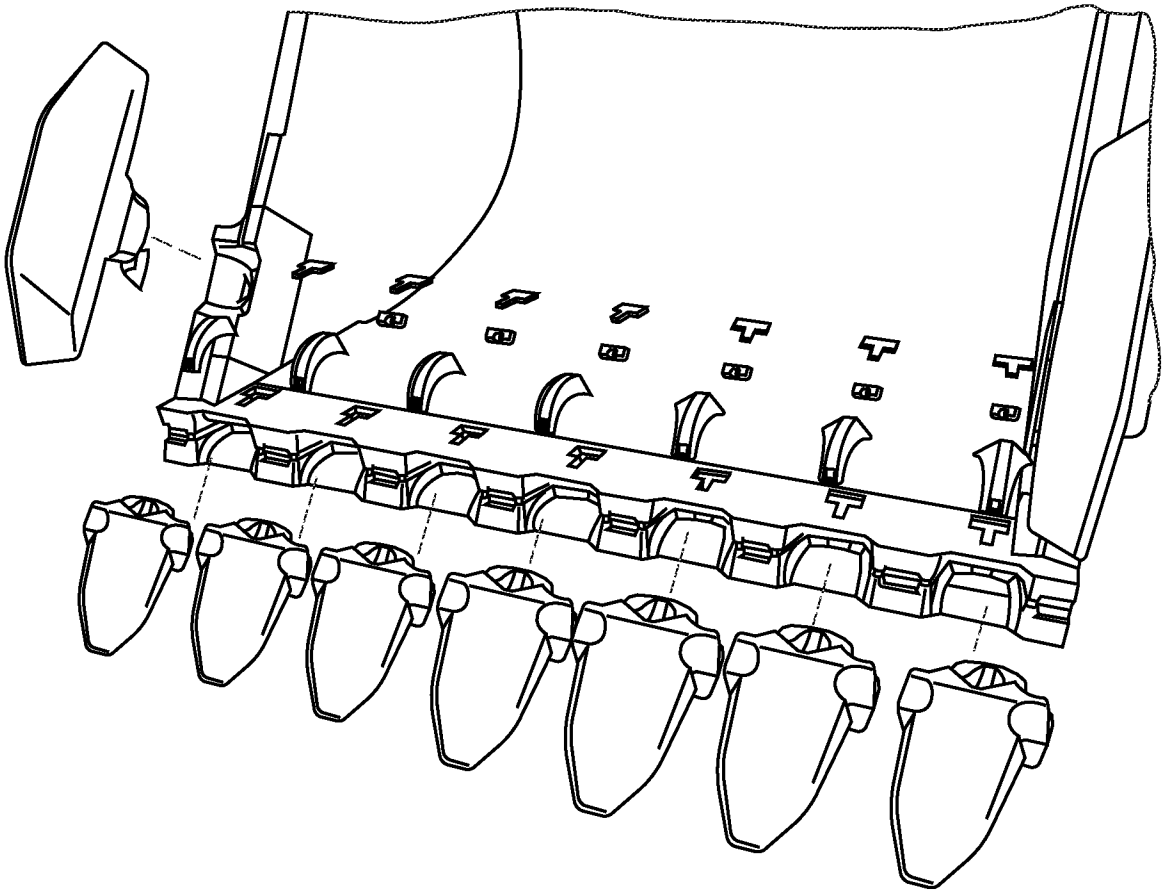
FIG. 62 is a exploded perspective image of an exemplary bucket, illustrating the shrouds and teeth ready for assembly to the bucket lip assembly.
Figure 63:
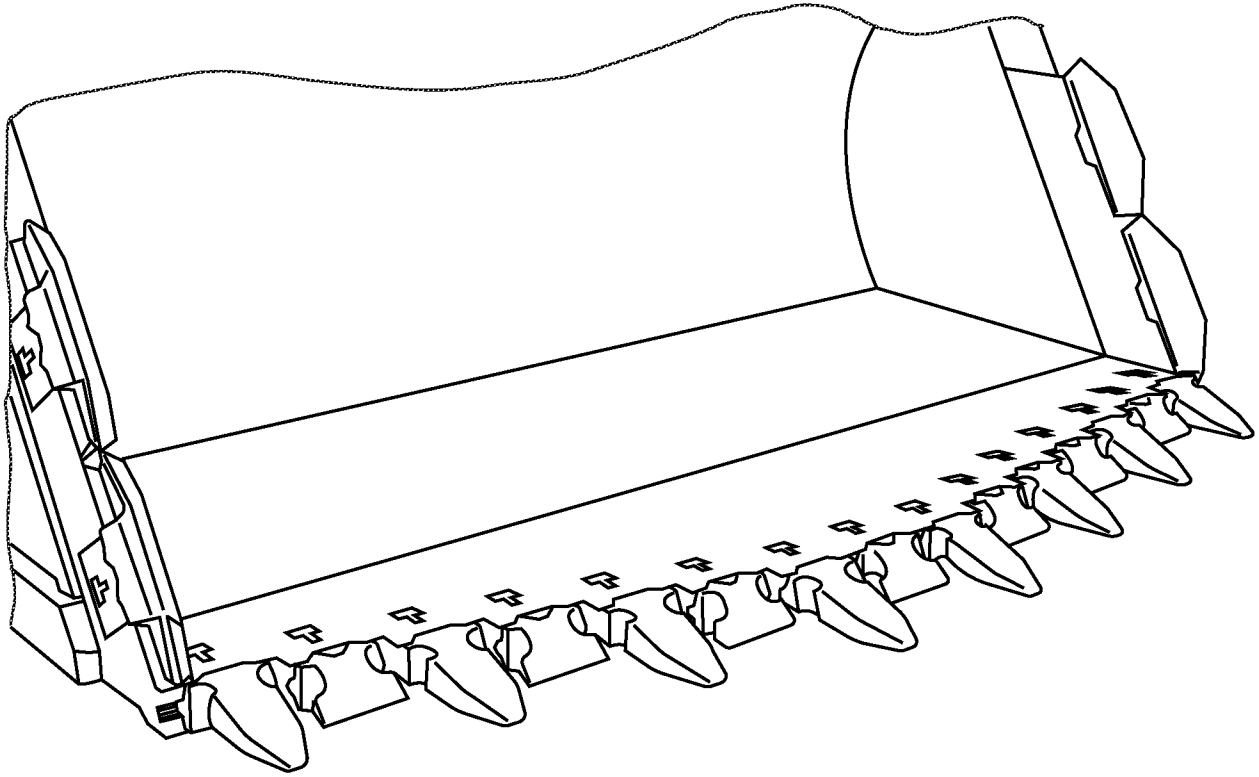
FIG. 63 is a perspective image of another exemplary bucket, illustrating the shrouds and teeth attached to the bucket lip assembly.
Figure 64:
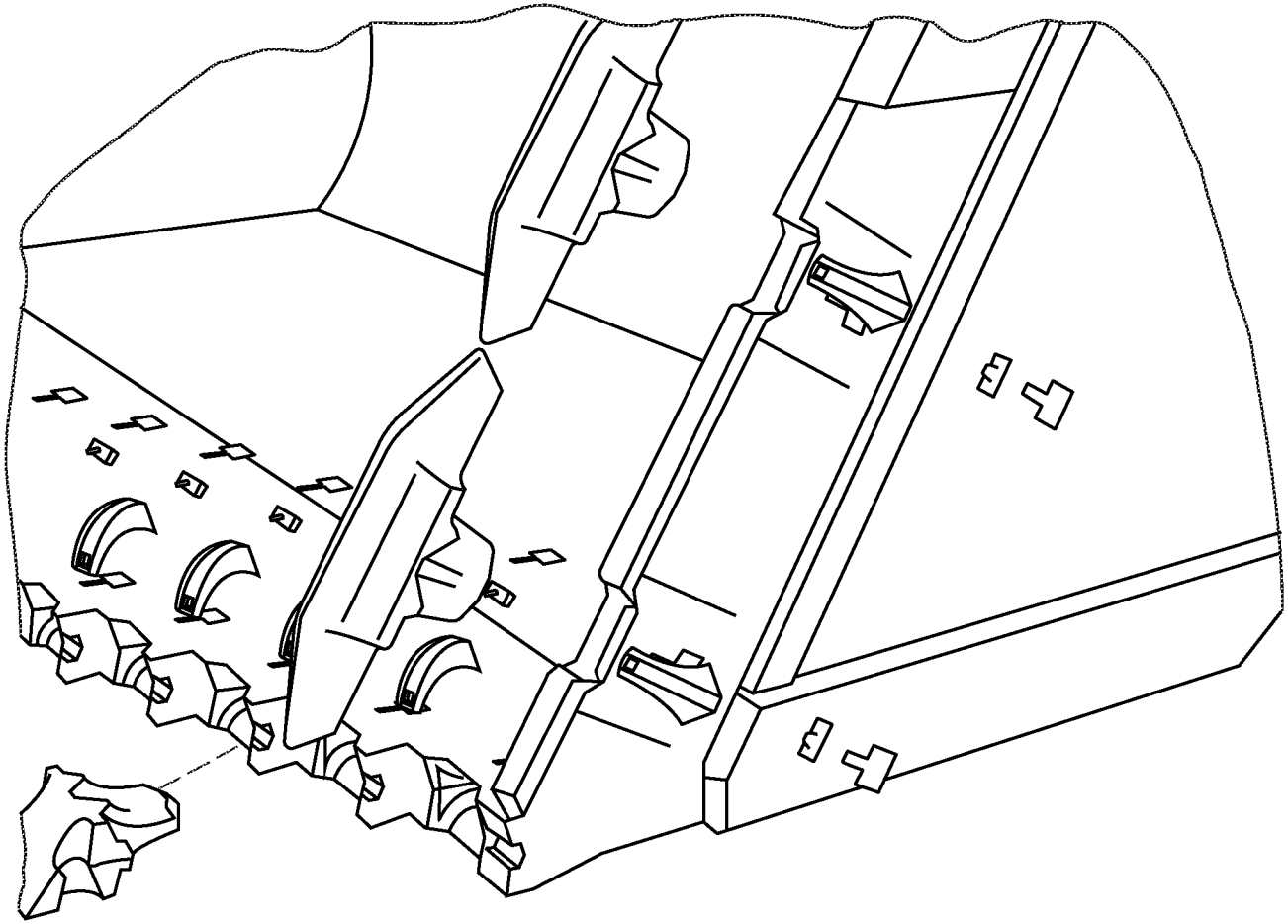
FIG. 64 is a exploded perspective image of bucket of FIG. 63, illustrating the shrouds and teeth ready for assembly to the bucket lip assembly.
Figure 65:
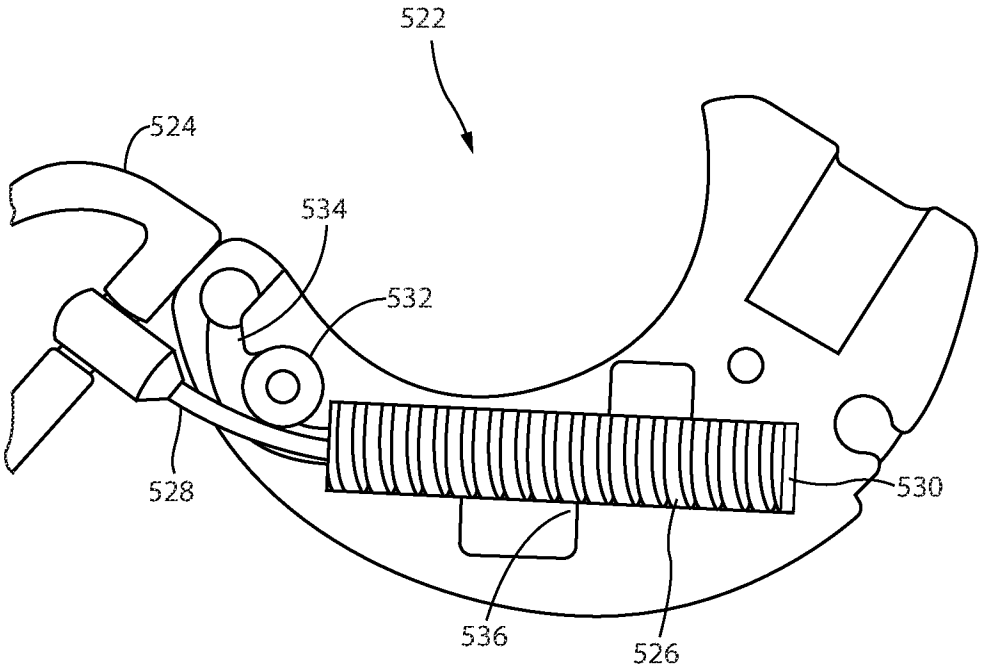
FIG. 65 is a photographic image of another embodiment of the present fastener, with one half of the body removed to view the mechanism within.
Figure 66:
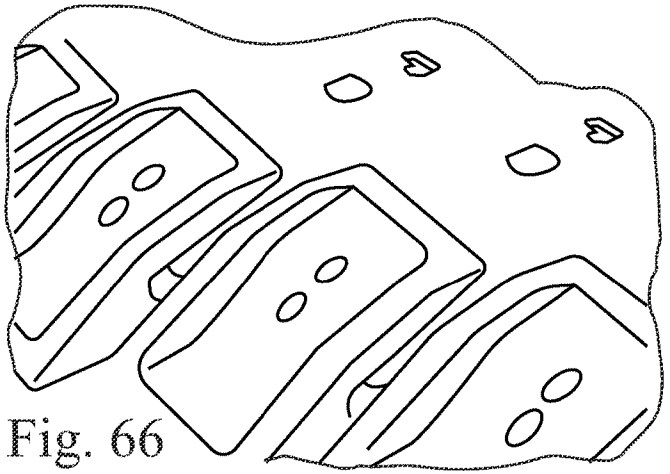
FIG. 66 is a perspective view of the fastener of FIG. 65, showing the fastener in the inserted configuration holding teeth onto a lip assembly of a bucket.

FIGS. 57-61 illustrate a tooth loading rack 504, designed to quickly and automatically load a plurality of teeth 522 (or other wear parts or attachments) by lowering the lip 470 of the implement over the row of teeth 544 aligned on the rack 504 and pressing down to lock the teeth 522 in place on the lip 470 with the fastener 430. The loading rack 504 includes a base 506 with two vertical tubes 508 extending upwards at each end of the base 506 and each receiving a spring-loaded telescoping tube 510 biased out of the vertical tubes 508. A cross beam 512 spans between and connects the top ends of the two telescoping tubes 510. The cross beam 512 includes a plurality of support bars arranged in pairs 514, 516 and extending horizontally at a right angle from the cross beam 512, and configured to hold a tooth 522 (or other attachment) by engaging the installation indents 488 formed on each side of the tooth 522. In this example, seven teeth 522 can be loaded on the rack 504, although more or less is possible. In each seat 484 of each tooth 476 a fastener 430 is placed, such that the second end 440 rests against the adjacent ramp 520 of the fastener insertion structure 518 extending upwards from the base 506. Within each access hole 466 of the lip 470, a catch 452 is inserted and placed within the seat 486. As shown in FIG. 61, the user lowers the machine implement, so that the cross beam 515 is lowered (by pushing in, against spring force, the telescoping tubes 510) relative to the ramps 520. Since the fastener 430 second end 440 rides on the ramp 520 surface, as the cross beam 515 lowers and the teeth 476 are lowered with the cross beam 515, the distance between the ramps 520 and their respective teeth 476 reduces, thereby pushing the fastener 430 further into the passage 498 until the catch hole 442 engages with and locks within the protrusion 458 of the catch 452. Thereafter, as the implement is lifted slightly and reversed, the teeth 476 (now locked to the lip 470) slide off their respective pair of support bars 514, 516. FIG. 62 illustrates an exploded view of the bucket assembly assembled in FIGS. 60-61. FIGS. 63-64 show yet more bucket assemblies possible using the present fastener 430.

Figure 67:
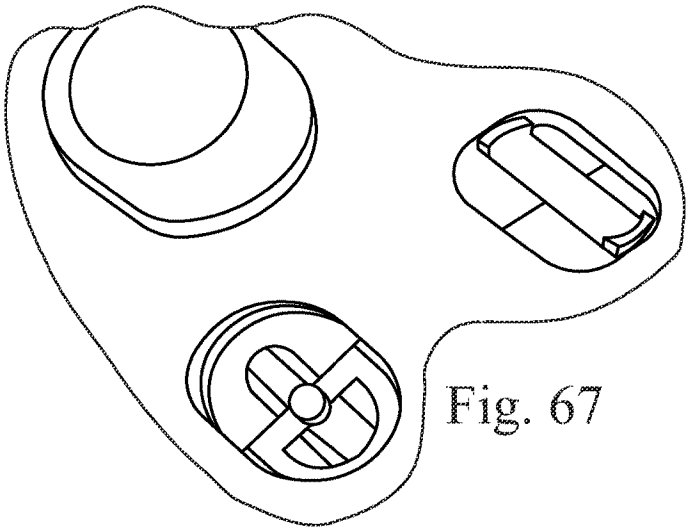
FIG. 67 is a perspective view of the fastener installed in the lip assembly of FIG. 66 illustrating a step of the extraction process.
Figure 68:
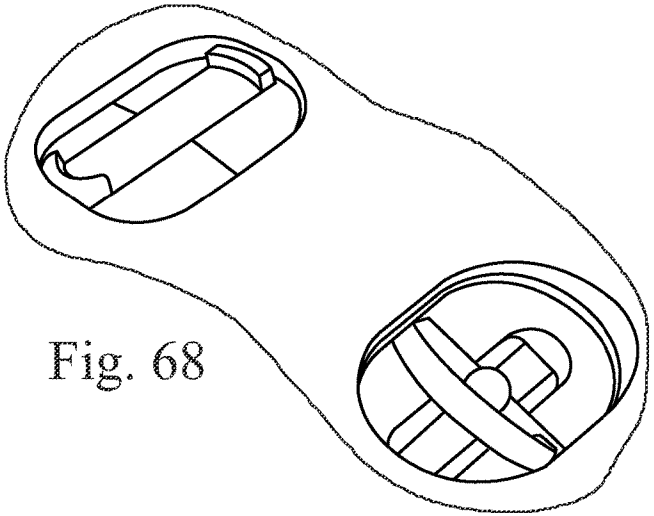
FIG. 68 is a perspective view of the fastener installed in the lip assembly of FIG. 66 illustrating another step of the extraction process.
Figure 69:
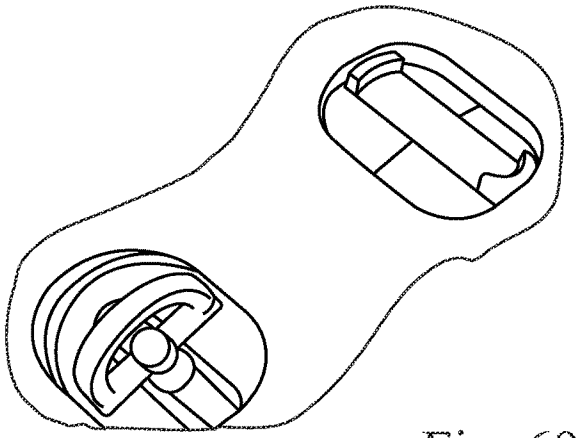
FIG. 69 is a perspective view of the fastener installed in the lip assembly of FIG. 66 illustrating yet another step of the extraction process.
Figure 71:
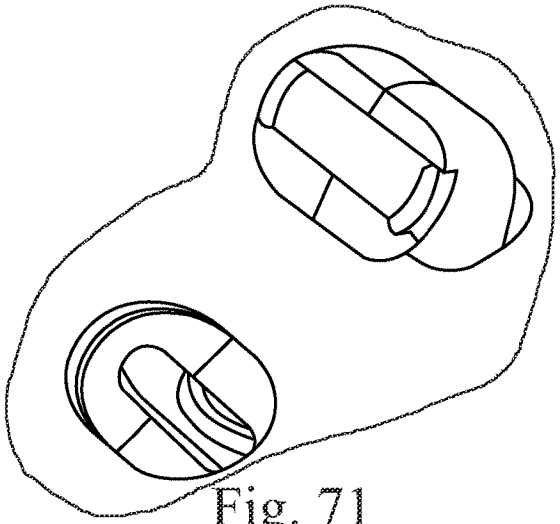
FIG. 71 is a perspective view of the fastener installed in the lip assembly of FIG. 66 illustrating yet a further step of the extraction process.
Figure 73:
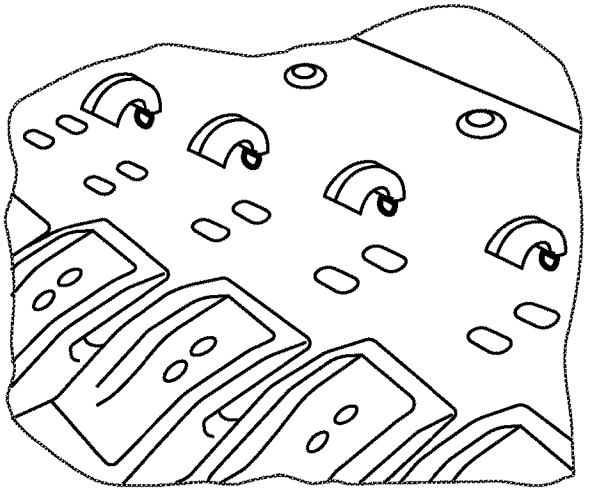
FIG. 73 is a perspective view of the fastener withdrawn the lip assembly of FIG. 66.
Figure 70:
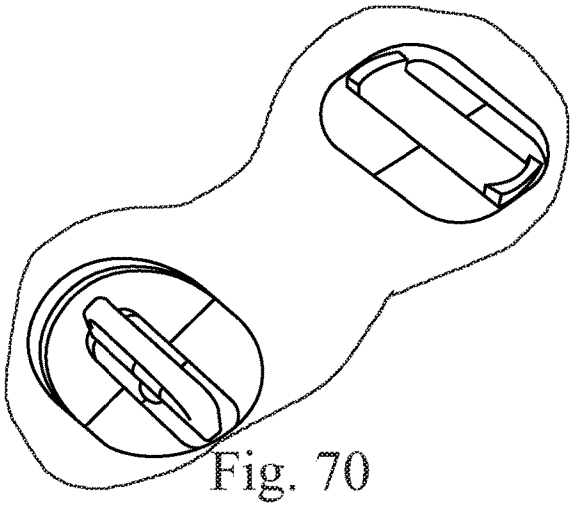
FIG. 70 is a perspective view of the fastener installed in the lip assembly of FIG. 66 illustrating a further step of the extraction process.
Figure 72:
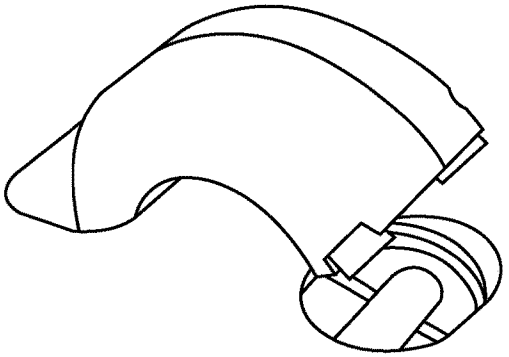
FIG. 72 is a perspective view of the fastener installed in the lip assembly of FIG. 66 illustrating nearing the final step of the extraction process.
Figure 75:
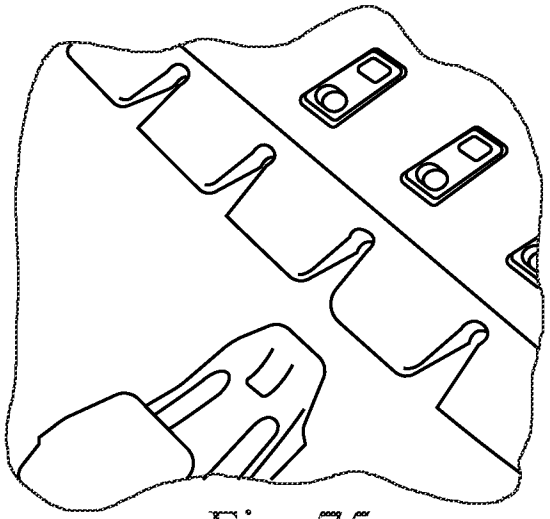
FIG. 75 is a perspective view of the lip of FIG. 66 illustrating a tooth aligned a ready for connection to the lip using the fastener of FIG. 65.
Figure 74:
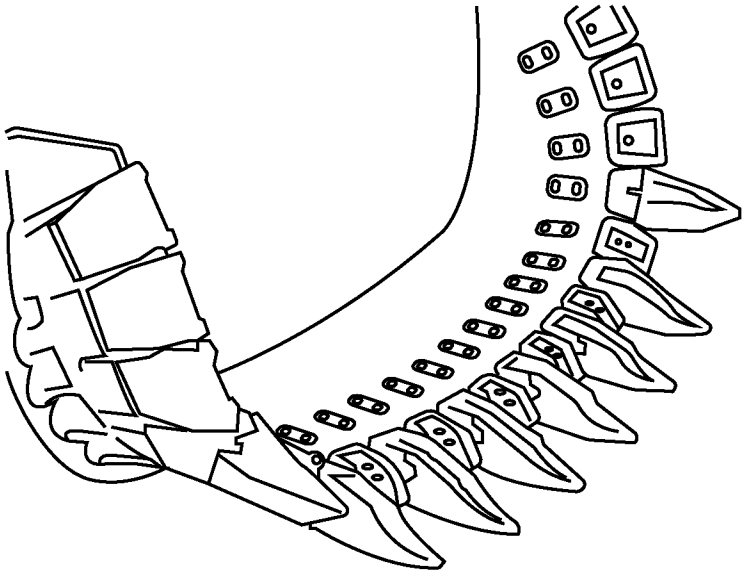
FIG. 74 is a perspective view of the fastener of FIG. 65, showing the fastener in the inserted configuration holding teeth onto a lip assembly of another exemplary bucket.
Figure 77:
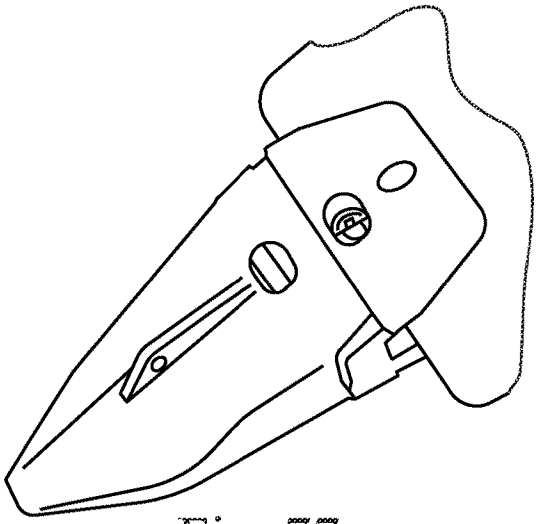
FIG. 77 is a perspective view of the of the lip of FIG. 66 illustrating the tooth in locked in place by the fastener.
Figure 76:
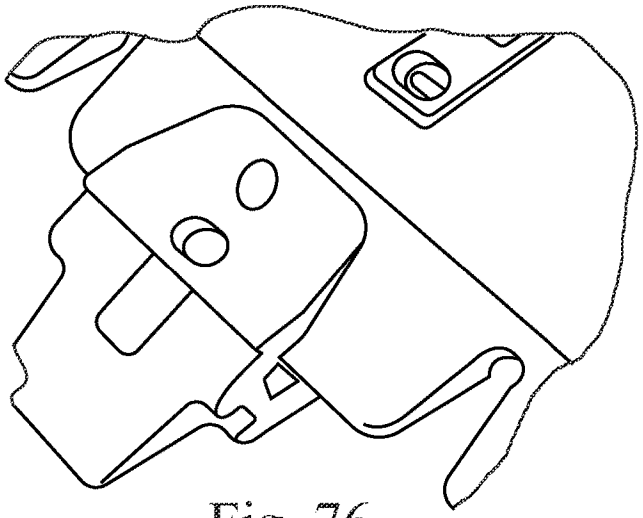
FIG. 76 is a perspective view of the lip of FIG. 66 illustrating the tooth in place on the lip and ready for insertion of the fastener to connect the tooth to the lip and the lip to the bucket.
Figure 78:
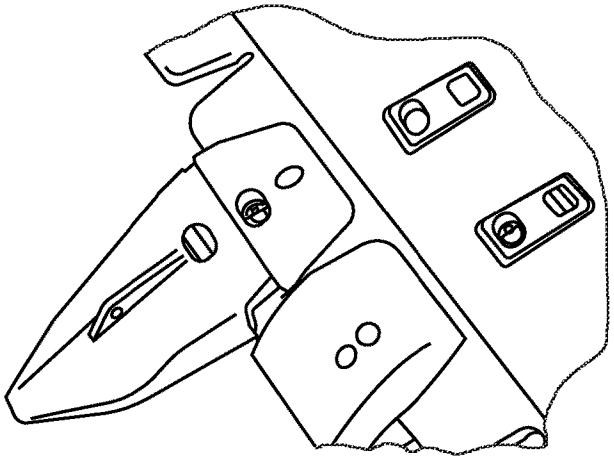
FIG. 78 is a perspective view of the of the lip of FIG. 66 illustrating the tooth and a shroud locked in place by respective fasteners.

FIGS. 65-78 show an embodiment of the fastener 522 (similar to the fastener described in reference to FIGS. 1-8, except different in how they lock in place), shown in isolation and in various applications to fasten wear parts to buckets and other implements. A locking handle 524 is positioned at the first end of the elongate arcuate body, and is connected by a cable 528 (through a cable passage 534 and about a bearing 532) to a compression spring 526 held within a spring cavity 536. The cable 528 travels through the coils of the spring 526 and connects to a cap 530 which compresses the spring 526 upon tensioning the cable 528. In use, the locking handle 524 is permitted to rotate and twist relative to the elongate arcuate body. FIG. 67 shows the handle 524 rotated across the access hole and laid down to prevent the fastener 522 from withdrawing from the passage. The handle 524 can be lifted up and rotated to align with the elongated access hole, so that the handle fits through the access hole, to permit the fastener 522 to withdraw from the passage, as shown in FIG. 70.

Figure 80:
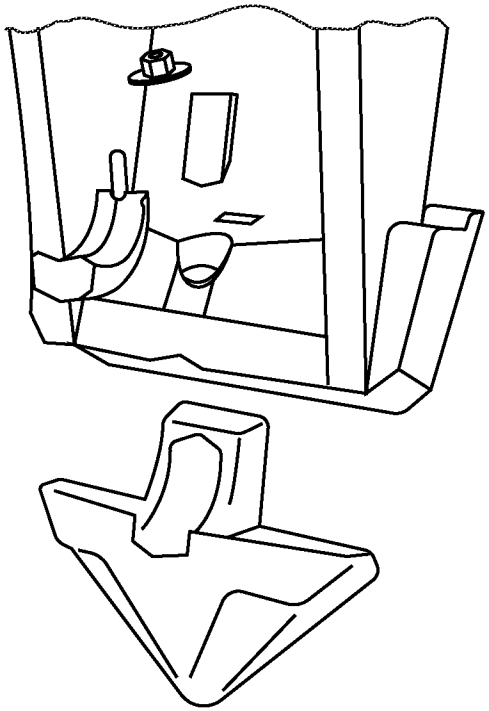
FIG. 80 is an exploded perspective view of the crane grapple of FIG. 79, with the tooth and fastener detached.
Figure 79:
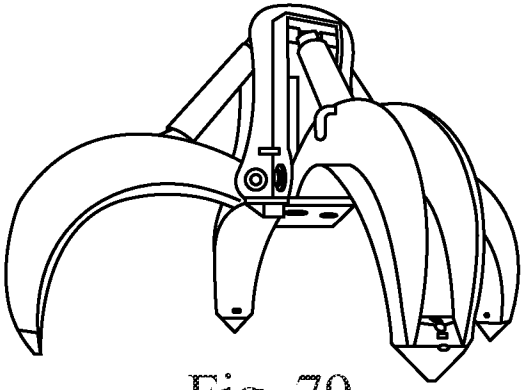
FIG. 79 is a perspective view of a crane grapple with a tooth attached to the tip of a tine using the yet another exemplary embodiment of the present fastener.
Figure 81:
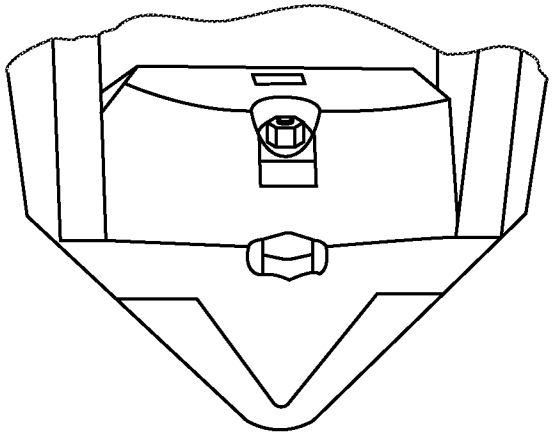
FIG. 81 is a magnified front view of the crane grapple of FIG. 79, with the fastener connecting the tooth to the grapple tine.

The fastener usage example of FIGS. 79-81 illustrates the fastener 20 of FIGS. 1-8 locking a tooth attached to the tip of a crane grapple.

Figure 83:
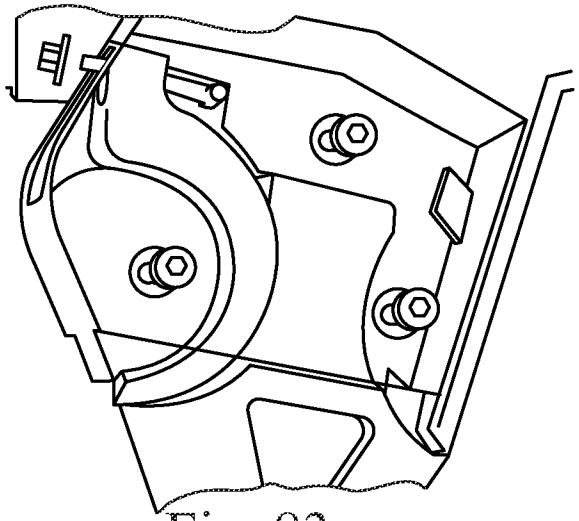
FIG. 83 is a perspective view of the ripper implement of FIG. 82, illustrating the fastener in the inserted configuration, with the nut removed to enable withdrawing.
Figure 84:
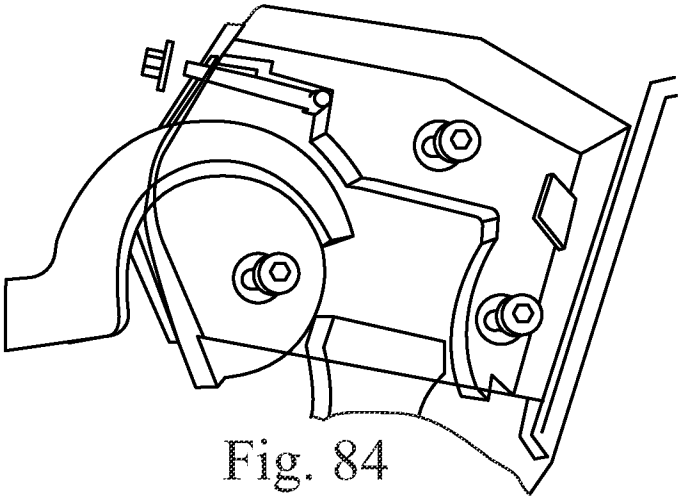
FIG. 84 is a perspective view of the ripper implement of FIG. 82, illustrating the fastener and ripper tooth partially removed from the implement.
Figure 82:
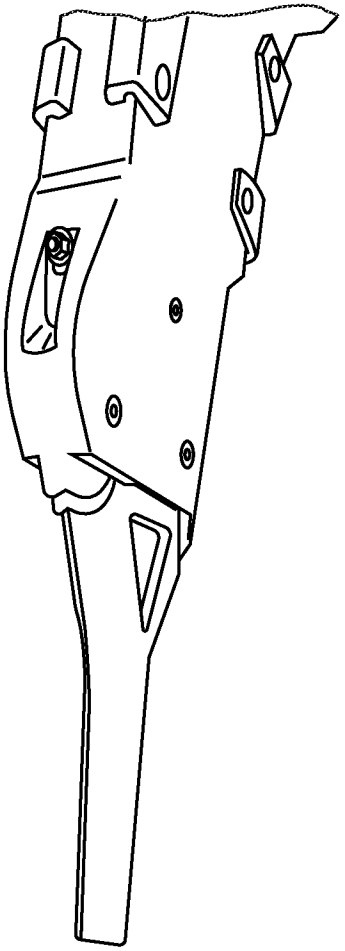
FIG. 82 is a perspective view of a excavator ripper implement with a ripper tooth attached to the tip, using another exemplary embodiment of the present fastener.
Figure 85:
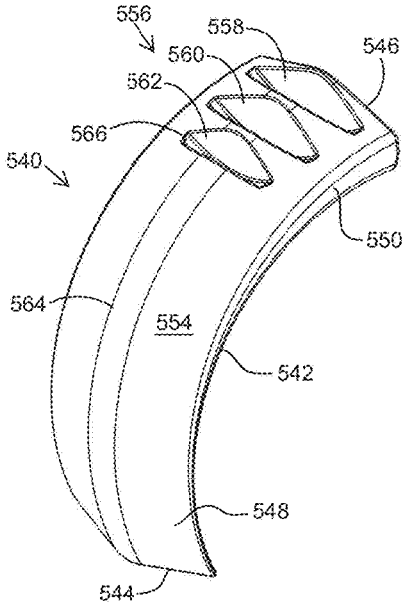
FIG. 85 is a perspective view of an embodiment of a fastener.
Figure 86:
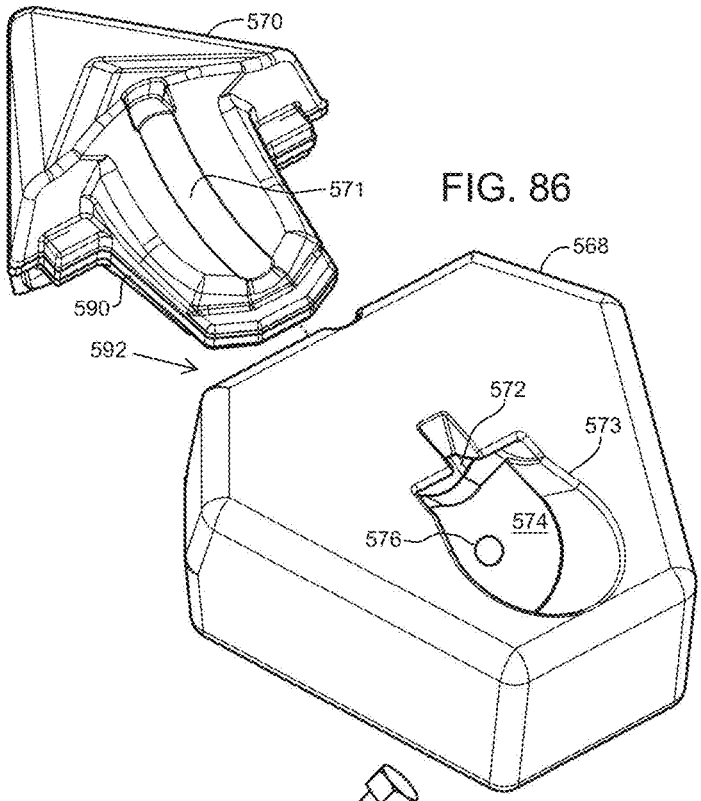
FIG. 86 is exploded perspective view of an embodiment of a tooth aligned and ready to connect to the lip adapter of an implement.
Figure 87:
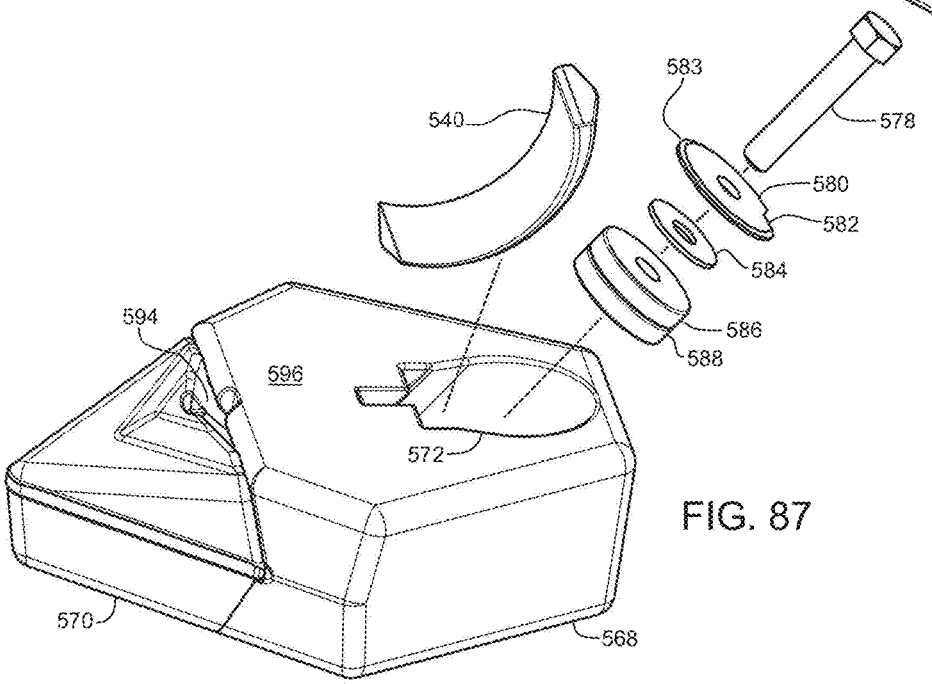
FIG. 87 is exploded perspective view of the lip assembly of FIG. 87, with the fastener of FIG. 85 aligned with the assembled tooth and lip adapter to assemble a lip assembly.
Figure 88:
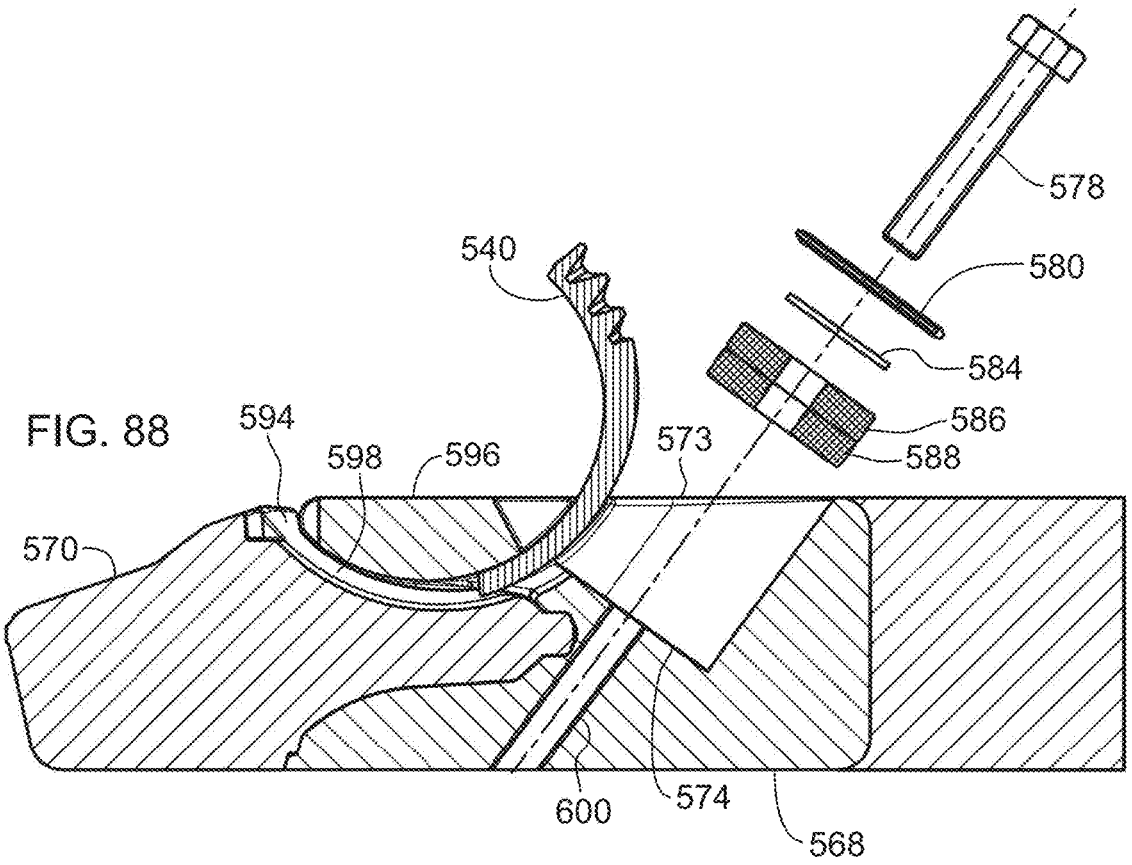
FIG. 88 is a cross-sectional exploded view of the assembly of FIG. 87, aligned to assemble the lip assembly.
Figure 89:
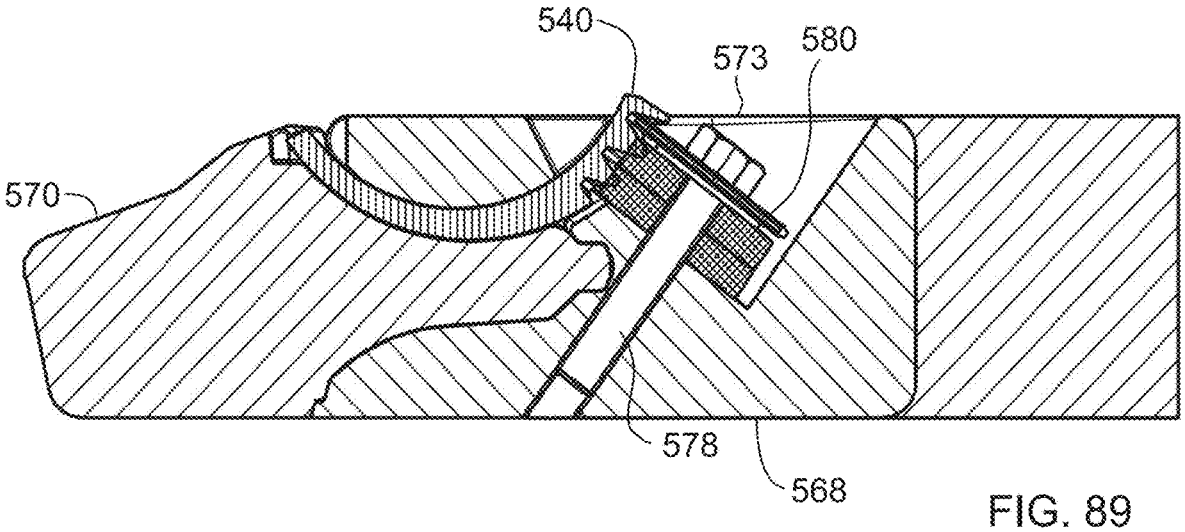
FIG. 89 is an assembled cross-sectional view of the assembly of FIG. 88.

The fastener usage example of FIGS. 82-84 illustrates that the T-bolt (as described in reference to FIGS. 1-8) can be pivoted within the tooth rather than within the elongate arcuate body (as shown in FIG. 6). A flange on the fastener engages the threaded rod of the T-bolt to secure the fastener within the passage.

Looking now at FIGS. 85-89, yet another embodiment of the fastener 540 is disclosed. The elongate arcuate body 542 of the fastener 540 generally includes a first end 544 opposite a second end 546. A first portion 548 is a region of the elongate arcuate body 542 that is closer in proximity to the first end 544 than the second end 546, and can, in one or more embodiments, include or exclude within that region the first end 544. A second portion 550 is a region of the elongate arcuate body 542 that is closer in proximity to the second end 546 than the first end 544, and can, in one or more embodiments, include or exclude within that region the second end 546.

Looking at the outer surface of the elongate arcuate body 542, there is an inner surface 552 opposing and generally having a smaller radius (or an offset center of the radius) than the outer surface 554. Although the curvature of the inner surface 552 and the outer surface 554 are described as having a radius, the curvature of each of the surfaces can have a constant radius (e.g., an arc of a circle) or a radius that is variable or not constant (e.g., an arc of an ellipse or a curvilinear shape). Furthermore, portions of the inner surface 552 and the outer surface 554 may include non-curved surfaces (e.g., depressions, protrusions, planar portions, and so on). Thus, the radius or curvature of the elongate arcuate body 542 in general, the inner surface 552, and the outer surface 554, can mean, in one or more embodiments, that the general curvature is considered while ignoring relatively small discontinuities between the first portion 548 and the second portion 550. The cross-sectional shape of the elongate arcuate body 542, in this example, changes along its length or arc, starting as a five-sided polygon (e.g., a pentagon or pentagon-like shape) at the second end 546, and tapering or thinning to a three- to five-sided polygon (a three-sided polygon in this example) at the first end 544 and having a smaller cross-sectional area than the second end 546. The cross-sectional shapes delineate a ridge 564 that runs at least some or all the length of the elongate arcuate body 542 on the outer surface 554. The outer surface 554 is generally gabled with a radiused peak to form the ridge 564; although, other shapes can form the ridge 564 with similar function.

The retaining portion 556, in this example, comprises one or more notches 558, 560, 562 or steps that are cut into the ridge 564 of the outer surface 554. In this example, three notches 558, 560, 562 are formed, spaced apart, in series on the second portion 550. The walls of the notches 558, 560, 562 converge towards an annular bottom portion 566, that provides a space between the two walls, with the ridge 564 intersecting through the approximate middle of each of the notches 558, 560, 562.

The present embodiment is constructed and operates somewhat similarly to the embodiments of FIGS. 43-55; and similar aspects will not be explained at length. The tooth 570 (or other attachment, such as a wear part or adapter) includes a nose 590 for insertion into the cavity 592 of the base portion 568 (e.g., a lip adapter or the like). The nose 590 includes a seat 571 that, when inserted into the cavity 592, defines a passage 598 between the seat 571 and the cross member; and further defines an access hole 594 at the terminus of the passage 598. The fastener 540 is inserted by the first end 544 into the entry hole 572 formed within the recess 573 of the base portion 568. Then, optional spacers 586, 588 are positioned within the recess 573, resting on the spacer seat 574, followed by a washer 584 and retainer 580, all stacked with through holes aligned for insertion of a threaded bolt 578 therethrough. The retainer 580, in this example, is circular with a notch or clearance 582 cut into the perimeter edge 583. The perimeter edge 583 is beveled both top and bottom, rounded, or otherwise converging so that it easily registers into the notches 558, 560, 562, where the beveled edge will be guided by the converging walls of one of the notches 558, 560, 562 to center the beveled edge within the corresponding notch. Optionally, when the retainer 580 is placed within the recess 573, the notch 582 is aligned with the ridge 564 of the fastener 540, such that the notch 582 provides clearance between the retainer 580 and the ridge 564 to permit easy retainer 580 insertion into the recess 573 and insertion of the threaded bolt 578. Once the threaded bolt 578 is hand threaded into the threaded hole 600, the retainer 580 can be located into one of the notches 558, 560, 562 (whichever notch is best for securing the fastener 540 given the specific arrangement of parts) and rotated so that the notch 582 is misaligned with the ridge 564 and the beveled edge 583 is registered within one of the notches 558, 560, 562. As the bolt 578 is threaded into the threaded hole 600, the retainer 580 bears upon the notch and further pushes the fastener 540 within the passage 598. Then, the threaded bolt 578 can be fully tightened to the recommended torque to secure the fastener 540 within the passage 598, effectively fastening the base portion 568 to the tooth 570. The retainer 580 is mechanically and frictionally engaged within one of the notches 558, 560, 562, such that the fastener 540 cannot be retracted and the retainer 580 cannot be rotated, unless the threaded bolt 578 is loosened.

Figure 90:
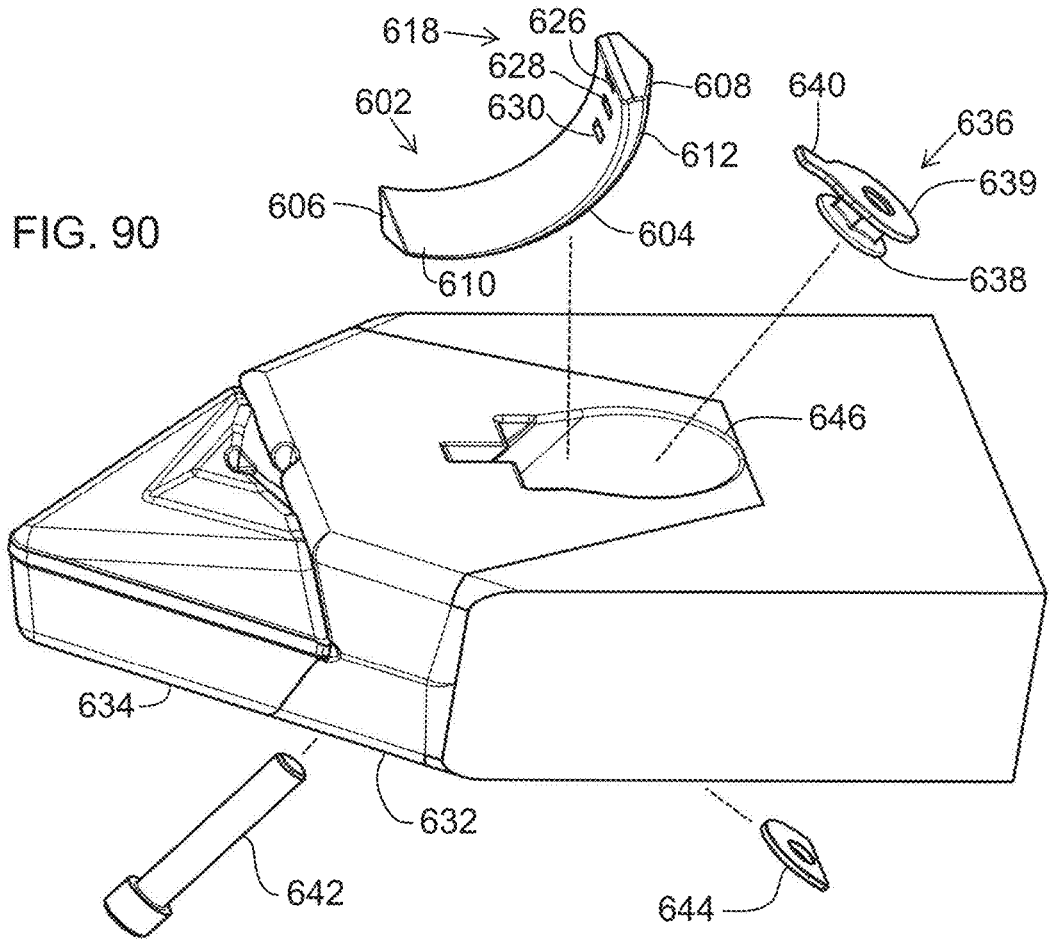
FIG. 90 is exploded perspective view of an example lip assembly, with a fastener aligned with the assembled tooth and lip adapter to assemble a lip assembly.
Figure 91:
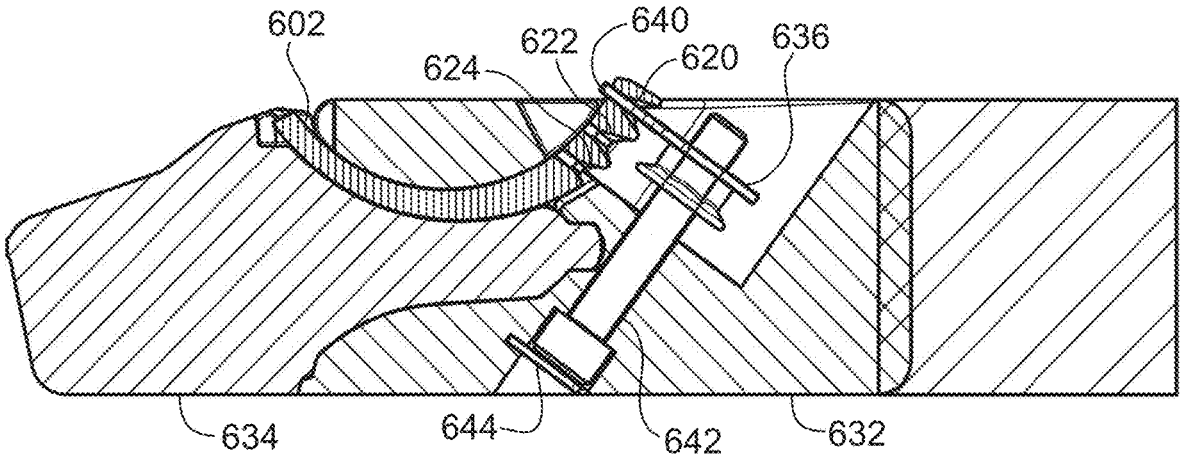
FIG. 91 is an assembled cross-sectional view of the lip assembly of FIG. 90.

Referring now to FIGS. 90 and 91, a modified version of the embodiment of FIGS. 85-89 is illustrated. As there are many similarities, only the differences will be explained. The fastener 618 is substantially the same as fastener 540, except the notches 620, 622, 624 include through holes or slots 626, 628, 630 located at the bottom of each notch 620, 622, 624 and formed through the elongate arcuate body 604. Alternatively, instead of through holes, blind holes can be formed at the bottoms of the notches 620, 622, 624. The fastener 618 includes an elongate arcuate body 604 with a first end 606 opposite a second end 608, with a first portion 610 nearest the first end 606 and a second portion 612 nearest the second end 608. A retaining portion 618 is located on the second portion 612. The retainer 636 includes a female threaded nut 638 with a tab 640 protruding laterally from nut 638. During installation, the tooth 634 and the base portion 632 are brought into engagement; and the fastener 602 is inserted within the passage 646 to prevent disengagement of the tooth 634 and base portion 632. A threaded bolt 642 is inserted through the base portion 632 and loosely threaded into the nut 638 of the retainer 636. The tab 640 is inserted into on of the slots 626, 628, 630. Because the retainer 636 includes a disc portion 639 with the tab 640 extending radially from the disc portion 638, when the tab 640 is inserted into one of the slots 626, 628, 630, the edge of the disc portion 638 is also engaged within the corresponding notch 620, 622, 624. Once the selected notch and corresponding slot is chosen by the installer, the threaded bolt 642 can be tightened to the recommended torque to draw the retainer 636 toward the bottom 648 of the recess 646. In this example, spacers are optional. A protective cover 644 is installed over the head of the bolt 642.

The two example embodiments illustrated in FIGS. 85-91 share the same broad concept of a retainer engaging a notch or a notch with a through hole or keyhole cut into the fastener. This enables the user to loosen the bolt (or other standard fastener) partially. Because the retainer remains engaged with the fastener as the bolt is loosened, loosening the bolt will withdraw the fastener from the passage at least partially without disengaging the retainer from the notch and/or through hole. Thus, the elongate arcuate body of the fastener is withdrawn from the passage sufficiently to permit the tooth to be separated from the adapter (or base, lip, etc.) and replaced with a tooth or other wear component. In this way, the bolt, retainer, fastener, etc. need not be completely removed in order to replace the wear component.

Aspects of the present specification may also be described as follows:

1. A fastening system for securely coupling a first body to a second body, the fastening system having a fastener with an elongate arcuate body curved along a longitudinal axis and having a cross-sectional area taken planar normal to the longitudinal axis, the elongate arcuate body comprising a first portion separated along the longitudinal axis from a second portion with the cross-sectional area of the elongate body increasing from the first portion to the second portion, a first cross sectional area taken proximate to the first portion is smaller in area than a second cross sectional area taken proximate to the second portion, the fastener further having a retaining portion; a converging passage delineated between the first body and the second body when coupled, the converging passage configured to receive the elongate arcuate body therewithin in an inserted configuration where the first body and the second body are prevented from decoupling; and a retainer configured to be secured to the first body and configured to be selectively engaged with the retaining portion of the fastener to selectively secure the elongate arcuate body in the inserted configuration and prevent retraction of the elongate arcuate body from the inserted configuration.

2. The fastening system of embodiment 1 where the retaining portion comprises a notch cut into the elongate arcuate body, the retainer is configured to selectively engage within the notch to prevent retraction of the elongate arcuate body from the inserted configuration.

3. The fastening system of embodiments 1 or 2 where the notch further includes a through hole for receiving a tab of the retainer.

4. A fastener securely coupling a first body to a second body, including an elongate arcuate body curved along a longitudinal axis and having a cross-sectional area taken planar normal to the longitudinal axis, the elongate arcuate body comprising a first portion separated along the longitudinal axis from a second portion with the cross-sectional area of the elongate body increasing from the first portion to the second portion; and a retaining portion configured to selectively secure the elongate arcuate body in an inserted configuration; where the elongate arcuate body is configured to selectively couple the first body to the second body which are overlapping at least in part.

5. The fastener of embodiment 4 where the cross-sectional area of the elongate arcuate body increases continuously from the first portion to the second portion.

6. The fastener of embodiments 4 or 5 where the cross-sectional area of the elongate arcuate body increases discontinuously from the first portion to the second portion.

7. The fastening system of any one of embodiments 4-6 where the cross-sectional area of the elongate arcuate body wherein a first cross sectional area taken proximate to the first portion is smaller in area than a second cross sectional area taken proximate to the second portion.

8. The fastening system of any one of embodiments 4-7 where the first cross-sectional area and the second first cross-sectional area are each ellipse-shaped.

9. The fastening system of any one of embodiments 4-8 where the retaining portion is proximate to the first portion and substantially prevents retraction of the elongate arcuate body from the inserted configuration.

10. The fastening system of any one of embodiments 4-9 where the retaining portion comprises a rod member extending from and pivoted by a proximal end to the elongate arcuate body proximate to the first portion and a retainer configured to selectively attach to a distal end of the rod member to mechanically block retraction of the elongate arcuate body from the inserted configuration.

11. The fastening system of any one of embodiments 4-10 where the elongate arcuate body further comprises a second end proximate to the second portion, an extraction bore being formed into the second end.

12. The fastening system of any one of embodiments 4-11 where the elongate arcuate body further comprises an outer surface adjacent to the second end with an undercut hole formed into the outer surface and configured to receive a retaining lug of a protective cover selectively attachable to the elongate arcuate body.

13. The fastening system of any one of embodiments 4-12 where the elongate arcuate body further comprises a first end proximate to the first portion, and wherein the retaining portion comprises a threaded bore formed into the first end, the first end configured to bear against a shoulder when in the inserted configuration with the shoulder captured between the first end and a threaded fastener engaged within into the threaded bore to mechanically block retraction of the elongate arcuate body from the inserted configuration.

14. The fastening system of any one of embodiments 4-13 where the elongate arcuate body further comprises a first end proximate to the first portion and a second end proximate to the second portion, and an outer arced surface opposite an inner arced surface and adjacent to each of and extending between the first end, the retaining portion comprises an engagement groove formed on the outer arced surface.

15. The fastening system of any one of embodiments 4-14 where the at least one engagement groove comprises a series of engagement grooves, one or more of the series of engagement grooves.

16. The fastening system of any one of embodiments 4-15 where an engagement clamp is spring biased to bear upon the elongate arcuate body to force the engagement groove into selective engagement with a detent to mechanically block retraction of the elongate arcuate body from the inserted configuration.

17. The fastening system of any one of embodiments 4-16 where the retaining portion comprises a flange extending from the elongate arcuate body and having a fastener clearance formed through the flange.

18. The fastening system of any one of embodiments 4-17 where the retaining portion comprises a first threaded bore proximate the first portion, the first threaded bore configured to threadably receive a first threaded fastener therethrough to mechanically block retraction of the elongate arcuate body from the inserted configuration.

19. The fastening system of any one of embodiments 4-18 where the elongate arcuate body further comprises and a second threaded bore proximate the second portion, the second threaded bore configured to threadably receive a second threaded fastener therethrough to mechanically limit insertion of the elongate arcuate body when in the inserted configuration.

20. The fastening system of any one of embodiments 4-19 where the retaining portion comprises a catch hole in the elongate arcuate body proximate the first portion, the catch hole configured to receive a catch therein to mechanically block retraction of the elongate arcuate body from the inserted configuration.

The foregoing description of presently preferred embodiments of the invention has been presented for the purposes of illustration and description only. It is not intended to be exhaustive or to limit the invention to the precise form(s) disclosed. Many modifications and variations are possible in light of the above teachings while remaining consistent with the spirit of the invention. It is intended that the scope of the invention not be limited by this detailed description.

What is claimed is:

1. A fastening system for securely coupling a first body to a second body, the fastening system comprising:

a fastener with an elongate arcuate body curved along a longitudinal axis and having a cross-sectional area taken planar normal to the longitudinal axis, the elongate arcuate body comprising a first portion separated along the longitudinal axis from a second portion with the cross-sectional area of the elongate body increasing from the first portion to the second portion, a first cross sectional area taken proximate to the first portion is smaller in area than a second cross sectional area taken proximate to the second portion, the fastener further having a retaining portion;

a converging passage delineated between the first body and the second body when coupled, the converging passage configured to receive the elongate arcuate body of the fastener therewithin in an inserted configuration where the first body and the second body are prevented from decoupling; and a retainer configured to be selectively secured to the first body and configured to be selectively engaged with the retaining portion of the fastener to selectively force the elongate arcuate body into the inserted configuration in a tightening procedure where the retainer forces the fastener to move into the converging passage and prevents retraction of the elongate arcuate body from the inserted configuration.

2. The fastener of claim 1 wherein the retaining portion comprises a notch formed into the elongate arcuate body, the retainer is configured to selectively engage within the notch to prevent retraction of the elongate arcuate body from the inserted configuration.

3. The fastener of claim 2 wherein the notch further includes a through hole for receiving a tab of the retainer.

4. The fastening system of claim 1 wherein the retainer is configured to selectively withdraw the fastener from the inserted configuration in a loosening procedure where the elongate arcuate body is sufficiently pulled out of the converging passage by the retainer to permit the second body to decouple from the first body.

5. The fastening system of claim 1 wherein the retainer further comprises a threaded portion for threadably engaging the first body, wherein when the retainer is threaded into the first body the fastener is forced to move in a first direction and when the retainer is threaded out of the first body the fastener is forced to move in a second direction opposite the first direction.

6. The fastening system of claim 1 wherein the retainer comprises a clearance portion that permits the fastener to be retracted from the converging passage and separated from the first body and the second body when retaining portion of the fastener is aligned with the clearance portion, and prevents the fastener from being separated from the first body and the second body when retaining portion of the fastener is not aligned with the clearance portion.

7. The fastening system of claim 1 wherein the retainer is circular and the clearance portion is a notch formed into a perimeter edge of the retainer.

8. A fastener securely coupling a first body to a second body, comprising:

an elongate arcuate body curved along a longitudinal axis and having a cross-sectional area taken planar normal to the longitudinal axis, the elongate arcuate body comprising a first portion separated along the longitudinal axis from a second portion with the cross-sectional area of the elongate body increasing from the first portion to the second portion; and a retaining portion configured to engage a retainer in a tightening procedure to selectively secure the elongate arcuate body in an inserted configuration where the first body is coupled to the second body, and the retaining portion configured to remain engaged with the retainer in a loosening procedure with the retainer being configured to selectively withdraw the elongate arcuate body from the inserted configuration by a pulling force where the elongate arcuate body is sufficiently retracted by the retainer to permit the second body to decouple from the first body.

9. The fastener of claim 8 wherein the cross-sectional area of the elongate arcuate body increases continuously from the first portion to the second portion.

10. The fastener of claim 8 wherein the cross-sectional area of the elongate arcuate body increases discontinuously from the first portion to the second portion.

11. The fastener of claim 8 wherein the cross-sectional area of the elongate arcuate body wherein a first cross-sectional area taken proximate to the first portion is smaller in area than a second cross sectional area taken proximate to the second portion.

12. The fastener of claim 8 wherein the first cross-sectional area and the second first cross-sectional area are each ellipse-shaped.

13. The fastener of claim 8 wherein the retaining portion is proximate to the first portion and substantially prevents retraction of the elongate arcuate body from the inserted configuration.

14. The fastener of claim 8 wherein the elongate arcuate body further comprises a first end proximate to the first portion and a second end proximate to the second portion, and an outer arced surface opposite an inner arced surface and adjacent to each of and extending between the first end, the retaining portion comprises an engagement groove formed on the outer arced surface.

15. The fastener of claim 14 wherein the engagement groove comprises a series of engagement grooves arranged in parallel.

16. The fastener of claim 15 wherein the elongate arcuate body further comprises and a second threaded bore proximate the second portion, the second threaded bore configured to threadably receive a second threaded fastener therethrough to mechanically limit insertion of the elongate arcuate body when in the inserted configuration.

17. The fastener of claim 8 wherein the retaining portion comprises a catch hole in the elongate arcuate body proximate the first portion, the catch hole configured to receive a catch therein to mechanically block retraction of the elongate arcuate body from the inserted configuration.

* * * * *